US006331765B1

(12) United States Patent
Yamamoto et al.

(10) Patent No.: US 6,331,765 B1
(45) Date of Patent: Dec. 18, 2001

(54) SERIES COMPENSATOR

(75) Inventors: Hajime Yamamoto, Yokohama; Shigeru Tanaka, Inagi; Masaaki Shigeta, Tokyo; Mami Mizutani, Hachioji; Yukitaka Monden, Yokohama; Hiroshi Uchino, Hachioji, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/512,455

(22) Filed: Feb. 24, 2000

(30) Foreign Application Priority Data

Feb. 25, 1999 (JP) ..... 11-047983

(51) Int. Cl.[7] ..... G05F 1/70
(52) U.S. Cl. ..... 323/210
(58) Field of Search ..... 323/205, 208, 323/209, 210; 363/34, 35, 37

(56) References Cited

U.S. PATENT DOCUMENTS 4,999,565 * 3/1991 Nilsson ..... 323/210
5,198,746 3/1993 Gyugyi et al. .
5,627,735 * 5/1997 Bjorklund et al. ..... 363/35
5,666,277 * 9/1997 Bjorklund et al. ..... 363/64
5,942,880 * 8/1999 Akamatsu et al. ..... 323/210

FOREIGN PATENT DOCUMENTS

10114388 A 5/1998 (JP) .
10124369 A 5/1998 (JP) .

* cited by examiner

*Primary Examiner*—Matthew Nguyen
(74) *Attorney, Agent, or Firm*—Oblon, Spivak, McClelland, Maier & Neustadt, P.C.

(57) ABSTRACT

A series compensator, connected in series to an AC transmission line, for compensating for an electric amount, such as a voltage, current, phase or impedance, of the AC transmission line, comprises a first capacitor and a second capacitor connected in series to each other and connected to the AC transmission line, and a compensation current generator connected in parallel to the first capacitor. This structure eliminates the need for a bypass transmission line to simplify the main transmission line structure, has an enhanced current controllability, reduces harmonics to be generated and realizes an economical way of ensuring a large compensation amount.

25 Claims, 46 Drawing Sheets

SERIES COMPENSATOR

CROSS-REFERENCE TO RELATED APPLICATION

This application is based upon and claims the benefit of priority from the prior Japanese Patent Application No. 11-047983, filed Feb. 25, 1999, the entire contents of which are incorporated herein by reference.

BACKGROUND OF THE INVENTION

The present invention relates to an improvement on a series compensator which is constructed by a power converter connected in series to an AC transmission line via a transformer and compensates for an electric quantity of the AC transmission line such as the voltage, current, phase or impedance.

Recently, the capacity of switching devices with intrinsic turn-off capabilities have increased and large-capacity self-commutated converters for high voltage power transmission lines to control the power thereof are being put to a practical use.

A compensator which is connected in series to an AC transmission line via a series transformer and which electrically compensates for the impedance of a power transmission line by generating a compensation voltage on the primary winding of the series transformer, thereby controlling the power flow on the transmission line, or which compensates for a variation in transmission line voltage is known as disclosed in, for example, "Static Synchronous Series Compensator: A Solid-State Approach to Series Compensator of Transmission Lines" (L. Gyugyi et al., IEEE PES 96 WM 120-6 PWRD, 1996).

FIG. 1 is a block transmission line diagram exemplifying the structure of a conventional series compensator of this type.

In FIG. 1, "G" is an AC power supply, "X1" is the transmission line inductance of an AC transmission line, "Tr1" is a series transformer, "CNV" is a power converter, "BP" is a bypass transmission line and "FL" is a harmonic filter.

The power converter CNV is structured by bridge-connecting a switching device with intrinsic turn-off capabilities like a gate turn-off thyristor (hereinafter called "GTO") and is capable of generating a voltage with an arbitrary amplitude and arbitrary frequency in accordance with the voltage and current of an AC transmission line by controlling the switching of the GTO.

The voltage generated by the power converter CNV is applied to the secondary winding of the series transformer Tr1, generating a voltage on the primary winding that is connected in series to the transmission line. The transmission line inductance X1 of the AC transmission line can be compensated by properly controlling the level and phase of the voltage generated on the primary winding of the series transformer Tr1 with respect to the voltage and current of the AC transmission line.

FIG. 2 is a vector diagram for explaining the principle of a method of compensating for the transmission line inductance.

In FIG. 2, "Vs" denotes the voltage vector of the AC transmission line, "Is" denotes the current vector of the AC transmission line, "Vc" denotes the voltage vector a power converter 4 generates on the primary winding of the series transformer Tr1, and "V1" and "V2" respectively denote the primary-side terminal voltage vector of the series transformer Tr1 on the power-supply side and the primary-side terminal voltage vector of the series transformer Tr1 on the load side.

Given that the transmission line inductance is L and the frequency of the AC power supply is ω, the relationship between the AC supply voltage vector Vs and the primary-side terminal voltage V1 of the series transformer Tr1 is expressed by the following equation.

$$\bar{V}1=\bar{V}s-j\omega L\bar{I}s \tag{1}$$

The primary-side terminal voltage V1 of the series transformer Tr1 has a phase delay of δ and is lower by ΔV with respect to the AC supply voltage Vs due to a voltage drop caused by the transmission line inductance L.

When the power converter CNV generates the compensation voltage Vc advanced by 90 degrees relative to the transmission line current on the primary winding of the series transformer Tr1, the primary-side terminal voltage vector V2 of the series transformer Tr1 on the load side changes in the direction of Vs and the phase delay and voltage drop with respect to the AC supply voltage Vs are reduced.

This is electrically equivalent to the transmission line inductance L having become smaller, and the transmission line inductance can be changed equivalently by changing the level of the compensation voltage Vc.

In general, given that the voltage at the sending end is Vs, the voltage at the receiving end is Vr and the phase difference between the voltages of the sending end and the receiving end is θ, the maximum active power P that can be transmitted is given by the following equation.

$$P=\frac{VsVr}{\omega L}\sin\theta \tag{2}$$

Because the maximum power that can be transmitted is inversely proportional to the transmission line inductance, the maximum transmission power can be increased by electrically compensating the transmission line inductance of a transmission line with large transmission line inductance.

In the structure in FIG. 1, as the AC transmission line and the power converter CNV are connected in series via the series transformer Tr1 in whose primary winding the same current as the transmission line current flows, the output current of the power converter CNV connected to the secondary winding of the series transformer Tr1 is constrained to the transmission line current.

When a large current flows in the transmission line due to a ground fault or the like, therefore, an excess current also flows in the power converter.

Designing the power converter so as to withstand such a large current means that a power converter having a very large capacity is used. However, the output that is needed in the normal state requires a much lower capacity such that its use is not economical.

In this respect, the bypass transmission line BP as shown in FIG. 1 is connected to the output terminal of the power converter CNV so that in case of a ground fault, the bypass transmission line BP is activated upon detection of the excess current, short-circuiting the output of the power converter. As the current constrained to the transmission line current is shifted to the bypass transmission line, the switching elements of the power converter are all turned off (gate-blocked) to prevent any excess current from flowing into the power converter.

As apparent from the above, the bypass transmission line is essential in the prior art and in case of a ground fault, the power converter should be gate-blocked to stop operation.

When the power converter is a voltage source converter as shown in FIG. 1, the current control system is generally structured to detect the output current. In a case of a series compensator, however, the output current is constrained to the transmission line current because of the above-described reason, so that current control cannot be performed.

For the series compensator, the voltage control system is designed to feedback the voltage applied to the winding of the series transformer. Since the voltage control system does not have an ability to suppress excess current that is likely to be induced by a disturbance on the transmission line side, excess current must be separately compensated.

The power converter generates a voltage with an arbitrary amplitude and arbitrary frequency by controlling the switching of the switching device with intrinsic turn-off capabilities but produces harmonics in accordance with the switching operation.

As the series compensator in FIG. 1 is connected in series to the transmission line via the series transformer, the harmonic voltage generated by the power converter is added directly to the transmission line voltage, making it essential to provide a harmonic filter like FL shown in FIG. 1.

To reduce the harmonics generated by the power converter, multiple converters should be connected.

The amount of compensation of the series compensator directly corresponds to the capacity of the power converter, so a power converter having a very large capacity to realize a large compensation amount is needed. This leads to an increase in the cost of the series compensator. Even when the transmission line inductance is large and large compensation is needed, it is preferred to restrict the compensation amount to reduce costs.

The above problems will be summarized as follows.

Because the power converter in the conventional series compensator is connected in series to the transmission line, the output current of the power converter is the transmission line current. As a result, it is necessary to provide a bypass transmission line at the output of the power converter in order to protect the power converter when excess current flows in the transmission line due to a ground fault or the like.

Since current control cannot be performed on the output current of the power converter, the excess current is likely to be induced by the disturbance on the transmission line.

As the harmonic voltage is directly applied to the transmission line, it is essential to provide a harmonic filter and multiple converters.

An increase in the compensation amount directly leads to an increase in the capacity of the power converter, so that sufficient compensation cannot be achieved.

In the meantime, protection systems for the above series compensators have the following shortcomings.

FIG. 60 exemplifies the transmission line structure of another conventional series compensator.

In FIG. 60, "1" is an AC transmission line voltage source, "2" denotes AC transmission lines, "3" is the line reactance of the AC transmission lines, "4" is a series transformer, "5" is a DC voltage source, "6" denotes a switching device with intrinsic turn-off capabilities, "7" denotes a diode, "8" is a voltage source converter which is constituted by the DC voltage source 5, the switching elements 6 and the diodes 7, "9" is a PWM control transmission line which determines the output voltage of the voltage source converter 8, "10" is a filter transmission line, "11" denotes a thyristor and "12" is a thyristor bypass transmission line including the thyristors 11.

The transmission line operation of the series compensator in FIG. 60 will now be discussed. The voltage source converter 8 generates an arbitrary AC output voltage Vo according to a switching pattern output from the PWM control transmission line 9. The AC output voltage Vo is supplied via the series transformer 4 in series to the AC transmission lines 2. FIG. 61 presents a voltage/current vector diagram when the winding ratio of the series transformer is 1:1. Given that the AC transmission line current is Is and the AC transmission line voltage is Vs, as the AC transmission line current flows through the line reactance 3, a reactance voltage VL is produced across the line reactance 3. The transmission line-voltage side terminal voltage of the series transformer 4, V1, becomes Vs+VL. As the output voltage Vo of the voltage source converter 8 can be output freely within a hatched circle in the transmission line from the center of this circle, a terminal voltage V2 on the other side of the series transformer 4 is V1+Vo=Vs+VL+Vo. The voltage component VL+Vo becomes an apparent impedance on the AC transmission lines, and controlling the voltage source converter 8 can provide the same effect as obtained by designing the line reactance 3 of the AC transmission lines variable.

The filter transmission line 10 serves to eliminates the harmonic component from the output voltage of the voltage source converter 8. The thyristor bypass transmission line 12 has each pair of thyristors 11 connected in parallel in the opposite directions, and short-circuits the windings of the series transformer 4 as the thyristors 11 are rendered conductive or enabled. When a ground fault or the like occurs in the AC transmission lines, a very large current flows through the AC transmission lines. If the thyristor bypass transmission line 12 were not used, this excess current would flow inside the voltage source converter 8 via the series transformer 4. In this respect, it is necessary to design the voltage source converter 8 so as to have a capacity large enough to endure such an excess current. This inevitably enlarges the series compensator. As the thyristor bypass transmission line 12 is used, when an excess current is produced due to a transmission line fault or the like, the excess current is made to flow through the thyristor bypass transmission line 12 by enabling the thyristors 11. During a transmission line fault, the gate of the voltage source converter 8 is blocked so that the voltage source converter 8 stops operating. It is therefore possible to design the voltage source converter 8 to function in a normal operation without considering an excess current which is generated at the time of a transmission line fault.

Because this conventional series compensator protects the voltage source converter against a transmission line fault by letting the excess current on the AC transmission lines flow through the compensation current generator thyristor bypass transmission line, the thyristor bypass transmission line must be designed as to have a capacity large enough to endure the excess current from the AC transmission lines. As a result, the thyristor bypass transmission line itself must be a large-capacity structure. In this respect, there is a demand for a series compensator which can protect the series capacitor and converter against a rising voltage and an excess transmission line current without requiring a thyristor bypass transmission line.

Further, during a transmission line fault, the thyristor bypass transmission line short-circuits the terminals of the series transformer, blocking the gate of the voltage source converter so that the voltage source converter stops operating. For the series compensator to resume the transmission line impedance compensating operation after the transmission line fault is eliminated, the thyristor bypass transmission line must be shut down before the operation of the voltage source converter is permitted. This resuming operation takes time. It is therefore desirable to provide a series compensator which can allow a compensation current generator to continuously operate even during a transmission line fault and can resume the transmission line impedance compensating operation promptly after the transmission line fault is eliminated.

BRIEF SUMMARY OF THE INVENTION

Accordingly, it is an object of the present invention to provide a series compensator which eliminates the need for a bypass transmission line to simplify the main transmission line structure, has an enhanced current controllability, reduces harmonics to be generated and realizes an economical way of ensuring a large compensation amount.

It is another object of this invention to provide a series compensator which can protect a series capacitor and converter against a rising voltage and an excess transmission line current without requiring a thyristor bypass transmission line.

It is a further object of this invention to provide a series compensator which can allow a compensation current generator to continuously operate even during a transmission line fault and can resume the transmission line impedance compensating operation promptly after the transmission line fault is eliminated.

According to one aspect of the present invention, there is provided a series compensator, for compensating for an electric amount of an AC transmission line, comprising: a first capacitor and a second capacitor connected in series to each other and connected to the AC transmission line; and a compensation current generator connected in parallel to the first capacitor.

In the series compensator, the second capacitor may be made up of a plurality of capacitors connected in series to one another and a plurality of switches respectively connected in parallel to the plurality of capacitors.

According to another aspect of the present invention, there is provided a series compensator, for compensating for an electric amount of an AC transmission line, comprising: a transformer connected in series to the AC transmission line; a first capacitor connected via the transformer to the AC transmission line; and a compensation current generator connected in parallel to the first capacitor.

According to still another aspect of the present invention, there is provided a series compensator, for compensating for an electric amount of the AC transmission line, comprising: a transformer connected in series to the AC transmission line; a first capacitor and a second capacitor connected in series to each other and connected via the transformer to the AC transmission line; and a compensation current generator connected in parallel to the first capacitor.

In the series compensator, the second capacitor may have a plurality of capacitors connected in series to one another and a plurality of switches respectively connected in parallel to the plurality of capacitors.

In the series compensator, the compensation current generator may have a transformer and a current source converter using switching elements connected to the transformer.

In the series compensator, the compensation current generator may have a transformer, a voltage source converter using switching elements connected to the transformer and a current control transmission line for controlling an output current of the voltage source converter.

In the series compensator, the compensation current generator may have a voltage source converter using switching elements and a current control transmission line for controlling an output current of the voltage source converter.

In the series compensator, the compensation current generator may generate a current having a phase the same as or opposite to that of a current of the AC transmission line based on the current of the AC transmission line.

The series compensator may further comprise: a detection transmission line for detecting a transmission line current flowing in the AC transmission line and a voltage thereof; a calculation transmission line for calculating an active current component and reactive current component flowing in the AC transmission line; and a fluctuation control transmission line for generating a compensation current instruction to suppress fluctuation in the AC transmission line based on a ratio of a change in the transmission line current, a variation in the active current component and a variation in the reactive current component.

The series compensator may further comprise: a capacitor voltage detection transmission line for detecting a voltage across the first capacitor connected in series to the AC transmission line; a DC component calculation transmission line for calculating a DC voltage component of the first capacitor from an output of the capacitor voltage detection transmission line; and a DC component suppressing transmission line for generating a compensation current instruction based on a signal obtained by compensating an amplitude and phase of an output of the DC component calculation transmission line. In this case, the capacitor voltage detection transmission line may have a detection transmission line for detecting a transmission line current flowing in the AC transmission line and an integration transmission line for calculating a voltage across the first capacitor connected in series to the AC transmission line.

In the compensator, the compensation current generator may have a transformer, a first current source converter using switching elements connected to the transformer, a second current source converter connected in parallel to the AC transmission line using switching elements, a reactor for connecting a DC portion of the first current source converter and a DC portion of the second current source converter and a DC current control transmission line for controlling a current across the reactor.

In the compensator, the compensation current generator may have a first current source converter using switching elements, a second current source converter connected in parallel to the AC transmission line using switching elements, a reactor for connecting a DC portion of the first current source converter and a DC portion of the second current source converter and a DC current control transmission line for controlling a current across the reactor.

In the compensator, the compensation current generator may have a transformer, a first voltage source converter using switching elements connected to the transformer, a second voltage source converter connected in parallel to the AC transmission line using switching elements, a third capacitor for connecting a DC portion of the first voltage source converter, a first current control transmission line for controlling an output current of the first voltage source converter, a second current control transmission line for controlling an output current of the second voltage source converter, and a DC portion of the second voltage source converter and a DC voltage control transmission line for controlling a voltage across the third capacitor.

In the compensator, the compensation current generator may have a first voltage source converter using switching elements, a second voltage source converter connected in parallel to the AC transmission line using switching elements, a second capacitor for connecting a DC portion of the first voltage source converter, a first current control transmission line for controlling an output current of the first voltage source converter, a second current control transmission line for controlling an output current of the second voltage source converter, and a DC portion of the second voltage source converter and a DC voltage control transmission line for controlling a voltage across the second capacitor.

In the compensator, the compensation current generator may have a transformer, a first current source converter using switching elements connected to the transformer, a second current source converter using a series transformer connected in series to another AC transmission line and switching elements, a reactor for connecting a DC portion of the first current source converter and a DC portion of the second current source converter and a DC current control transmission line for controlling a current across the reactor.

In the compensator, the compensation current generator may have a transformer, a first voltage source converter using switching elements connected to the transformer, a second voltage source converter using a series transformer connected in series to another AC transmission line and switching elements, a third capacitor for connecting a DC portion of the first voltage source converter, a first current control transmission line for controlling an output current of the first voltage source converter, a second current control transmission line for controlling an output current of the second voltage source converter, and a DC portion of the second voltage source converter and a DC voltage control transmission line for controlling a voltage across the third capacitor.

According to still another aspect of the present invention, there is provided a series compensator comprising: a series capacitor connected in series to an AC transmission line; a compensation current generator connected in parallel to the series capacitor; and a non-linear resistor element connected in parallel to the series capacitor.

In the compensator, the compensation current generator may have a current source converter using a series transformer and switching elements.

The series compensator may further comprise a detection transmission line for detecting a voltage or a current of the AC transmission line connected to the series compensator; and a transmission line for enabling a same arm of switching elements in the current source converter, thereby short-circuiting upper and lower ends of the arm, when a transmission line fault is detected by the detection transmission line.

In the compensator, the compensation current generator may have a voltage source converter using a series transformer and switching elements and the series compensator may further include a current control transmission line for controlling an output current of the voltage source converter.

The series compensator may further comprise a detection transmission line for detecting a voltage or a current of the AC transmission line connected to the series compensator; and a transmission line for blocking a gate of the voltage source converter and disabling all of the switching elements when a transmission line fault is detected by the detection transmission line.

The series compensator may further comprise a detection transmission line for detecting a voltage or a current of the AC transmission line connected to the series compensator; and a transmission line for controlling an output current when a transmission line fault is detected by the detection transmission line, thereby permitting the voltage source converter to keep operating even during the transmission line fault.

The series compensator may further comprise a voltage control transmission line for controlling an output voltage of the series compensator; a detection transmission line for detecting a voltage or a current of the AC transmission line connected to the series compensator; and a transmission line for controlling the output voltage when a transmission line fault is detected by the detection transmission line, thereby permitting the voltage source converter to keep operating even during the transmission line fault.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Preferred embodiments of the present invention will now be described in detail with reference to the accompanying drawings.

First Embodiment

Figure 1:
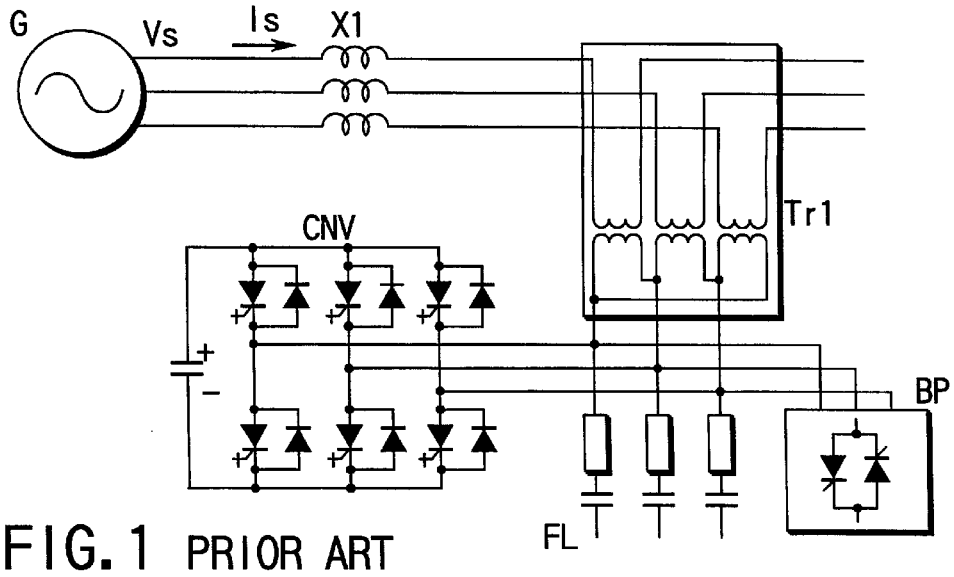
FIG. 1 PRIOR ART
FIG. 1 is a block transmission line diagram exemplifying the structure of a conventional series compensator.
Figure 2:
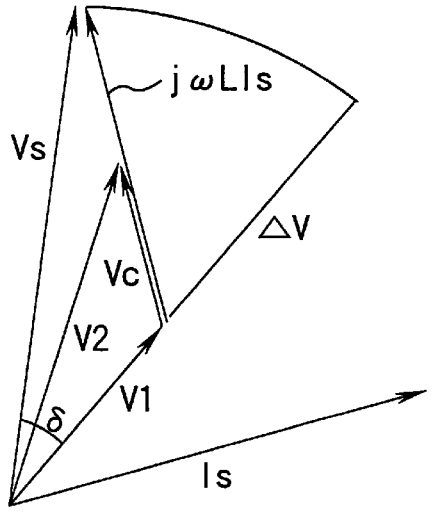
FIG. 2 PRIOR ART
FIG. 2 is a vector diagram for explaining the operation of the conventional series compensator.
Figure 3:
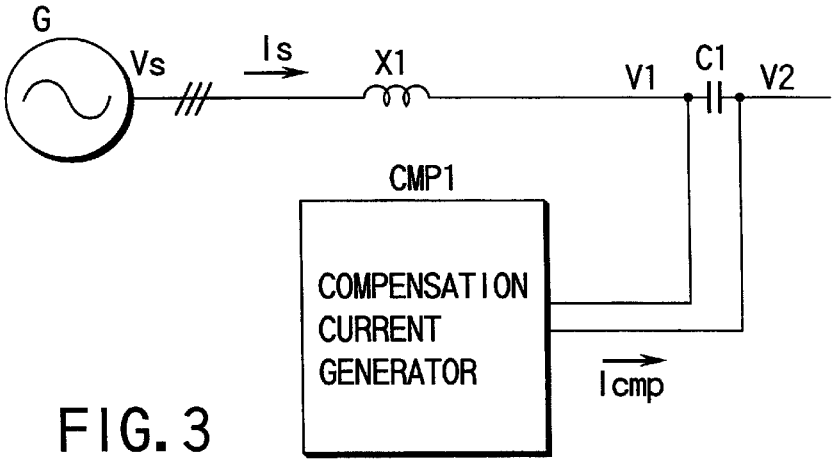
FIG. 3 is a block transmission line diagram illustrating a series compensator according to a first embodiment of this invention.

FIG. 3 is a block transmission line diagram exemplifying the structure of a series compensator according to this embodiment, and same reference numerals as used for the components in FIG. 1 are given to corresponding components of this series compensator.

In FIG. 3, "G" denotes an AC power supply, "X1" denotes the inductance of an AC transmission line, "C1" denotes a series capacitor, and "CMP1" denotes a compensation current generator.

The series capacitor C1 is connected in series to the AC transmission line, and the compensation current generator CMP1 is connected in parallel to the series capacitor C1.

According to the thus constituted series compensator of this embodiment, when the output of the compensation current generator CMP1 is zero, a voltage with a phase delay of 90 degrees from the phase of the transmission line current is produced on the series capacitor C1 as the transmission line current flows in.

Because the voltage that is generated across the inductance X1 of the AC transmission line has a phase leading by 90 degrees to that of the transmission line current, a voltage having a phase to cancel out a voltage drop caused by the inductance X1 of the AC transmission line is normally generated across the series capacitor C1.

The compensation current generator CMP1, which is a current source for generating a predetermined compensation current, has its output connected to both ends of the series capacitor C1 of each phase.

When the compensation current generator CMP1 actually generates a compensation current which is supplied into the series capacitor C1, a voltage with a phase delay of 90 degrees from the phase of the current that is obtained by adding the transmission line current and the compensation current together is generated across the series capacitor C1.

By changing the level and phase of the compensation current with respect to the transmission line current, the level and phase of the total current flowing in the series capacitor C1 can be changed to various levels and phases. It is therefore possible to alter the level and phase of the voltage generated across the series capacitor C1.

Accordingly, the impedance from the AC power supply G to the load-side terminal of the series compensator can be changed equivalently. As mentioned above, since the characteristics of an AC transmission line (such as the transmission limit of the AC transmission line and stability) vary according to the equivalent impedance, it is possible to realize an improvement of the transmission capability of the AC transmission line, power fluctuation control, power flow control and so forth.

The above operation will be described in detail referring to a vector diagram in FIG. 4.

Figure 4:
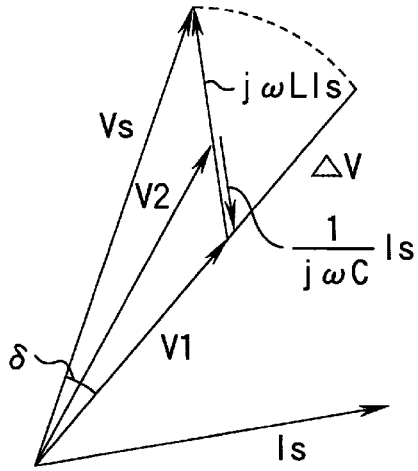
FIG. 4 is a vector diagram for explaining the operation of the series compensator according to the first embodiment.

FIG. 4 presents the vector diagram that shows the relationship among the AC supply voltage vector Vs, the transmission line current vector Is and the vectors of the AC-power-supply-side transmission line voltage V1 of the series capacitor C1 and the load-side transmission line voltage V2 of the series capacitor C1 when the compensation current Icmp is zero.

Given that the transmission line inductance is L, the AC-power-supply-side transmission line voltage V1 has a phase delay of $\delta$ and is lower by $\Delta V$ with respect to the AC supply voltage Vs due to a voltage drop caused by the transmission line inductance L.

Meanwhile, a voltage having a phase delay of 90 degrees to the transmission line current Is is generated across the series capacitor C1, so that the relation between the AC-power-supply-side transmission line voltage V1 and the load-side transmission line voltage V2 is expressed by the following equation:

$$V2 = V1 - \frac{1}{j\omega C} Is \tag{3}$$

where C is the capacitance of the series capacitor C1.

That is, the voltage is generated across the series capacitor C1 in such a direction as to compensate for the phase delay and voltage drop caused by the transmission line inductance L.

Figure 5:
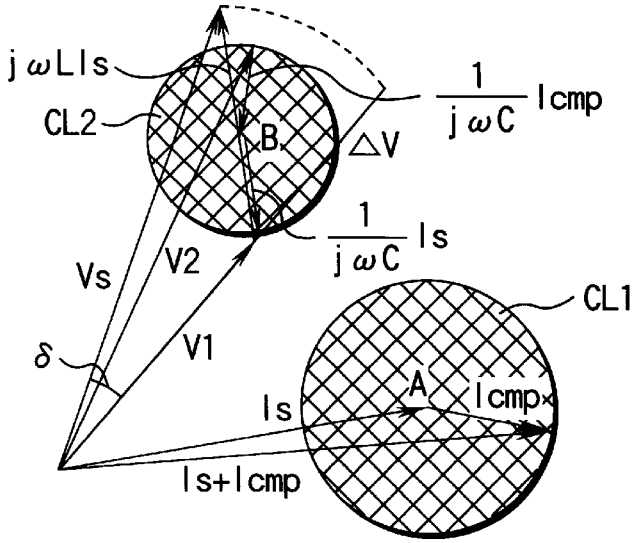
FIG. 5 is a vector diagram for explaining the operation of the series compensator according to the first embodiment.

FIG. 5 is a vector diagram showing one example of the operation when the compensation current generator CMP1 feeds the compensation current Icmp.

In FIG. 5, in addition to the voltage generated by the transmission line current Is, another voltage is generated across the series capacitor C1 by the compensation current Icmp, so that the load-side transmission line voltage V2 is compensated to the state shown in FIG. 5.

By changing the amplitude of the compensation current Icmp and the phase with respect to the transmission line current, the current vector Is+Icmp flowing across the series capacitor C1 can be altered within a circle CL1 whose center is the end point A of Is and whose radius is determined by the maximum value of the compensation current.

That is, feeding the compensation current Icmp with the proper amplitude and phase can compensate for the load-side transmission line voltage V2, allowing the equivalent impedance from the AC power supply G to the load side of the series capacitor C1 to be changed variably.

While the conventional series compensator is connected to a transmission line via a series transformer and the current flowing in the series compensator is restricted to the transmission line current, the transmission line current and the compensation current in the structure of this embodiment shown in FIG. 3 are dependent of each other so that with the compensation current adequately maintained by the compensation current generator, even when an excess current flows in the transmission line due to a transmission line fault or the like, the transmission line current flows through the series capacitor C1 and does not flow into the compensation current generator CMP1.

This structure can therefore eliminate the need for a bypass transmission line which is essential in the conventional series compensator in order to prevent an excess fault current from flowing into, and damaging, the series compensator.

Although an increase in the number of transmission lines inevitably increases the voltage of the series capacitor C1, if an arrester (non-linear resistor element) is connected in parallel to the series capacitor C1 to protect against excessive voltage, the maximum voltage applied to the compensation current generator CMP1 is restricted to the protection level of the arrester. By designing the compensation current generator CMP1 so as to be able to withstand the voltage that is determined by the protection level of the arrester, it is possible to realize a highly reliable series compensator with a simple structure which can quickly implement a predetermined compensation operation after elimination of a fault without requiring any bypass transmission line.

As a power converter using semiconductor switching elements is normally used as the compensation current generator CMP1, the compensation current contains a harmonic current in addition to a current with the necessary frequency. In the structure of this embodiment shown in FIG. 3, however, the large-capacity series capacitor C1 is connected in parallel to the compensation current generator CMP1, so that most of the harmonic component flows into the series capacitor C1 and not out to the transmission line side.

The above operation will be discussed referring to equivalent transmission line diagrams in FIGS. 6A and 6B.

Figure 6A:
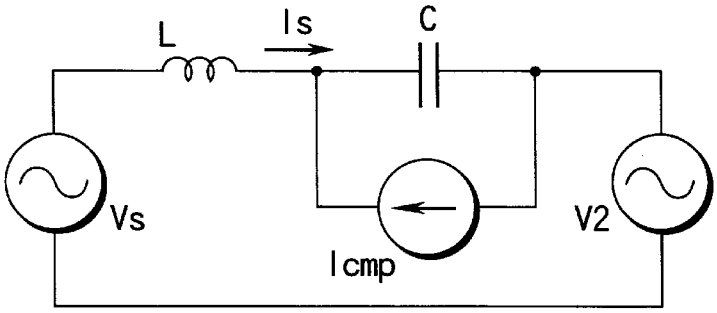
FIGS. 6A and 6B are equivalent transmission line diagrams for explaining the operation of the series compensator according to the first embodiment.
Figure 6B:
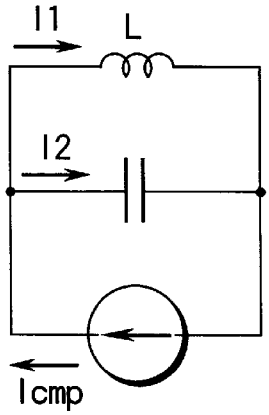

FIG. 6A shows an equivalent transmission line for one phase of the AC transmission line.

In FIG. 6A, the AC power supply G and the phase voltage of the load side of the series capacitor C1 are respectively shown as voltage sources Vs and V2, and the compensation current generator CMP1 is shows as the current source that feeds the current Icmp.

Although the current Is flowing in the transmission line is expressed by the sum of the currents that are respectively determined by the voltage sources Vs and V2 and the current source Icmp, the voltage sources may be considered as short-circuited by the principle of superposition when one considers the current that is determined by the current source. Thus, the equivalent transmission line in FIG. 6A can be transformed to the one shown in FIG. 6B.

Given that I1 and I2 are respectively the current flowing out to the transmission line from the current source and the current flowing into the series capacitor, the ratio of I1 to I2 is given by the following equation:

$$I1:I2=1/(2\times\pi\times f\times C):2\times\pi\times f\times L \quad (4)$$

where f [Hz] is the frequency of the compensation current.

Assuming for the sake of descriptive simplicity that the voltage drop caused by the transmission line inductance is completely compensated (100%) by the series capacitor C1 at the reference frequency, then $$1/(2\times\pi\times 50\times C)=2\times\pi\times 50\times L \quad (5)$$

Rewriting the equation (4) using the equation (5) yields $$I/1:I/2=50/f:f/50 \quad (6)$$

Letting the order of the harmonics contained in the compensation current be n yields $$f=50\times n \quad (7)$$

Thus, $$I1:I2=1:n^2 \quad (8)$$

Because the range of the frequency generated by the power converter connected in the normal three-phase bridge rectifier connection is generally of the fifth order, the seventh or higher order, the harmonic component flowing out to the transmission line, even if it is of the fifth order, is reduced to 1/26, which is sufficiently small.

Although the amount of compensation by the series capacitor is set to the value that completely compensates the transmission line inductance (100%) in the foregoing description, the compensation amount is normally suppressed to a smaller value than 100% so that the harmonic component flowing out to the transmission line becomes smaller.

The power converter used for the compensation current generator CMP1 can be formed as a series compensator with a smaller influence of any harmonic component on the transmission line without employing any countermeasure against harmonics, such as the provision of a harmonic filter or a multiple converter structure.

Although the series capacitor C1 is shown as a single capacitor for each phase in FIG. 3, for the sake of simpler description, capacitors in series-parallel connection may be actually used in accordance with the required capacitance.

Second Embodiment

Figure 7:
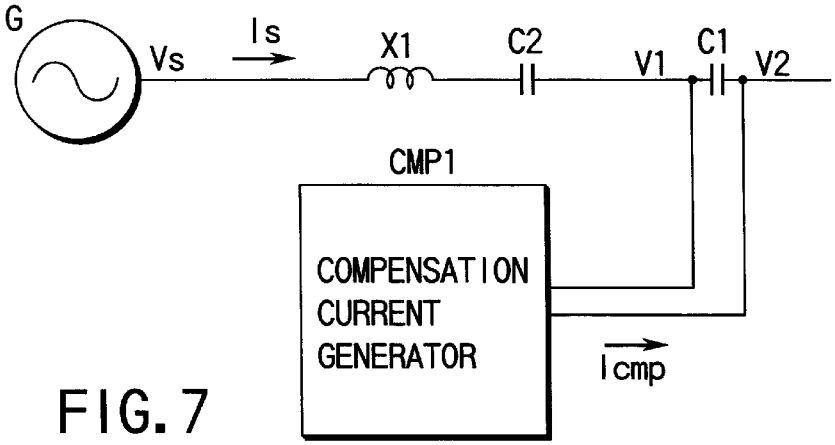
FIG. 7 is a block transmission line diagram illustrating a series compensator according to a second embodiment of this invention.

FIG. 7 is a block transmission line diagram exemplifying the structure of a series compensator according to this embodiment, and same reference numerals as used for the components in FIG. 3 are given to corresponding components of this series compensator.

In FIG. 7, "G" denotes an AC power supply, "X1" denotes the inductance of an AC transmission line, "C1" denotes a series capacitor (hereinafter called "first series capacitor"), "C2" denotes another series capacitor (hereinafter called "second series capacitor") and "CMP1" denotes a compensation current generator.

The series capacitor C1 and the second series capacitor C2 are both connected in series to the AC transmission line, and the compensation current generator CMP1 is connected in parallel to the series capacitor C1.

That is, the second series capacitor C2 which performs compensation of a fixed component is provided in addition to the first series capacitor C1 which can change the impedance by altering the compensation current in this embodiment.

According to the thus constituted series compensator of this embodiment, when the compensation current Icmp is zero, voltages with a phase delay of 90 degrees from the phase of the transmission line voltage are generated across the respective series capacitors C1 and C2 and the voltage drop caused by the transmission line inductance X1 is reduced by the sum of the voltages generated across the series capacitors C1 and C2.

As the compensation current Icmp is fed, in accordance with the level and phase of the compensation current Icmp, the voltage vector generated across the first series capacitor C1 can be changed to a value within the circle CL1 whose center is the load-side terminal voltage when the compensation current Icmp is zero.

This can permit the equivalent impedance from the AC power supply G to the load-side terminal voltage to be changed, which is the same effect as obtained by the above-described first embodiment.

In addition, as most of the capacitance of the series capacitor C1 in the first embodiment is provided in the form of the second series capacitor C2, the voltage to be applied to the output terminal of the compensation current generator CMP1 can be reduced, particularly when a large compensation is required.

Although the first and second series capacitors C1 and C2 are both shown as a single capacitor for each phase in FIG. 7, for the sake of simpler description, capacitors in series-parallel connection may actually be used in accordance with the required capacitance.

Third Embodiment

Figure 8:
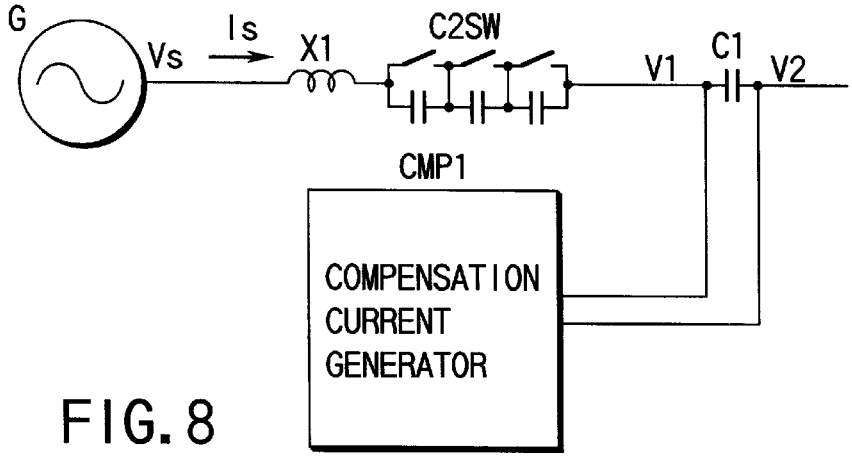
FIG. 8 is a block transmission line diagram illustrating a series compensator according to a third embodiment of this invention.

FIG. 8 is a block transmission line diagram exemplifying the structure of a series compensator according to this embodiment, and same reference numerals as used for the components in FIG. 7 are given to corresponding components of this series compensator to omit their description. The following will discuss only the difference.

As shown in FIG. 8, the series compensator according to this embodiment is designed in such a way that the second series capacitor C2 provided in the second embodiment as a series capacitor for performing compensation of a fixed component is constituted by capacitor units C2SW whose series number can be changed by mechanical switches.

Specifically, the second series capacitor C2 comprises a plurality of series capacitors to which respective switches are connected in parallel.

Although there are three capacitor units provided for each phase in FIG. 8 for the sake of simpler description, the second series capacitor C2 may comprise an arbitrary number of capacitor units in accordance with the required compensation amount.

According to the thus constituted series compensator of this embodiment, by changing the number of series capacitors in the capacitor units C2SW which are to be rendered active and the amount of compensation for a variable component by the first series capacitor C1, wide-range compensation can be accomplished while reducing the capacity of the compensation current generator CMP1.

Assuming that the ratio of the reactance of the series capacitor portion to the reactance of the transmission line inductance is called the degree of compensation, and the degree of compensation by each of the capacitor units C2SW is 10%, the degree of compensation by the first series capacitor C1 is 5% and the capacity of the compensation current generator CMP1 is 5% (which is the capacity of the compensation current generator capable of generating the compensation current necessary to generate a voltage equivalent to a compensation degree of +5%; because the compensation current can be generated in the opposite phase, the degree of compensation can be changed within a range from −5% to +5% by the compensation current generator CMP1), the degree of compensation by the first series capacitor C1 is variable within a range of 0% to 10%. As apparent from the following Table 1, therefore, compensation from 0% to 40% can be continuously implemented by selecting the number of the series capacitors in the capacitor units C2SW which are to be rendered active.

TABLE 1

| TOTAL DEGREE OF COMPENSATION | NUMBER OF CAPACITORS IN C2SW TO BE ACTIVE | DEGREE OF COMPENSATION BY C1 |
|---|---|---|
| 0–10% | 0 | 0–10% |
| 10–20% | 1 | 0–10% |
| 20–30% | 2 | 0–10% |
| 30–40% | 3 | 0–10% |

Figure 9:
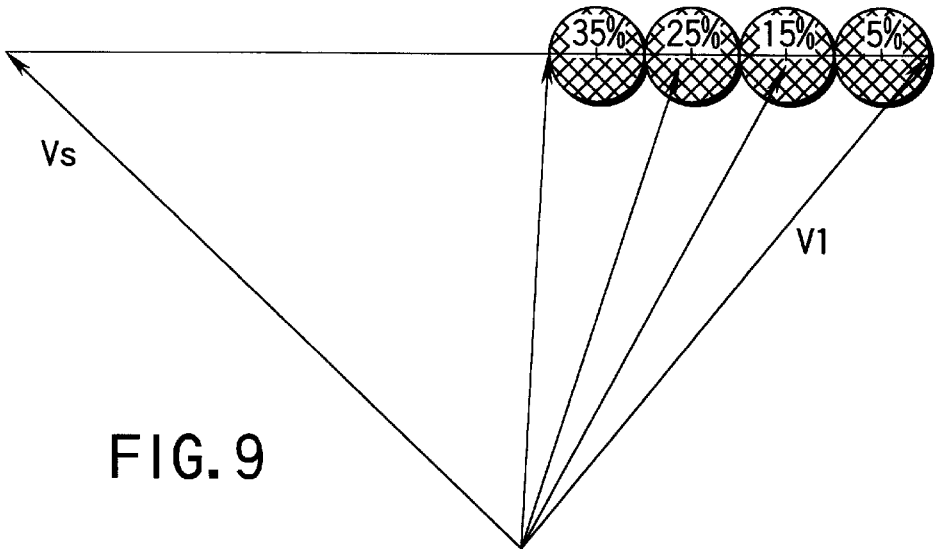
FIG. 9 is a vector diagram for explaining the operation of the series compensator according to the third embodiment.

Although the foregoing description has been given with reference to the case where the compensation by the first series capacitor C1 is directed only in the direction of reactance for the sake of simpler description, compensation within the circle with a radius of 5% compensation about, for example, the degree of compensation of 5%, 15%, 25% or 35% as shown in FIG. 9 by arbitrarily setting the phase of the compensation current with respect to the transmission line current.

Fourth Embodiment

Figure 10:
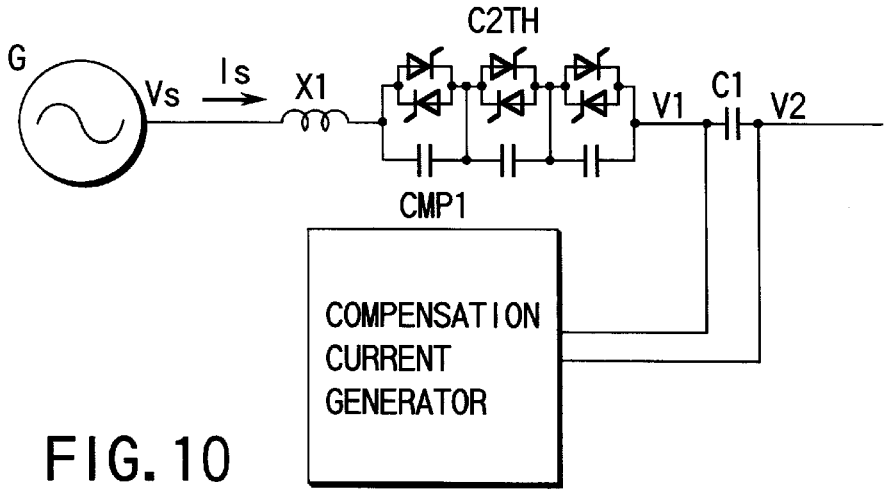
FIG. 10 is a block transmission line diagram illustrating a series compensator according to a fourth embodiment of this invention.

FIG. 10 is a block transmission line diagram exemplifying the structure of a series compensator according to this embodiment, and same reference numerals as used for the components in FIG. 8 are given to corresponding components of this series compensator to omit their description. The following will discuss only the difference.

As shown in FIG. 10, the series compensator according to this embodiment has such a structure that the switches for switching the number of capacitors in the capacitor units C2SW which are to be rendered active in the third embodiment are each constituted by a semiconductor switch having a pair of thyristors connected in parallel in the opposite directions.

According to the thus constituted series compensator of this embodiment, since the number of series capacitors to be rendered active can be quickly switched by the thyristors, the compensation that has been described in the foregoing description of the third embodiment can be implemented faster.

Fifth Embodiment

Figure 11:
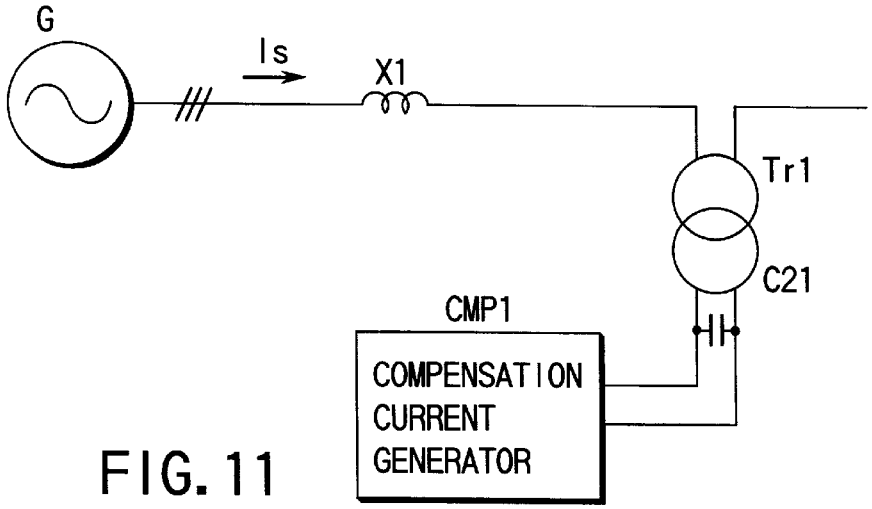
FIG. 11 is a block transmission line diagram illustrating a series compensator according to a fifth embodiment of this invention.

FIG. 11 is a block transmission line diagram exemplifying the fundamental structure of a series compensator according to this embodiment, and same reference numerals as used for the components in FIG. 3 are given to corresponding components of this series compensator.

In FIG. 11, the series transformer Tr1 has the primary winding connected in series to the AC transmission line and the secondary winding connected to a capacitor C21 to which the compensation current generator CMP1 is connected in parallel.

Given that the turn ratio of the series transformer Tr1 is n and the reactance of the capacitor C21 is Xc21 in the thus constituted series compensator of this embodiment, when the compensation current generated by the compensation current generator CMP1 is zero, a current of n×Is, which is determined by the transmission line current Is and the turn ratio n of the series transformer Tr1, flows across the capacitor C21, generating a voltage of n×Xc21×Is whose phase is delayed by 90 degrees from the phase of that current.

The voltage generated across the capacitor C21 is supplied in series to the AC transmission line via the series transformer Tr1 as a voltage which has a phase delay of 90 degrees with respect to the transmission line current and will normally cancel out the voltage drop caused by the transmission line inductance X1.

When the compensation current generator CMP1 generates the compensation current Icmp, the compensation current Icmp is supplied to the capacitor C21 in addition to the current that is determined by the transmission line current, causing the voltage generated across the capacitor C21 to change according to the level and phase of the compensation current Icmp.

In accordance with the level and phase of the compensation current Icmp, the voltage generated across the capacitor C21 can be changed within an arbitrary circle whose center is the end of the voltage vector when the compensation current is zero and which is determined by the maximum value of the compensation current.

In accordance with the voltage vector generated across the capacitor C21, the voltage which is generated on the primary winding of the series transformer Tr1 and is supplied in series to the AC transmission line also varies.

This can permit the equivalent impedance from the AC power supply G to the load side of the compensation current generator CMP1 to be changed variably, which is the same effect as obtained by the above-described first embodiment.

In a case of the compensation current being zero, the voltage generated across the capacitor C21 becomes n×Xc21×Is and a voltage of $n^2$×Xc×Is is produced on the primary winding of the series transformer Tr1.

That is, to achieve the same degree of compensation as achieved by the first embodiment, a capacitor having a reactance of $1/n^2$ should be provided in this embodiment.

As the current that flows across the capacitor C21 becomes n times as large, the voltage generated across the capacitor C21 becomes 1/n although the capacitance of the capacitor that is determined by the reactance×(square of the current).

That is, while the capacitor C21 has the same effect as the series capacitor because it is connected in series to the AC transmission line via the series transformer Tr1, it is located on the low-voltage side of the series transformer Tr1, which makes it significantly advantageous in terms of the voltage withstandability and insulation of the capacitor.

Sixth Embodiment

Figure 12:
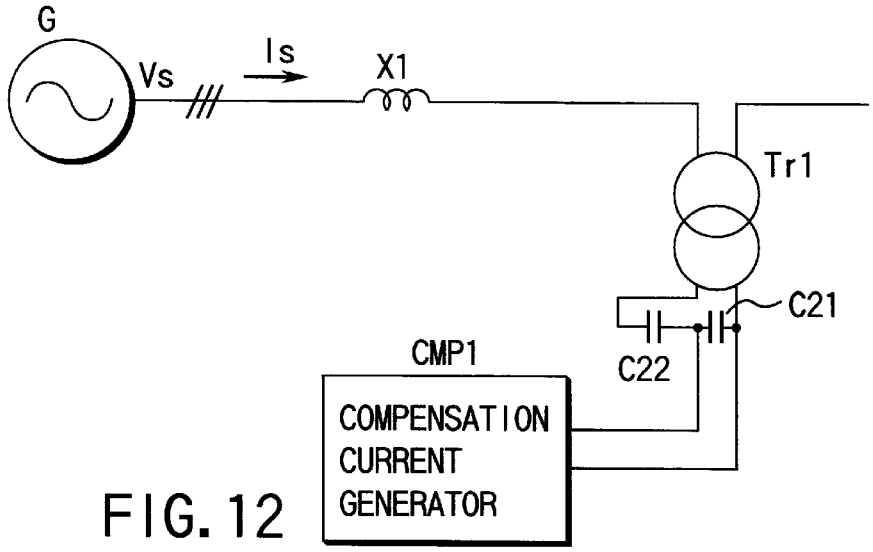
FIG. 12 is a block transmission line diagram illustrating a series compensator according to a sixth embodiment of this invention.

FIG. 12 is a block transmission line diagram exemplifying the fundamental structure of a series compensator according to this embodiment, and same reference numerals as used for the components in FIG. 3 are given to corresponding components of this series compensator.

In FIG. 12, the series transformer Tr1 has the primary winding connected in series to the AC transmission line and the secondary winding connected to a first capacitor C21 and a second capacitor C22, with the compensation current generator CMP1 connected in parallel to the first capacitor C21.

The second series capacitor C22 is chosen to be equivalent to the amount of compensation normally needed and a structure similar to that of the second embodiment is realized on the secondary winding side of the series transformer Tr1.

Given that the turn ratio of the series transformer Tr1 is n and the reactances of the capacitors C21 and C22 are respectively Xc21 and Xc22 in the thus constituted series compensator of this embodiment, when the compensation current generated by the compensation current generator CMP1 is zero, a current of n×Is which is determined by the transmission line current Is and the turn ratio n of the series transformer Tr1 flows across the capacitors C21 and C22, generating voltages of n×Xc21 X Is and n×Xc22×Is whose phases are delayed by 90 degrees from the phase of that current.

The sum of the voltages generated across the capacitors C21 and C22 is supplied in series to the AC transmission line via the series transformer Tr1 as the voltage which has a phase delay of 90 degrees with respect to the transmission line current and will normally cancel out the voltage drop caused by the transmission line inductance X1.

When the compensation current generator CMP1 generates the compensation current Icmp, the compensation current Icmp is supplied to the capacitor C21 in addition to the current that is determined by the transmission line current, causing the voltage generated across the capacitor C21 to change according to the level and phase of the compensation current Icmp.

In accordance with the level and phase of the compensation current Icmp, the voltage generated across the capacitor C21 can be changed within an arbitrary circle whose center is the end of the voltage vector when the compensation current is zero and which is determined by the maximum value of the compensation current.

In accordance with the voltage vector generated across the capacitor C21, the voltage which is generated on the primary winding of the series transformer Tr1 and is supplied in series to the AC transmission line also varies.

This can permit the equivalent impedance from the AC power supply G to the load side of the compensation current generator CMP1 to be changed variably, which is the same effect as obtained by the second embodiment.

When large compensation is needed, this structure can reduce the voltage to be applied to the output terminal of the compensation current generator CMP1, and the location of the capacitors C21 and C22 on the low-voltage side of the series transformer Tr1 is advantageous in terms of voltage withstandability and insulation of the capacitor.

Seventh Embodiment

Figure 13:
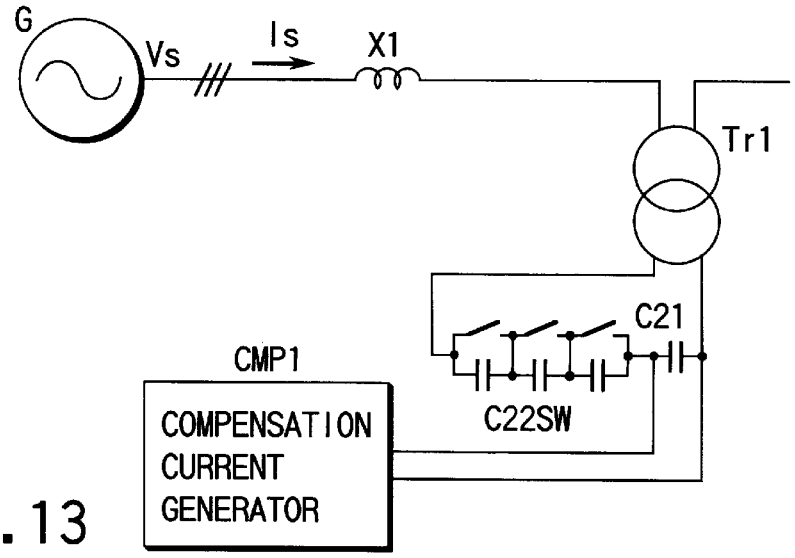
FIG. 13 is a block transmission line diagram illustrating a series compensator according to a seventh embodiment of this invention.

FIG. 13 is a block transmission line diagram exemplifying the structure of a series compensator according to this embodiment, and same reference numerals as used for the components in FIG. 12 are given to corresponding components of this series compensator to omit their description. The following will discuss only the difference.

As shown in FIG. 13, the series compensator according to this embodiment is designed in such a way that the first series capacitor C1 to which the compensation current generator CMP1 is connected in parallel capacitor units C22SW whose series number can be changed by mechanical switches are connected to the secondary winding of the series transformer Tr1 whose primary winding is connected in series to an AC transmission line in the sixth embodiment.

Specifically, the second series capacitor C2 comprises a plurality of series capacitors to which respective switches are connected in parallel.

Although there are three capacitor units provided for each phase in FIG. 13 for the sake of simpler description, the second series capacitor C2 may comprise an arbitrary number of capacitor units in accordance with the required compensation amount.

According to the thus constituted series compensator of this embodiment, the level and phase of the voltage to be generated across the first capacitor C21 can be changed variably by changing the level and phase of the compensation current Icmp which is supplied to the first capacitor C21 from the compensation current generator CMP1.

That is, according to this embodiment as in the third embodiment, by changing the number of series capacitors in the capacitor units C2SW which are to be rendered active and the amount of compensation for a variable component by the first series capacitor C1, the voltage that is generated on the secondary winding of the series transformer Tr1 is continuously changed over a wide range, thus changing the compensation voltage to be supplied in series to the AC transmission line via the series transformer Tr1.

This can permit the equivalent impedance from the AC power supply G to the load side of the compensation current generator CMP1 to be changed to various values, which is the same effect as obtained by the third embodiment.

Given that the number of turns of the series transformer Tr1 is n, to realize the same compensation amount as achieved in the third embodiment, the voltages to be applied to the first capacitor C21 and the capacitor units C22SW become 1/n.

This can insure wide-range compensation while reducing the capacity of the compensation current generator CMP1, and the location of the capacitor C21 and the capacitor units C22SW on the low-voltage side of the series transformer Tr1 is advantageous in terms of voltage withstandability and insulation of the capacitor.

Eighth Embodiment

Figure 14:
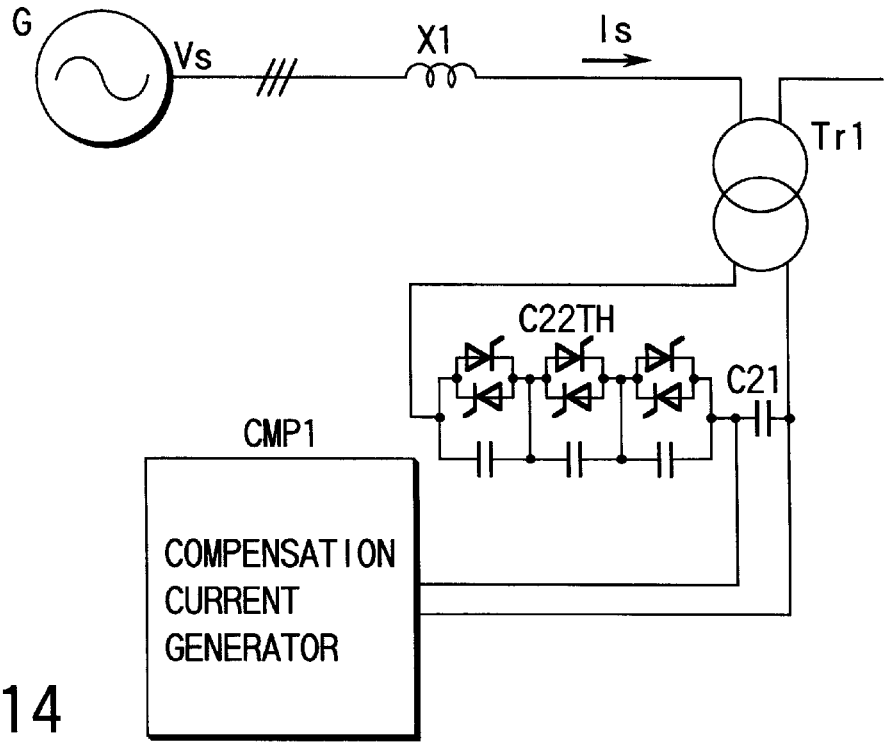
FIG. 14 is a block transmission line diagram illustrating a series compensator according to an eighth embodiment of this invention.

FIG. 14 is a block transmission line diagram exemplifying the structure of a series compensator according to this embodiment, and same reference numerals as used for the components in FIG. 13 are given to corresponding components of this series compensator to omit their description. The following will discuss only the difference.

As shown in FIG. 14, the series compensator according to this embodiment has such a structure that the switches for switching the number of capacitors in the capacitor units C22Sw which are to be rendered active in the seventh embodiment are each constituted by a semiconductor switch having a pair of thyristors connected in parallel in the opposite directions.

According to the thus constituted series compensator of this embodiment, since the number of series capacitors to be rendered active can be quickly switched by the thyristors, the compensation that has been described in the foregoing description of the seventh embodiment can be implemented faster, and the location of the capacitor C21 and the thyristors on the low-voltage side of the series transformer Tr1 is advantageous in terms of voltage withstandability and insulation of the capacitor and thyristors.

Ninth Embodiment

Figure 15:
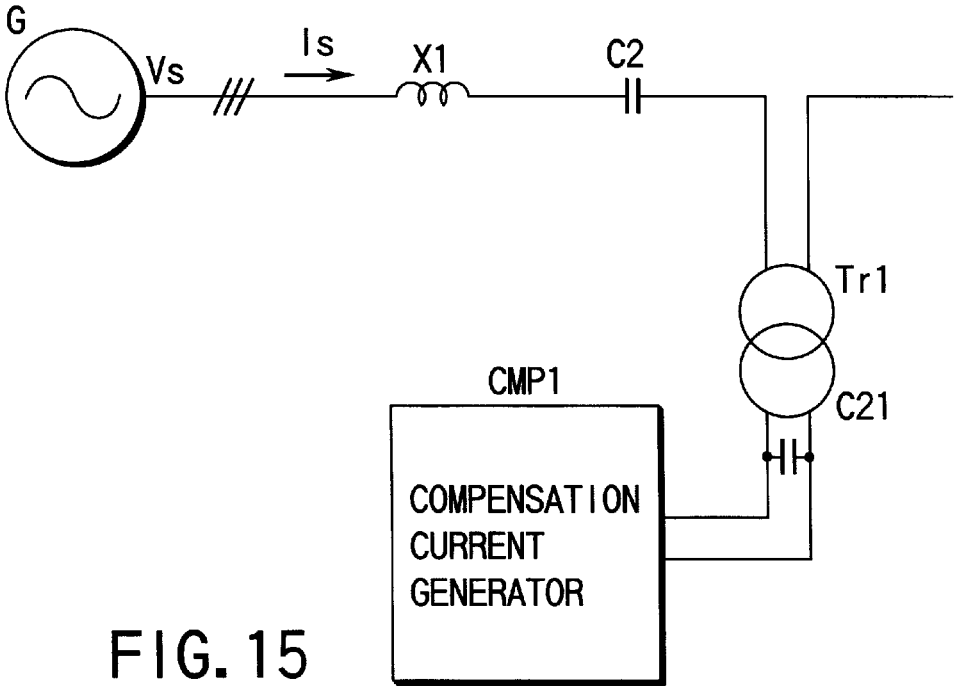
FIG. 15 is a block transmission line diagram illustrating a series compensator according to a ninth embodiment of this invention.

FIG. 15 is a block transmission line diagram exemplifying the fundamental structure of a series compensator according to this embodiment. Same reference numerals as used for the components in FIG. 11 are given to corresponding components of this series compensator to omit their description and the following will discuss only the difference.

The series compensator of this embodiment has such a structure that a capacitor which is nearly equivalent to the amount of compensation normally needed is provided as a second series capacitor in series with the series compensator.

According to the thus constituted series compensator of this embodiment, the transmission line current Is flows across the series capacitor C2 and a voltage which has a phase delay of 90 degrees relative to the transmission line current is always generated. This voltage has the opposite phase to that of the voltage that is generated across the transmission line impedance X1 and thus will normally cancel out the voltage drop caused by the transmission line impedance X1.

The capacitor C21 and the compensation current generator CMP1 connected via the series transformer Tr1 perform the same operations as those in the fifth embodiment to generate various compensation voltages on the primary winding of the series transformer Tr1, so that the equivalent impedance from the AC power supply G to the load side of the compensation current generator CMP1 can be changed variably in accordance with the normal compensation by the series capacitor C2.

When large compensation is needed, this structure can reduce the voltage to be applied to the output terminal of the compensation current generator CMP1, and the location of the capacitor C21 on the low-voltage side of the series transformer Tr1 is advantageous in terms of voltage withstandability and insulation of the capacitor.

Further, because the series capacitor C2 can be arranged as separate from the compensator portion involving the series transformer Tr1, the degree of arrangement is very high.

Tenth Embodiment

Figure 16:
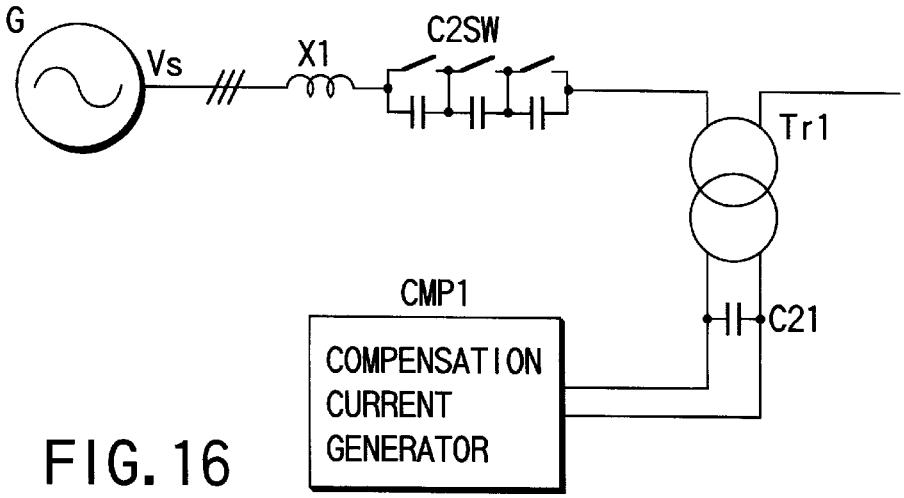
FIG. 16 is a block transmission line diagram illustrating a series compensator according to a tenth embodiment of this invention.

FIG. 16 is a block transmission line diagram exemplifying the structure of a series compensator according to this embodiment. Since the same reference numerals as used for the common components shown in FIG. 15 are again used for corresponding components of this series compensator, their description is omitted and the following will discuss only the difference.

As shown in FIG. 16, the series compensator according to this embodiment is designed in such a way that the series capacitor C2 provided in the ninth embodiment as a series capacitor for performing compensation of a fixed component is constituted by capacitor units C2SW whose series number can be changed by mechanical switches.

Specifically, the series capacitor C2 comprises a plurality of series capacitors to which respective switches are connected in parallel.

Although there are three capacitor units provided for each phase in FIG. 16 for the sake of simpler description, the second series capacitor C2 may comprise an arbitrary number of capacitor units in accordance with the required compensation amount.

According to the thus constituted series compensator of this embodiment, the transmission line current Is flows in any capacitor in the capacitor units C2SW whose parallel-connected switch is open, generating a voltage which has a phase delay of 90 degrees relative to the transmission line current. Because this voltage his the opposite phase to that of the voltage generated across the transmission line impedance X1, it will normally cancel out the voltage drop caused by the transmission line impedance X1.

By changing the number of series capacitors in the capacitor units C2Sw which are to be rendered active, the voltage to be supplied to the transmission line changes stepwise and so does the amount of compensation.

The capacitor C21 and the compensation current generator CMP1 connected via the series transformer Tr1 perform the same operations as those in the fifth embodiment so that various compensation voltages can be generated on the primary winding of the series transformer Tr1.

According to this embodiment, therefore, combining the stepwise compensation by the capacitor units C2SW and the variable compensation voltage to be generated on the primary winding of the series transformer Tr1 in the same way as has been explained in the description of the third embodiment using the Table 1 can continuously generate a wide range of compensation amounts. This can permit the equivalent impedance from the AC power supply G to the load side of the compensation current generator CMP1 to be changed variably.

This structure can ensure wide-range compensation while reducing the capacity of the compensation current generator CMP1, and the location of the capacitor C21 on the low-voltage side of the series transformer Tr1 is advantageous in terms of voltage withstandability and insulation of the capacitor.

Further, as the capacitor units C2SW can be arranged as separate from the compensator portion involving the series transformer Tr1, the degree of arrangement is very high.

Eleventh Embodiment

Figure 17:
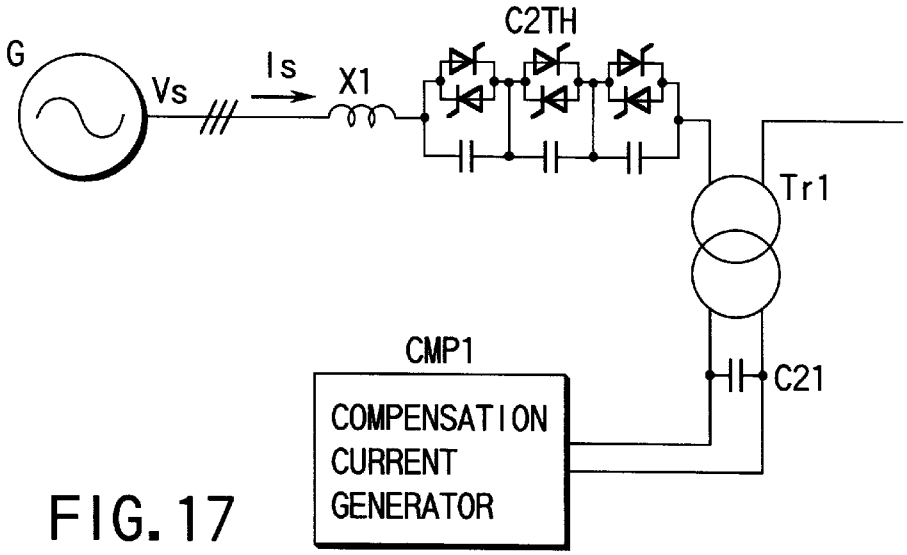
FIG. 17 is a block transmission line diagram illustrating a series compensator according to an eleventh embodiment of this invention.

FIG. 17 is a block transmission line diagram exemplifying the structure of a series compensator according to this embodiment, and same reference numerals as used for the components in FIG. 16 are given to corresponding components of this series compensator to omit their description. The following will discuss only the difference.

As shown in FIG. 17, the series compensator according to this embodiment has such a structure that the switches for switching the number of capacitors in the capacitor units C2SW which are to be rendered active in the tenth embodiment are each constituted by a semiconductor switch having a pair of thyristors connected in parallel in the opposite directions.

According to the thus constituted series compensator of this embodiment, since the number of series capacitors to be rendered active can be quickly switched by the thyristors, the compensation that has been described in the foregoing description of the tenth embodiment can be implemented faster, and the location of the first capacitor C21 on the low-voltage side of the series transformer Tr1 is advantageous in terms of voltage withstandability and insulation of the capacitor.

Further, because the capacitor units C2SW can be arranged as separate from the compensator portion involving the series transformer Tr1, the degree of arrangement is very high.

Twelfth Embodiment

Figure 18:
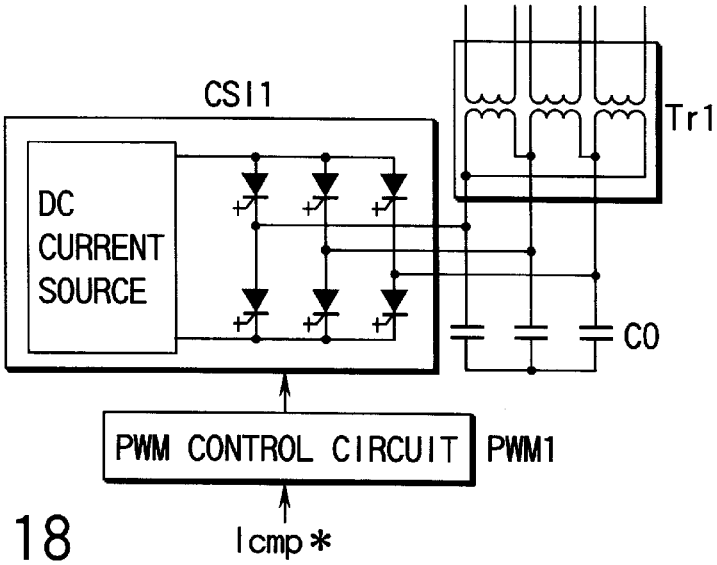
FIG. 18 is a block transmission line diagram illustrating a series compensator according to a twelfth embodiment of this invention.

FIG. 18 is a block transmission line diagram exemplifying the structure of a series compensator according to this embodiment, and same reference numerals as used for the components of each of the first to eleventh embodiments are given to corresponding components of this series compensator.

According to this embodiment, as shown in FIG. 18, the aforementioned compensation current generator CMP1 comprises a current source converter CSI1, which has reverse blocking GTOs as switching elements connected in three-phase rectifier connection and has a DC current source on the DC side, and a series transformer Tr1.

Provided between the current source converter CSI1 and the series transformer Tr1 is a harmonic filter C0 for eliminating a harmonic component produced by the current source converter CSI1.

Figure 19:
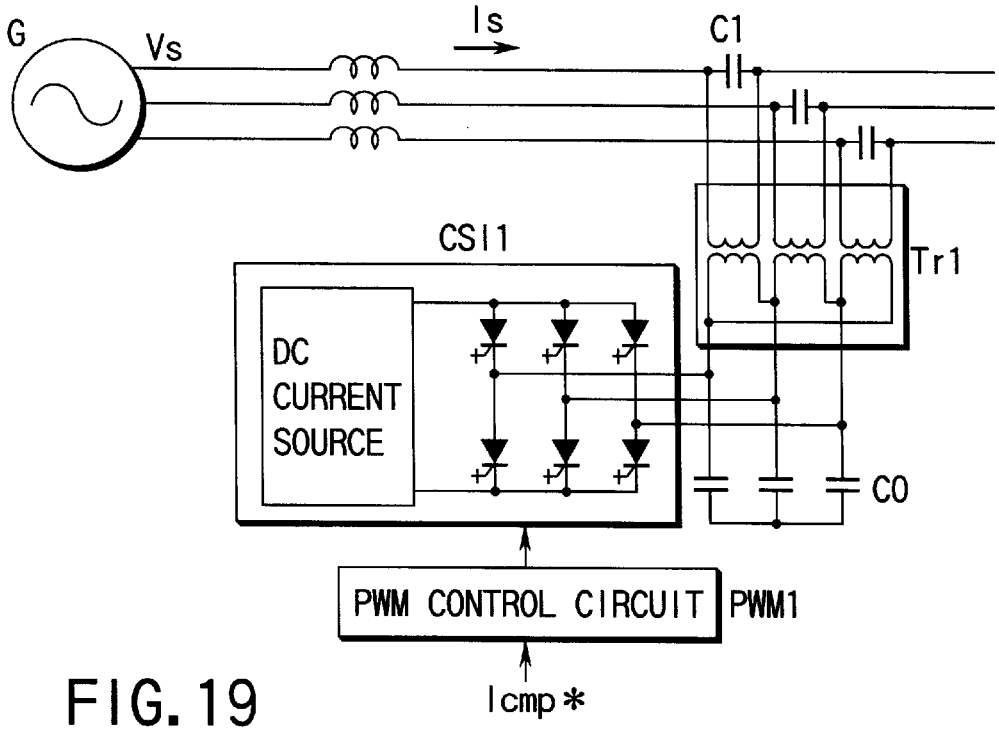
FIG. 19 is a block transmission line diagram showing a structural example in a case where a compensation current generator constituting the series compensator of the twelfth embodiment is adapted to the first embodiment.

FIG. 19 is a block transmission line diagram showing a structural example in a case where the compensation current generator CMP1 constituting the series compensator of this embodiment is adapted to the first embodiment, and same reference numerals as used for the components in FIG. 3 are given to corresponding components of this series compensator.

According to the thus constituted series compensator of this embodiment, a compensation current instruction Icmp* is input to a PWM control transmission line PWM1 which performs PWM modulation and generates such a switching pattern as to generate a current which becomes equal to the current instruction Icmp*.

The current that is output from the current source converter CSI1 has a PWM-modulated square waveform that has its harmonic component eliminated by the harmonic filter C0, so that the current having a sine waveform is supplied to the secondary winding of the series transformer Tr1.

The compensation current is converted by the series transformer Tr1 in accordance with the number of turns, and the resultant current is supplied to the series capacitor C1, thereby generating a compensation voltage having a sine wave.

In other words, since the current source converter CSI1 in this embodiment has a DC voltage source on the DC side and serves as a current source which outputs the compensation current equal to the instruction value under PWM control based on the current instruction, it works as the compensation current generator which generates the compensation current matched with a predetermined instruction value.

Consequently, the predetermined compensation current is supplied via the series transformer Tr1 to the series capacitor C1 connected to the output of the compensation current generator CMP1, thus allowing a predetermined compensation voltage to be produced in series to the AC transmission line.

Although the foregoing description of this embodiment has been given with reference to the structure that uses a single current source converter connected in three-phase bridge rectifier connection for the sake of simpler description, a plurality of current source converters may be connected in a multiplexing form to achieve a large capacity.

Thirteenth Embodiment

Figure 20:
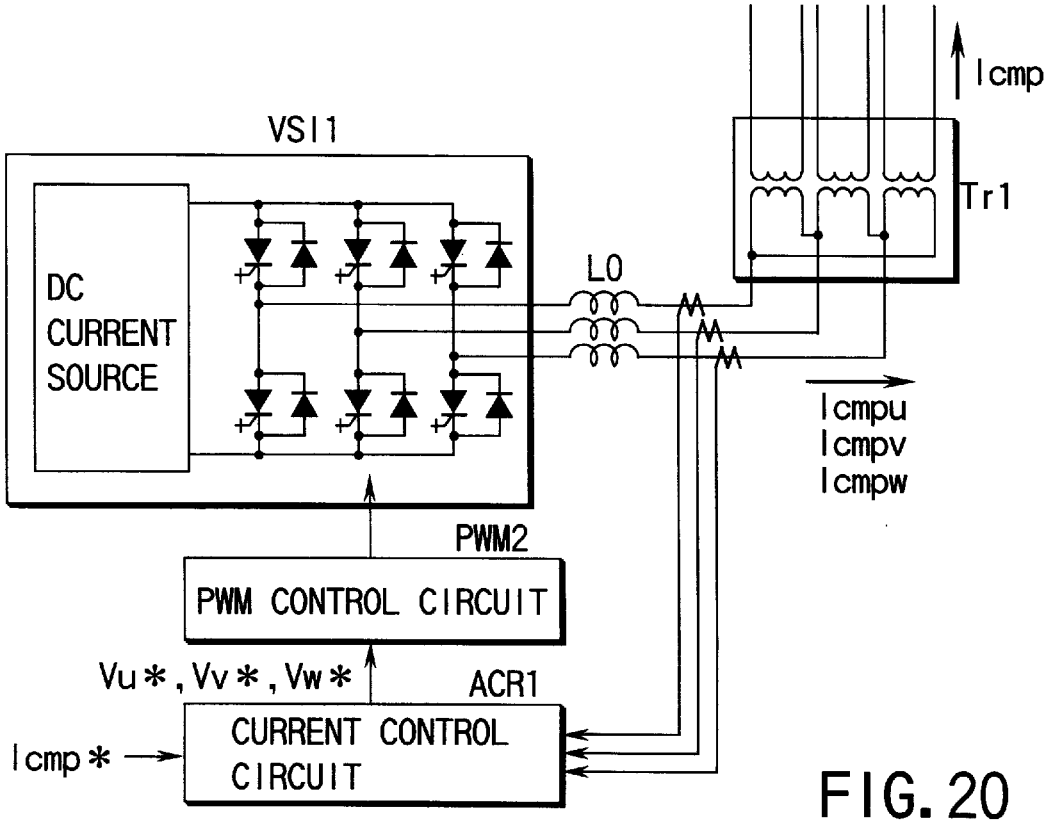
FIG. 20 is a block transmission line diagram illustrating a series compensator according to a thirteenth embodiment of this invention.

FIG. 20 is a block transmission line diagram exemplifying the structure of a series compensator according to this embodiment, and the same reference numerals as used for the components of each of the first to eleventh embodiments are again used relative to corresponding components of this series compensator.

According to this embodiment, as shown in FIG. 20, the aforementioned compensation current generator CMP1 comprises a voltage source converter VSI1, which has reverse blocking GTOs as switching elements connected in three-phase rectifier connection and has a DC voltage source on the DC side, a PWM control transmission line PWM2 for generating a switching pattern for each GTO of the voltage source converter VSI1, a current control transmission line ACR1 for controlling the output current of the voltage source converter VSI1, a reactor L0 for linkage, and a series transformer Tr1.

The link reactor L0 may be provided as an independent reactor as in this embodiment, but may alternatively a achieved by designing the leak reactance of a series transformer Tr1 to be larger.

Figure 21:
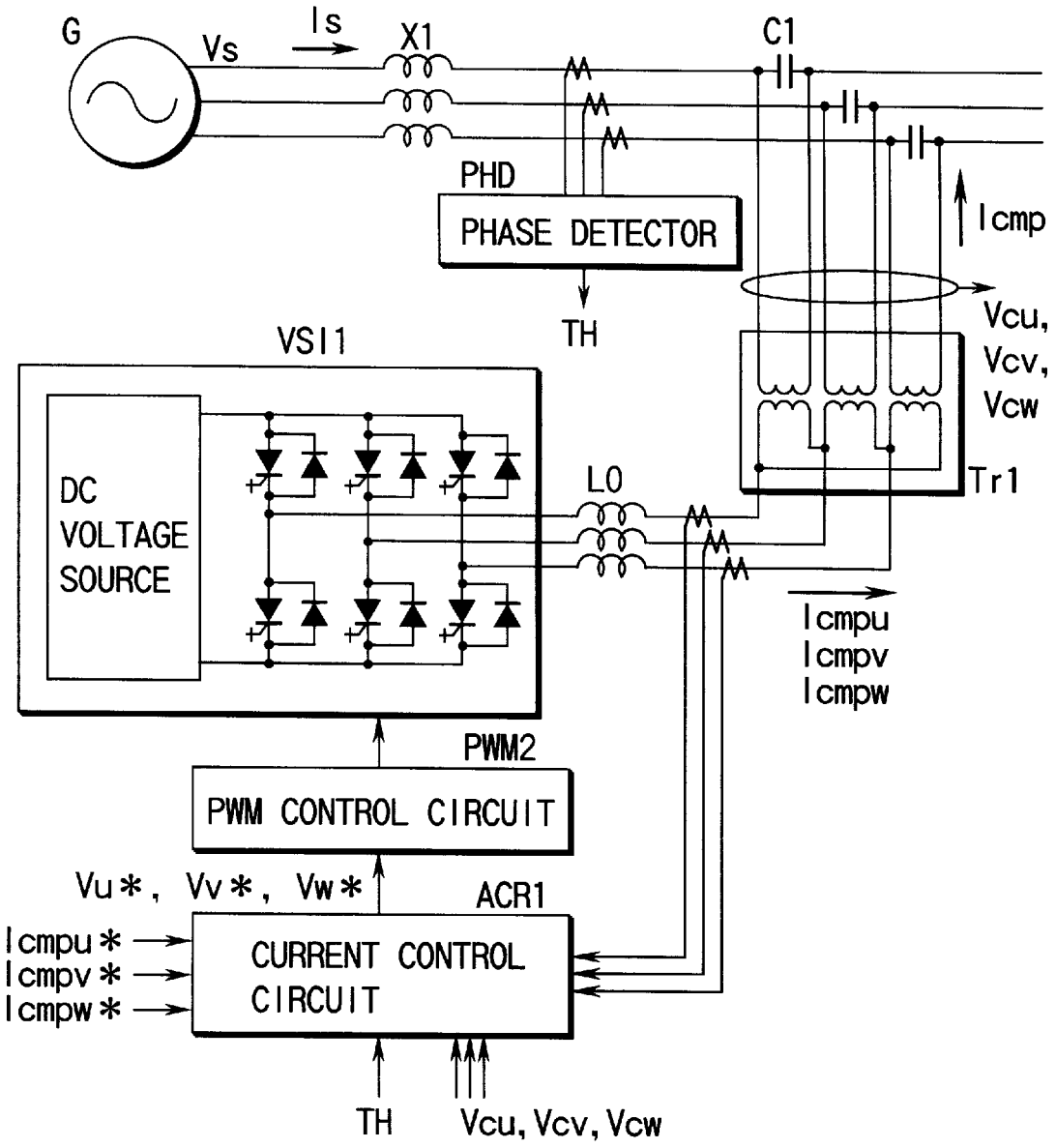
FIG. 21 is a block transmission line diagram showing a structural example in a case where a compensation current generator constituting the series compensator of the thirteenth embodiment is adapted to the first embodiment.

FIG. 21 is a block transmission line diagram showing a structural example in a case where the compensation current generator CMP1 constituting the series compensator of this embodiment is adapted to the first embodiment, and same reference numerals as used for the components in FIG. 3 are given to corresponding components of this series compensator.

Figure 22:
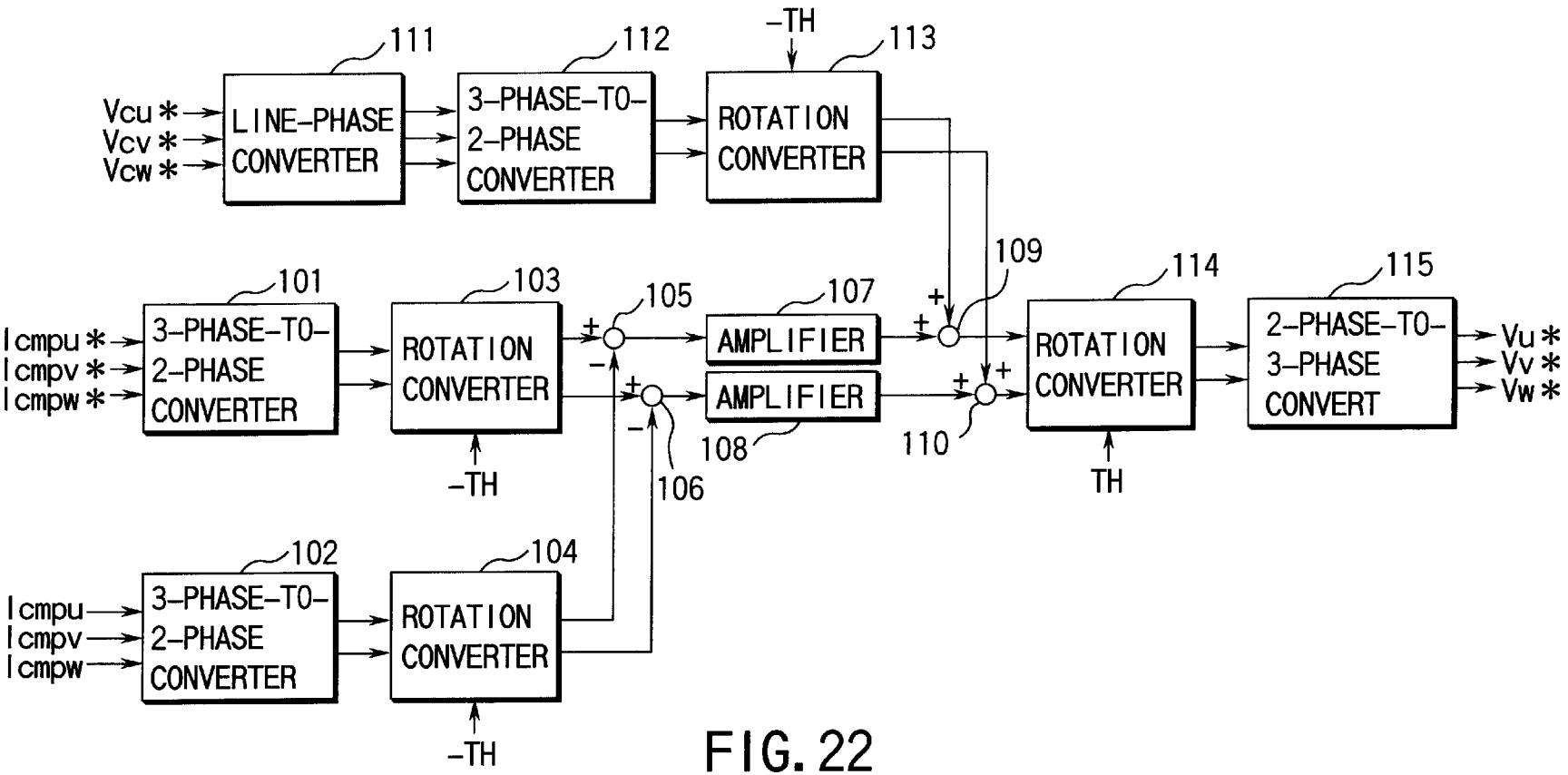
FIG. 22 is a block diagram exemplifying the detailed structure of a current control transmission line in the compensation current generator in the series compensator of the thirteenth embodiment.

FIG. 22 is a block diagram exemplifying the detailed structure of the current control transmission line ACR1.

As shown in FIG. 22, the current control transmission line ACR1 comprises 3-phase-to-2-phase converters 101 and 102, rotation converters 103 and 104, subtracters 105 and 106, amplifiers 107 and 108, adders 109 and 110, a line-phase converter 111, a 3-phase-to-2-phase converter 112, a rotation converter 113, a rotation converter 114 and a 2-phase-to-3-phase converter 115.

The operation of the thus constituted series compensator of this embodiment will now be explained by referring to FIGS. 21 and 22.

A phase detector PHD detects the phase TH of the transmission line current from the detected value thereof, and inputs the phase TH to the current control transmission line ACR1.

The current control transmission line ACR1 is further supplied with compensation current instructions Icmpu*, Icmpv* and Icmpw* given as three-phase current instructions and three-phase output current detected values Icmpu, Icmpv and Icmpw of the voltage source converter VSI1.

In the current control transmission line ACR1, the compensation current instructions Icmpu*, Icmpv* and Icmpw* are input to the 3-phase-to-2-phase converter 101 and the three-phase output current detected values Icmpu, Icmpv and Icmpw are input to the 3-phase-to-2-phase converter 102, and those inputs are transformed to two-phase amounts IcmpA*, IcmpB*, IcmpA and IcmpB by the following equation.

$$IcmpA^*=(Icmpu^*-Icmpv^*/2-Icmpw^*/2)$$

$$IcmpB^*=\mathrm{sqrt}(3)/2\times(Icmpv^*-Icmpw^*)$$

$$IcmpA=(Icmpu-Icmpv/2-Icmpw/2)$$

$$IcmpB=\mathrm{sqrt}(3)/2\times(Icmpv-Icmpw) \quad (9)$$

The outputs of the 3-phase-to-2-phase converters 101 and 102 respectively input to the rotation converters 103 and 104 and are transformed to DC amounts IcmpD*, IcmpQ*, IcmpD and IcmpQ, or components parallel to the transmission line current and components whose phases lead to the phase of the transmission line current by 90 degrees, by using the following equation.

$$IcmpD^*=IcmpA^*\times\cos(TH)+IcmpB^*\times\sin(TH)$$

$$IcmpQ^*=-IcmpA^*\times\sin(TH)+IcmpB^*\times\cos(TH)$$

$$IcmpD=IcmpA\times\cos(TH)+IcmpB\times\sin(TH)$$

$$IcmpQ=-IcmpA\times\sin(TH)+IcmpB\times\cos(TH) \quad (10)$$

As the components IcmpD* and IcmpD parallel to the transmission line current are supplied to the series capacitor C1 to generate voltages perpendicular to the transmission line current, they represent reactive current components corresponding to the reactive power.

As the components IcmpQ* and IcmpQ whose phases lead to the phase of the transmission line current by 90 degrees are supplied to the series capacitor C1 to generate voltages in phase with the transmission line current, they represent active current components corresponding to the active power.

With regard to the reactive current components and the active current components, the instruction values and detected values are input to the subtracters 105 and 106 where the differences between the instruction values and detected values are calculated.

The differences are input to the amplifiers 107 and 108 to be amplified.

Detected voltages Vcu, Vcv and VcW across the series capacitor C1 are transformed to equivalent phase voltages Vcu2, Vcv2 and Vcw2 in the line-phase converter 111 by the following equation.

$$\mathrm{Vcu}\mathbf{2}=\tfrac{1}{3}\times(2\times Vcu+Vcv)$$

$$\mathrm{Vcv}\mathbf{2}=\tfrac{1}{3}\times(2\times Vcv+Vcw)$$

$$\mathrm{Vcw}\mathbf{2}=\tfrac{1}{3}\times(2\times Vcw+Vcu) \quad (11)$$

Each output of the line-phase converter 111 is separated into an active power vector component VcD and a reactive power vector component VcQ by the 3-phase-to-2-phase converter 112 and the rotation converter 113 using the following equation, and those separated components are added to the outputs of the amplifiers 107 and 108 by the adders 109 and 110, respectively.

$$VcA=(Vcu2-Vcv2/2-\mathrm{Vcw}\mathbf{2}/2)$$

$$VcB=\mathrm{sqrt}(3)/2\times(\mathrm{Vcv}\mathbf{2}-\mathrm{Vcw}\mathbf{2}) \quad (12)$$

$$VcD=VcA\times\cos(TH)+VcB\times\sin(TH)$$

$$VcQ=VcA\times\sin(TH)+VcB\times\cos(TH) \quad (13)$$

Here, the voltage based on the detected value of each voltage across the series capacitor C1 is equivalent to the voltage to be applied to the transmission line side of the link reactor L0, and as this voltage is forwardly added to the outputs of the amplifiers 107 and 108, the amplifiers 107 and 108 need not supply bias voltage components produced by the generation of the voltage across the series capacitor C1. This can provide an improved response.

The outputs VcmpD* and VcmpQ* of the adders 109 and 110 are transformed to three-phase voltage instructions Vu*, Vv* and Vw*, given by the following equation, through the rotation converter 114 and the 2-phase-to-3-phase converter 115 and those three-phase voltage instructions are given to the PWM control transmission line PWM2.

$$VcmpA^*=VcmpD^*\times\cos(TH)-VcmpQ^*\times\sin(TH)$$

$$VcmpB^*=VcmpD^*\times\sin(TH)+VcmpQ^*\times\cos(TH) \quad (14)$$

$$Vu^*=2/3\times VcmpA^*$$

$$Vv^*=-1/3\times VcmpA^*+1/\mathrm{sqrt}(3)\times \mathrm{VcmpB}^*$$

$$Vw^*=-1/3\times VcmpA^*-1/\mathrm{sqrt}(3)\times \mathrm{VcmpB}^* \quad (15)$$

The PWM control transmission line PWM2 generates a switching pattern for each GTO of the voltage source converter VSI1 in such a way that the voltage source converter VSI1 outputs voltages equal to the three-phase voltage instructions Vu*, Vv* and Vw*.

When the detected value is smaller than the associated instruction value, a positive difference becomes greater so that the output of the amplifier 107, 108 which has amplified that difference becomes a larger positive value.

As voltages equivalent to the voltages on the transmission line side of the link reactor L0 are added in the adders 109 and 110, the outputs of the adders 109 and 110 generate voltage instructions corresponding to voltages which are greater than the transmission line-side voltages of the link reactor L0 by voltage components amplified based on the positive differences.

Voltages equal to the three-phase voltage instructions are generated by the PWM control transmission line PWM2 and the voltage source converter VSI1, and the voltages to be applied to the link reactor L0 become larger by amounts corresponding to the differences. As a result, the output currents of the voltage source converter VSI1 increase, thus reducing the differences between the detected values and the instruction values.

The current control transmission line ACR1 generates output currents equal to the current instructions Icmpu*, Icmpv* and Icmpw* in this manner.

That is, the output currents of the voltage source converters VSI1 are so controlled to be always equal to the current instructions and the voltage source converter VSI1 works as the current source that always supplies the currents equal to the current instructions to the series capacitor C1.

Each current output from the voltage source converter VSI1 is converted by the series transformer Tr1 in accordance with the number of turns, and the resultant current is supplied to the series capacitor C1, thereby generating a compensation voltage.

In other words, since the voltage source converter VSI1 in this embodiment serves as the current source that outputs the compensation current equal to the instruction value under PWM control based on the current instruction, it works as the compensation current generator which generates the compensation current matched with a predetermined instruction value.

As a result, the predetermined compensation current is supplied via the series transformer Tr1 to the series capacitor C1 connected to the output of the compensation current generator CMP1, thus allowing a predetermined compensation voltage to be produced in series to the AC transmission line.

Although the foregoing description of this embodiment has been given with reference to the structure that uses a single voltage source converter connected in three-phase bridge rectifier connection for the sake of simpler description, a plurality of voltage source converters may be connected in a multiplexing form to achieve a large capacity.

Fourteenth Embodiment

Figure 23:
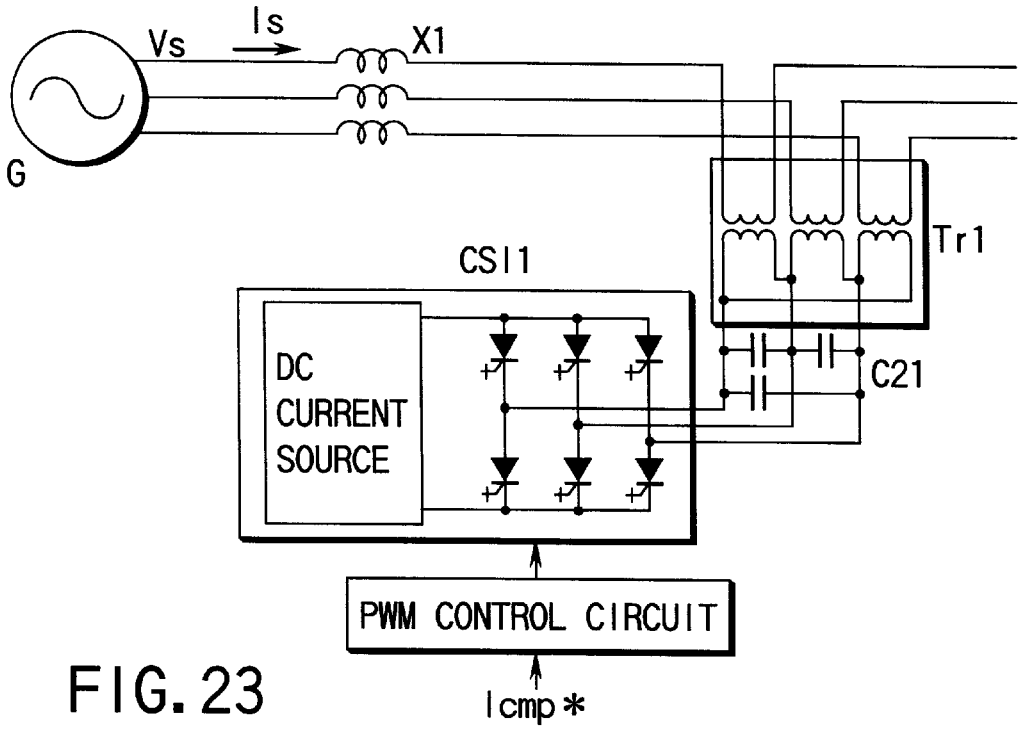
FIG. 23 is a block transmission line diagram showing one example of a series compensator according to a fourteenth embodiment of this invention.

FIG. 23 is a block transmission line diagram exemplifying tie structure of a series compensator according to this embodiment, and same reference numerals as used for the components in the fifth embodiment are again used relative to corresponding components of this series compensator.

According to this embodiment, as shown in FIG. 23, as a capacitor C21 is provided on the low-voltage side of the series transformer Tr1, the aforementioned compensation current generator CMP1 is constituted by the current source converter CSI1 alone.

According to the thus constituted series compensator of this embodiment, the current source converter CSI1 generates a current equal to the compensation instruction under PWM control and serves as a current source to supply the compensation current to the capacitor C21, so that various compensation voltages can be generated on the primary winding of the series transformer Tr1.

It is possible to omit a transformer in the compensation current generator CMP1 and also a harmonic filter because the capacitor C21, which is connected to the secondary winding of the series transformer Tr1 and generates the compensation voltage normally needed, serves as a filter.

Figure 24:
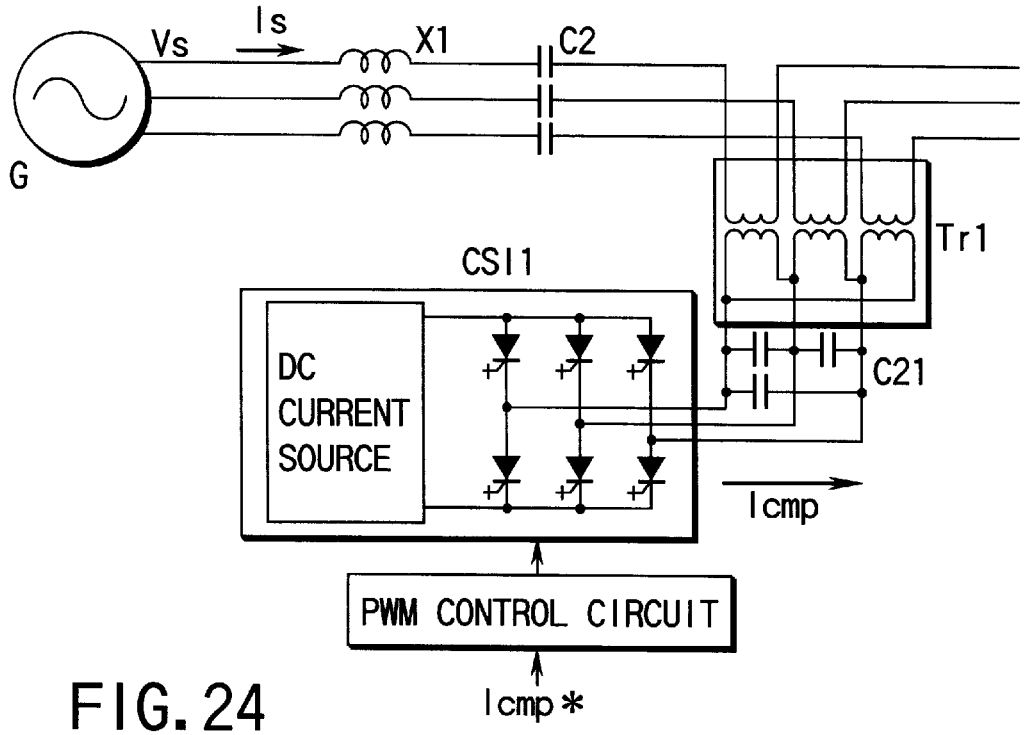
FIG. 24 is a block transmission line diagram showing another example of the series compensator according to the fourteenth embodiment of this invention.
Figure 25:
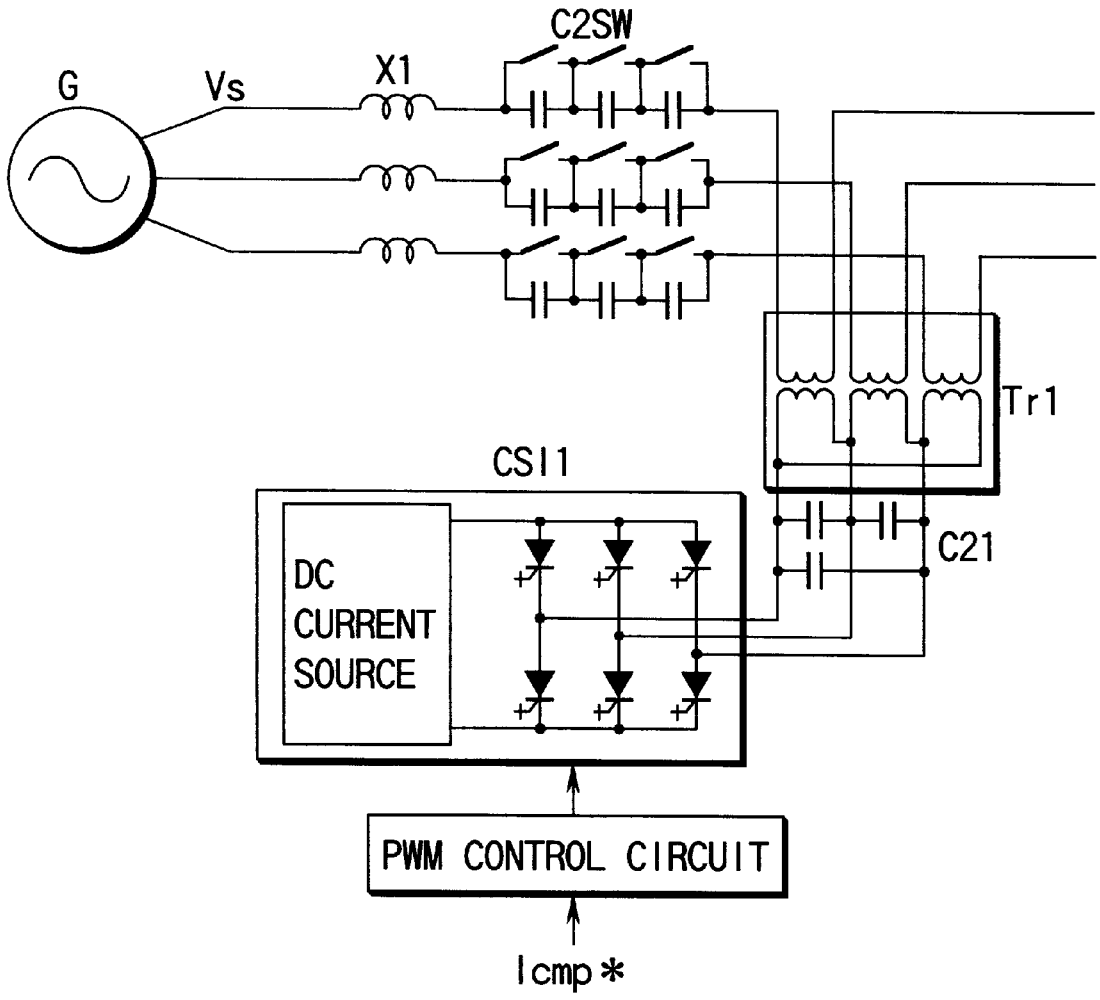
FIG. 25 is a block transmission line diagram showing a further example of the series compensator according to the fourteenth embodiment of this invention.
Figure 26:
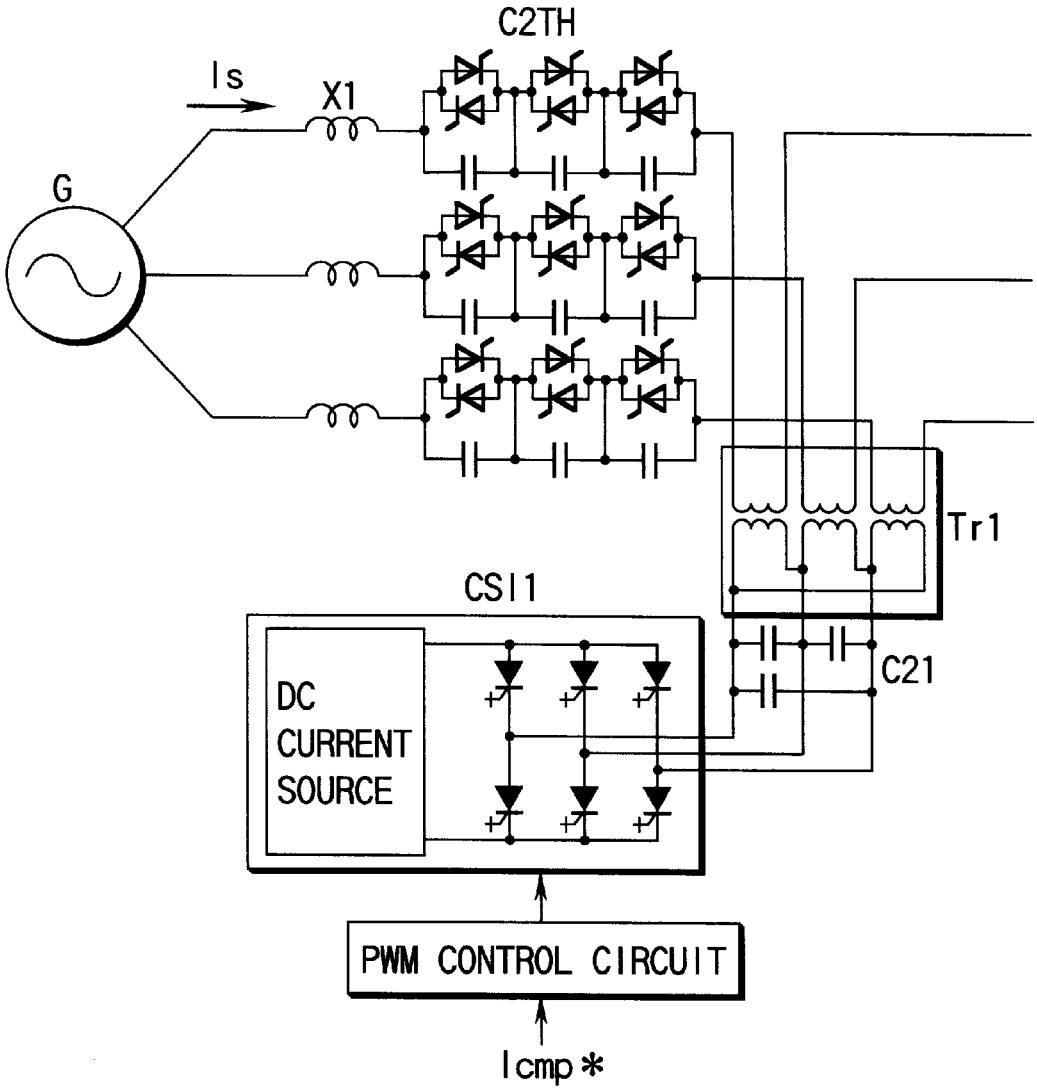
FIG. 26 is a block transmission line diagram showing a still further example of the series compensator according to the fourteenth embodiment of this invention.

FIGS. 24 to 26 are block transmission line diagrams exemplifying the structure of the series compensator according to this embodiment, and the same reference numerals as used for the components in the ninth to eleventh embodiments are used relative to corresponding components of this series compensator.

According to this embodiment, as shown in FIGS. 24 to 26, as the capacitor C21 is provided on the low-voltage side of the series transformer Tr1, the aforementioned compensation current generator CMP1 is constituted by the current source converter CSI1 alone.

The series compensator of this embodiment with the above structure can supply various compensation voltages to the transmission line through the same operation as has been discussed above relative to the ninth to eleventh embodiments.

It is possible to omit a transformer in the compensation current generator CMP1 and also a harmonic filter because the capacitor C21, which is connected to the secondary winding of the series transformer Tr1 and generates the compensation voltage normally needed, serves as a filter.

As described above, since the current source converter CSI1 in this embodiment has a DC voltage source on the DC side and serves as a current source which outputs the compensation current equal to the instruction value under PWM control based on the current instruction, it works as the compensation current generator which generates the compensation current matched with a predetermined instruction value.

Consequently, the predetermined compensation current is supplied to the capacitor C21 connected to the output of the compensation current generator CMP1, thus allowing a predetermined compensation voltage to be produced in series to the AC transmission line.

Fifteenth Embodiment

Figure 27:
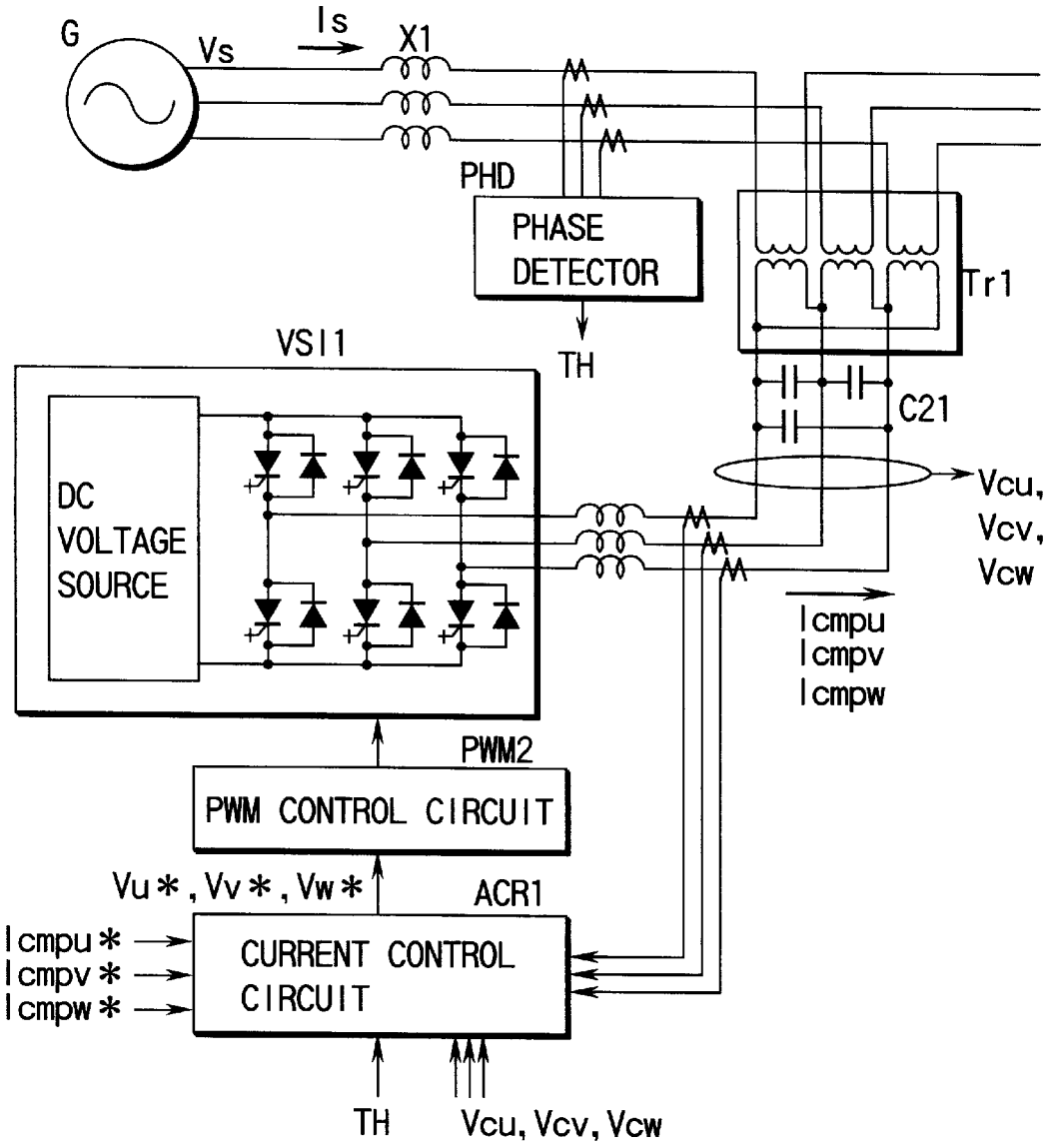
FIG. 27 is a block transmission line diagram showing one example of a series compensator according to a fifteenth embodiment of this invention.

FIG. 27 is a block transmission line diagram exemplifying the structure of a series compensator according to this embodiment, and the same reference numerals as used for the components in the fifth embodiment are again used relative to corresponding components of this series compensator.

According to this embodiment, as shown in FIG. 27, as a capacitor C21 is provided on the low-voltage side of the series transformer Tr1, the aforementioned compensation current generator CMP1 is constituted only by the voltage source converter VSI1 equipped with a current control transmission line.

According to the thus constituted series compensator of this embodiment, the voltage source converter VSI1 generates a current equal to the compensation instruction under current control and serves as a current source, and the compensation current is supplied to the capacitor C21, so that various compensation voltages can be generated on the primary winding of the series transformer Tr1.

It is possible to omit a transformer in the compensation current generator CMP1.

Figure 28:
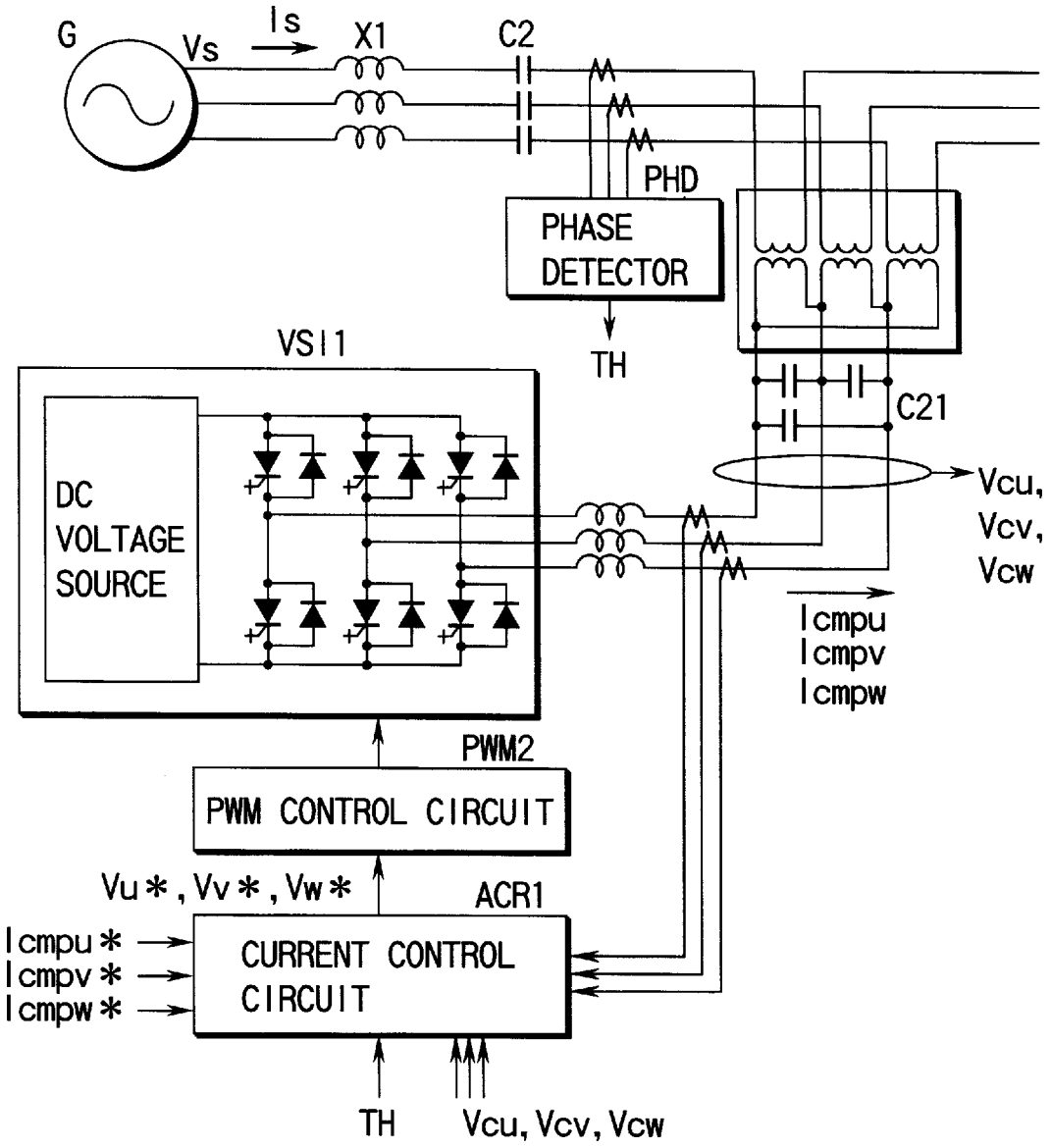
FIG. 28 is a block transmission line diagram showing another example of the series compensator according to the fifteenth embodiment of this invention.
Figure 29:
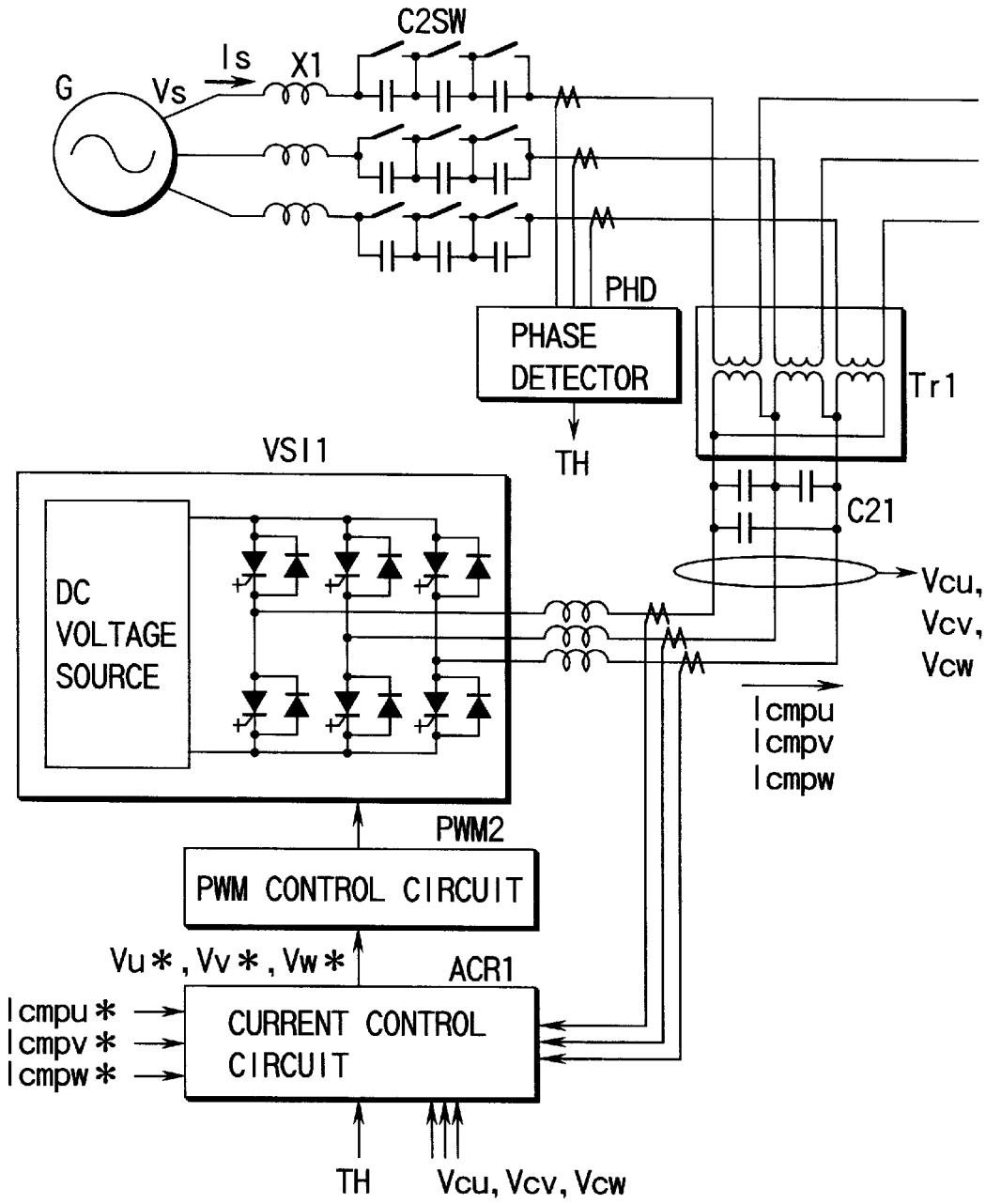
FIG. 29 is a block transmission line diagram showing a further example of the series compensator according to the fifteenth embodiment of this invention.
Figure 30:
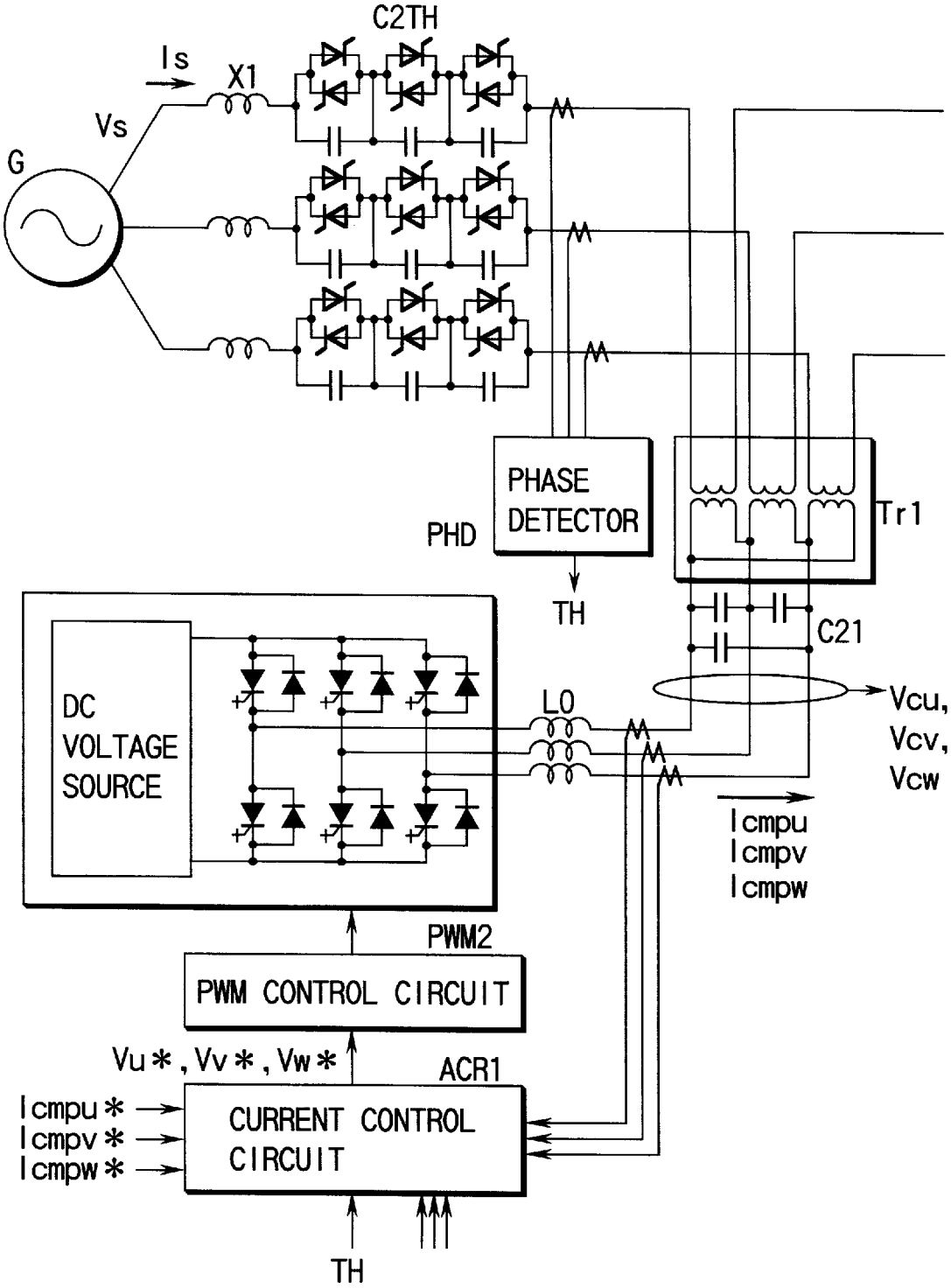
FIG. 30 is a block transmission line diagram showing a still further example of the series compensator according to the fifteenth embodiment of this invention.

FIGS. 28 to 30 are block transmission line diagrams exemplifying the structure of the series compensator according to this embodiment, and same reference numerals as used for the components in the ninth to eleventh embodiments are given to corresponding components of this series compensator.

According to this embodiment, as shown in FIGS. 28 to 30, as the capacitor C21 is provided on the low-voltage side of the series transformer Tr1, the aforementioned compensation current generator CMP1 is constituted only by the voltage source converter CVS1 having the current control transmission line.

The series compensator of this embodiment with the above structure can supply various compensation voltages to the transmission line through the same operation as has been discussed above relative to the ninth to eleventh embodiments.

It is possible to omit a transformer in the compensation current generator CMP1.

According to this embodiment, as described above, the current control transmission line which controls the output current of the voltage source converter VSI1 generates such a voltage instruction as to make the output current of the voltage source converter VSI1 coincide with the compensation current instruction, and the voltage source converter VSI1 outputs a voltage equal to the voltage instruction under PWM control. As a result, the output current coincides with the compensation current instruction. This current control transmission line therefore works as the compensation current generator that generates the compensation current instruction which coincides with a predetermined instruction value.

Consequently, the predetermined compensation current is supplied to the capacitor C21 connected to the output of the compensation current generator CMP1, thus allowing a predetermined compensation voltage to be produced in series to the AC transmission line.

Sixteenth Embodiment

Figure 31:
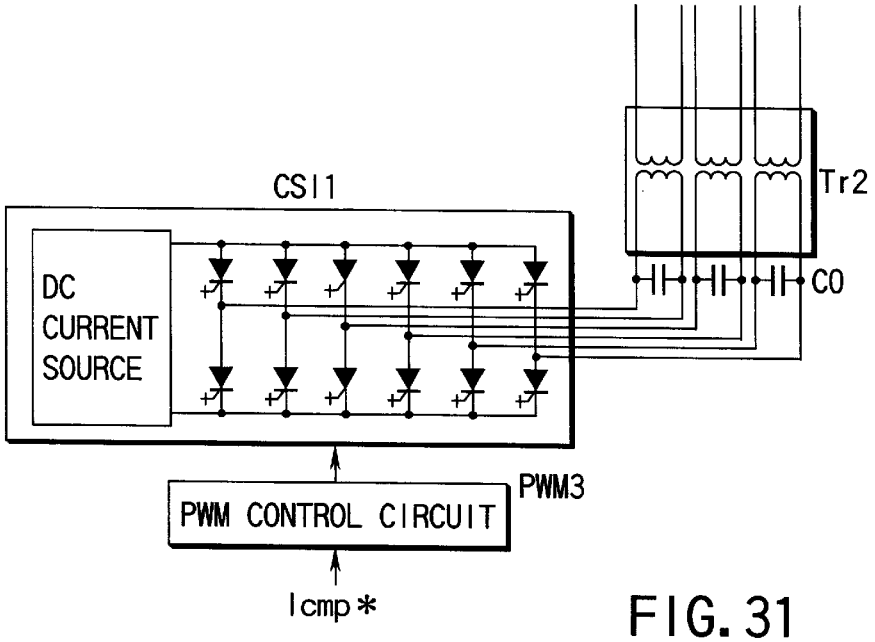
FIG. 31 is a block transmission line diagram illustrating a series compensator according to a sixteenth embodiment of this invention.

FIG. 31 is a block transmission line diagram exemplifying a structure of a series compensator according to this embodiment, and the same reference numerals as used for the components of the twelfth or fourteenth embodiment are again used relative to corresponding components of this series compensator.

According to this embodiment, as shown in FIG. 31, the aforementioned compensation current generator CMP1 comprises a current source converter CSI1, which has reverse blocking GTOs as switching elements connected in single-phase bridge rectifier connection for each phase and comprises a current source converter CSI2 having a DC current source on the DC side, and a series transformer Tr2.

Provided between the current source converter CSI2 and the series transformer Tr2 is a harmonic filter C0 for eliminating a harmonic component produced by the current source converter CSI2.

The series compensator of this embodiment with the above structure can supply various compensation voltages to the transmission line through the same operation as has been discussed above relative to the twelfth or fourteenth embodiment.

Further, the output currents of the individual phases can be controlled independently.

In other words, by controlling the switching of the reverse blocking GTOs as switching elements connected in single-phase bridge rectifier connection for each phase, the current source converter CSI2 in this embodiment outputs a current matched with the instruction current and thus works as the compensation current generator which generates the compensation current instruction that coincides with a predetermined instruction value.

Consequently, the predetermined compensation current is supplied to the capacitor connected to the output of the compensation current generator CMP1, thus allowing a predetermined compensation voltage to be produced in series to the AC transmission line. In this case, the single-phase bridge rectifier connection for each phase can allow the compensation currents of the individual phases to be controlled independently.

Although the foregoing description of this embodiment has been given with reference to the structure that uses the series transformer Tr2 and the harmonic filter C0, a transformer-less and filter-less structure may be provided by directly connecting the output of the current source converter CSI2 to both ends of the series capacitor.

Seventeenth Embodiment

Figure 32:
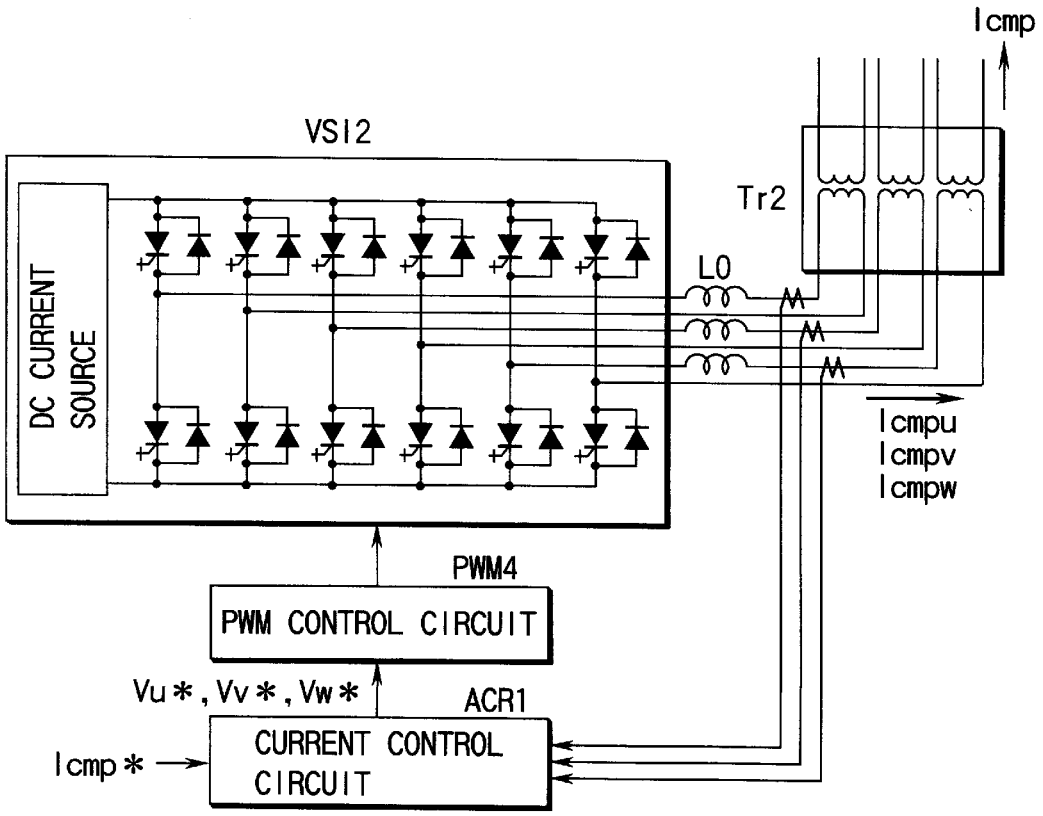
FIG. 32 is a block transmission line diagram illustrating a series compensator according to a seventeenth embodiment of this invention.

FIG. 32 is a block transmission line diagram exemplifying a structure of a series compensator according to this embodiment, and the same reference numerals as used for the components of the thirteenth or fifteenth embodiment are again used relative to corresponding components of this series compensator.

According to this embodiment, as shown in FIG. 32, the aforementioned compensation current generator CMP1 comprises a current source converter CSI1, which has GTOs as switching elements connected in single-phase bridge rectifier connection for each phase and comprises a voltage source converter VSI2 having a DC voltage source on the DC side, a current control transmission line ACR1 for controlling the output current of the voltage source converter VSI2 and a series transformer Tr2.

The series compensator of this embodiment with the above structure basically can supply various compensation voltages to the transmission line through quite the same operation as has been discussed in the section of the thirteenth or fifteenth embodiment.

Further, the output currents of the individual phases can be controlled independently.

In other words, by giving a voltage instruction for outputting a current matched with a predetermined instruction current to the voltage source converter VSI2 as the output of the current control transmission line ACR1 and controlling the switching of the GTOs as switching elements connected in single-phase bridge rectifier connection for each phase, the voltage source converter VSI2 in this embodiment outputs a current matched with the instruction voltage and thus works as the compensation current generator which generates the compensation current instruction that coincides with a predetermined instruction value.

Consequently, the predetermined compensation current is supplied to the capacitor connected to the output of the compensation current generator CMP1, thus allowing a predetermined compensation voltage to be produced in series to the AC transmission line. In this case, the single-phase bridge rectifier connection for each phase can allow the compensation currents of the individual phases to be controlled independently.

Although this embodiment has been described has having the structure that uses the series transformer Tr2, a transformer-less structure may be provided by directly connecting the output of the current source converter CSI2 to both ends of the series capacitor.

Eighteenth Embodiment

Figure 33:
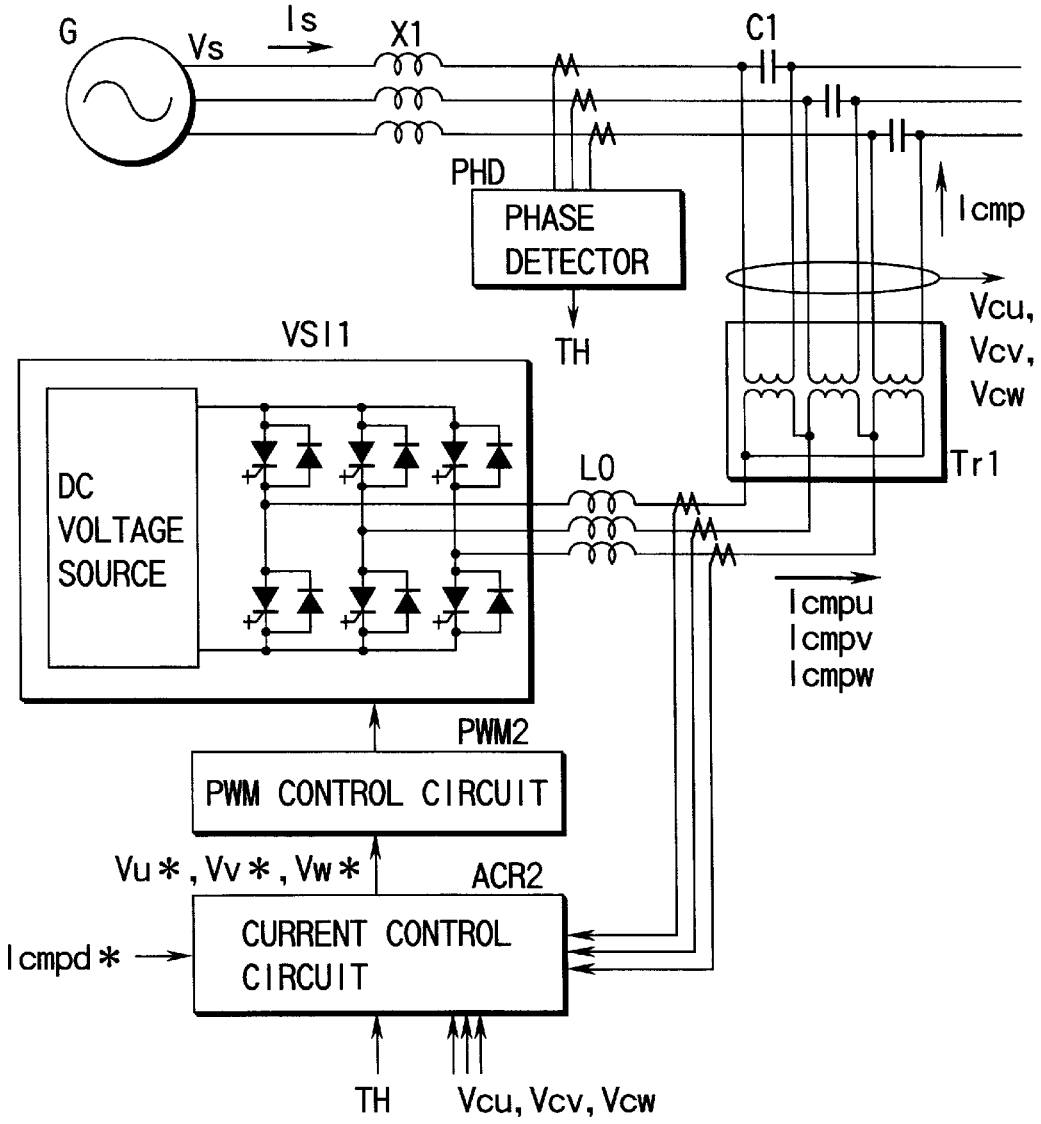
FIG. 33 is a block transmission line diagram showing one example of a series compensator according to an eighteenth embodiment of this invention.

FIG. 33 is a block transmission line diagram exemplifying a structure of a series compensator according to this embodiment, and the same reference numerals as used for the components of each of the first to seventeenth embodiments are again used relative to corresponding components of this series compensator.

According to this embodiment, as shown in FIG. 33, a compensation current controller is constructed in such a way that the compensation current generator CMP1 in any one of the first to seventeenth embodiments generates a current having the same phase as or the opposite phase to the phase of the current from an AC transmission line upon detection of the AC transmission line current.

This embodiment has such a structure that the voltage source converter of the thirteenth embodiment is adapted to the first embodiment.

Figure 34:
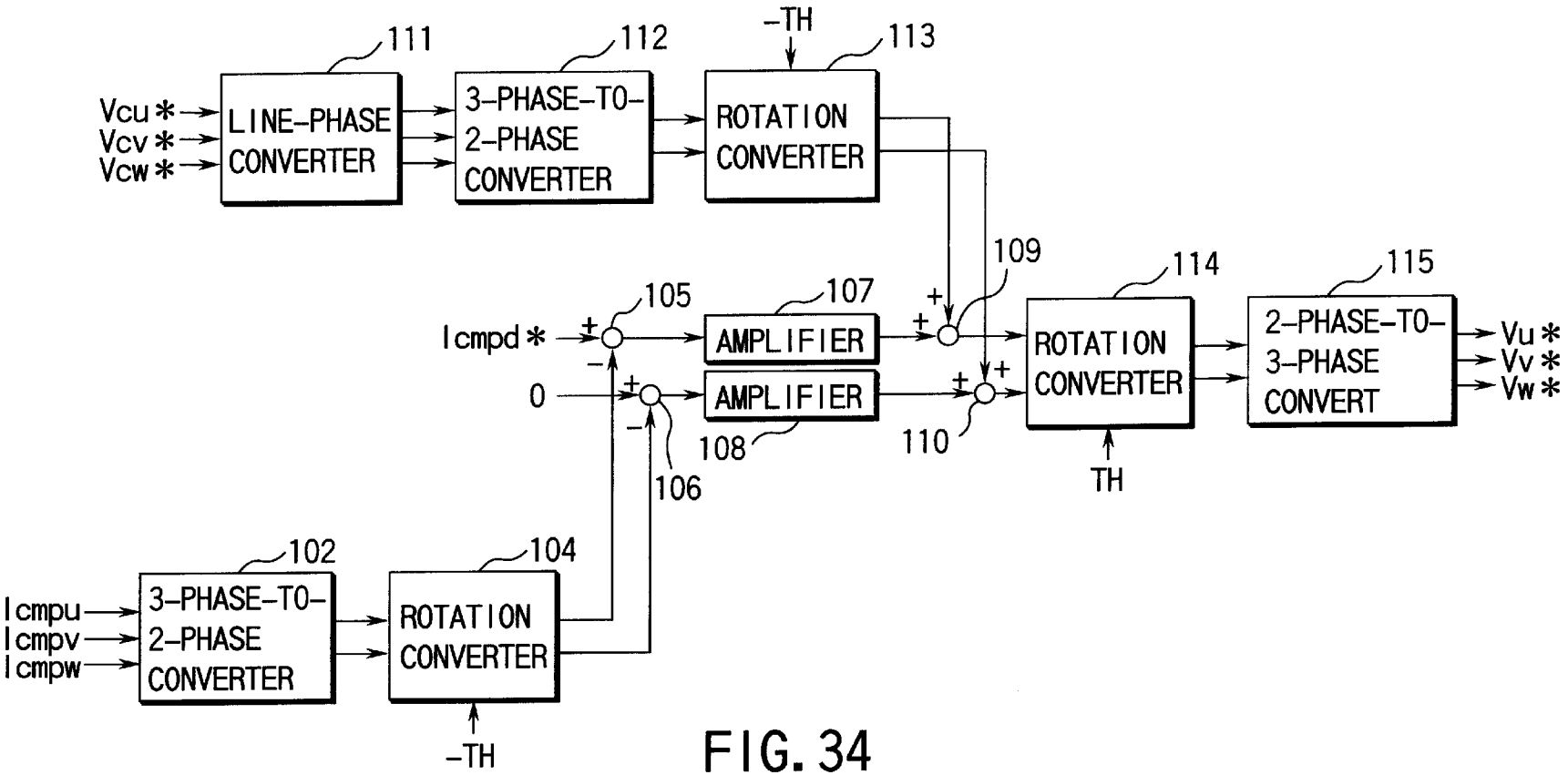
FIG. 34 is a block diagram exemplifying the detailed structure of a current control transmission line in the series compensator of the eighteenth embodiment.

FIG. 34 is a block diagram exemplifying the detailed structure of the current control transmission line ACR2, and the same reference numerals as used for the components in FIG. 22 are again used relative to corresponding components.

The operation of the series compensator according to this embodiment with the above-described structure will be discussed referring to FIGS. 33 and 34.

The transmission line current Icmpd* in the direction of the transmission line current is input to the current control transmission line ACR2 which performs a current control operation with the current instruction being zero in the direction of the phase leading by 90 degrees to the phase of the transmission line current.

When the compensation current instruction Icmpd* has a positive value, a current instruction in phase with the transmission line current is given to the current control transmission line ACR2, whereas when the compensation current instruction Icmpd* has a negative value, a current instruction having the opposite phase to that of the transmission line current is given to the current control transmission line ACR2.

The current control transmission line ACR2 outputs voltage instructions Vu*, Vv* and Vw* which cause the voltage source converter VSI1 to output a current equal to the compensation current instruction Icmpd*, and the PWM control transmission line PWM2 generates a switching pattern for each GTO.

As a result, the output currents Icmpu, Icmpv and Icmpw become compensation currents having a component having the same phase as or the opposite phase to the transmission line current.

Further, the compensation current having a component having the same phase as or the opposite phase to the phase of the transmission line current is supplied via the series transformer Tr1 to the series capacitor C1.

A voltage which has a phase delay of 90 degrees to the transmission line current is generated across the series capacitor C1 to which the compensation current having a component having the same phase as or the opposite phase to that of the transmission line current is supplied, and becomes the compensation voltage which has the same phase as or the opposite phase to that of the voltage to be generated across the series capacitor C1 when the compensation current is zero.

Figure 35:
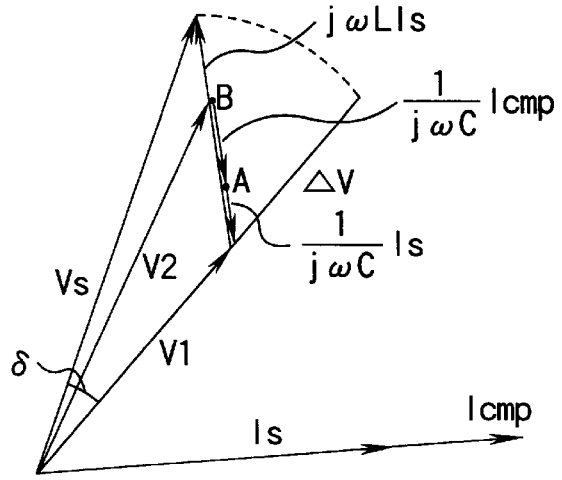
FIG. 35 is a vector diagram for explaining the operation of the series compensator according to the eighteenth embodiment.

Consequently, the series capacitor C1 works as an equivalent variable reactance. FIG. 35 is a vector diagram illustrating the operation then.

Because of the voltage drop caused by the transmission line reactance Xs, the AC-power-supply-side transmission line voltage V1 of the series capacitor C1 becomes a voltage whose phase is delayed by $\delta$ and whose amplitude is dropped by $\Delta V$.

When the compensation current Icmp is zero, a voltage $1/(j\omega C)\times Is$ perpendicular to the transmission line current Is is generated across and the load-side voltage V2 of the series capacitor C1 is expressed by a vector having its end at a point A in FIG. 35.

When the compensation current Icmp in phase with the transmission line current Is is supplied to the series capacitor C1, a voltage $1/(j\omega C)\times Icmp$ is further generated across the series capacitor C1, and the end of the vector representing the load-side voltage V2 of the series capacitor C1 is shifted to a point B, further compensating for the voltage drop caused by the transmission line impedance.

By changing the compensation current Icmp in phase or in the opposite phase, the end of the vector representing the load-side voltage V2 of the series capacitor C1 can be changed on a straight line which connects the AC supply voltage vector Vs to the end of the power-supply-side voltage V1 of the series capacitor C1 around the point A.

That is, the series compensator can be operated as a variable reactance to compensate for the voltage drop caused by the transmission line reactance.

In the case of the sixteenth embodiment, the compensation voltage is always perpendicular to the transmission line current so that the compensation current generator CMP1 does not basically output active power to an AC transmission line.

Accordingly, a capacitor can be used as a DC voltage source. In this case, since active power which corresponds to a loss generated by the voltage source converter or the like should be supplemented from the AC transmission line, a compensation current controller constructed as shown in FIGS. 36 and 37 is used.

Figure 36:
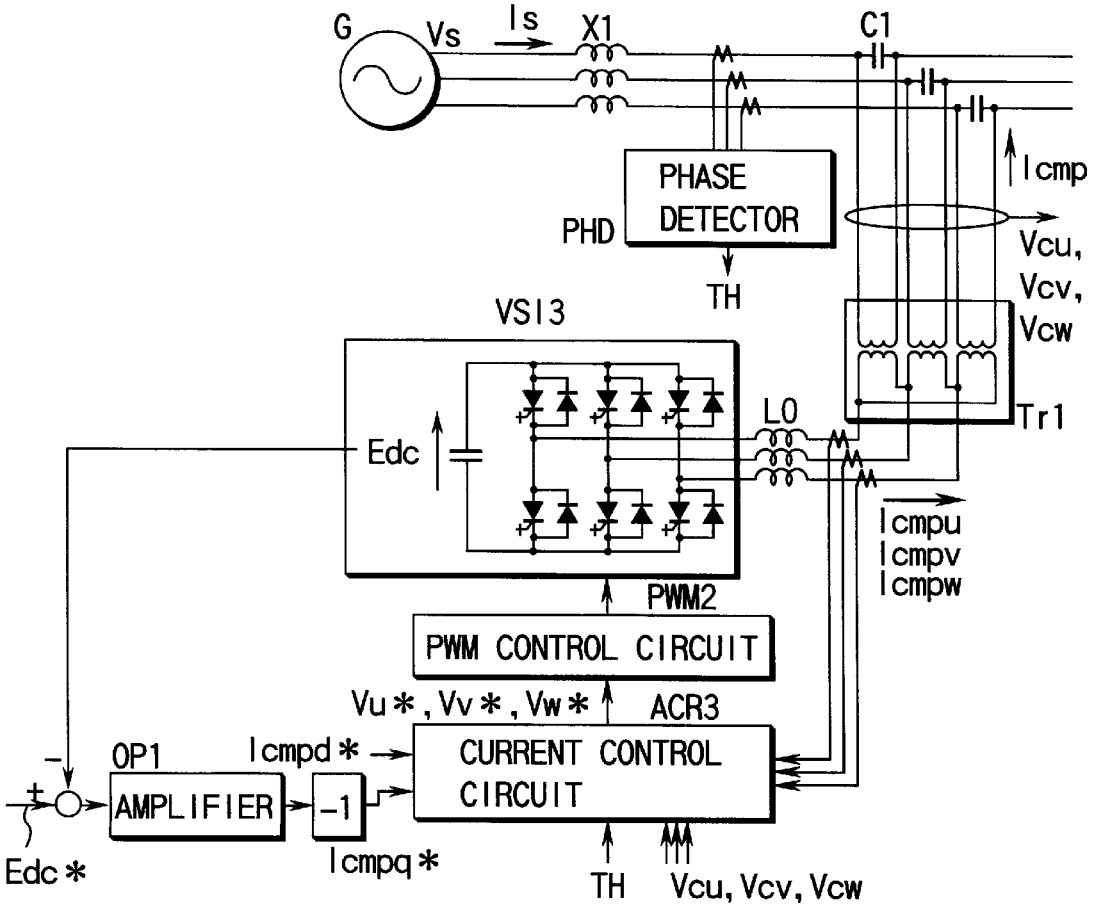
FIG. 36 is a block transmission line diagram showing another example of the series compensator according to the eighteenth embodiment of this invention.
Figure 37:
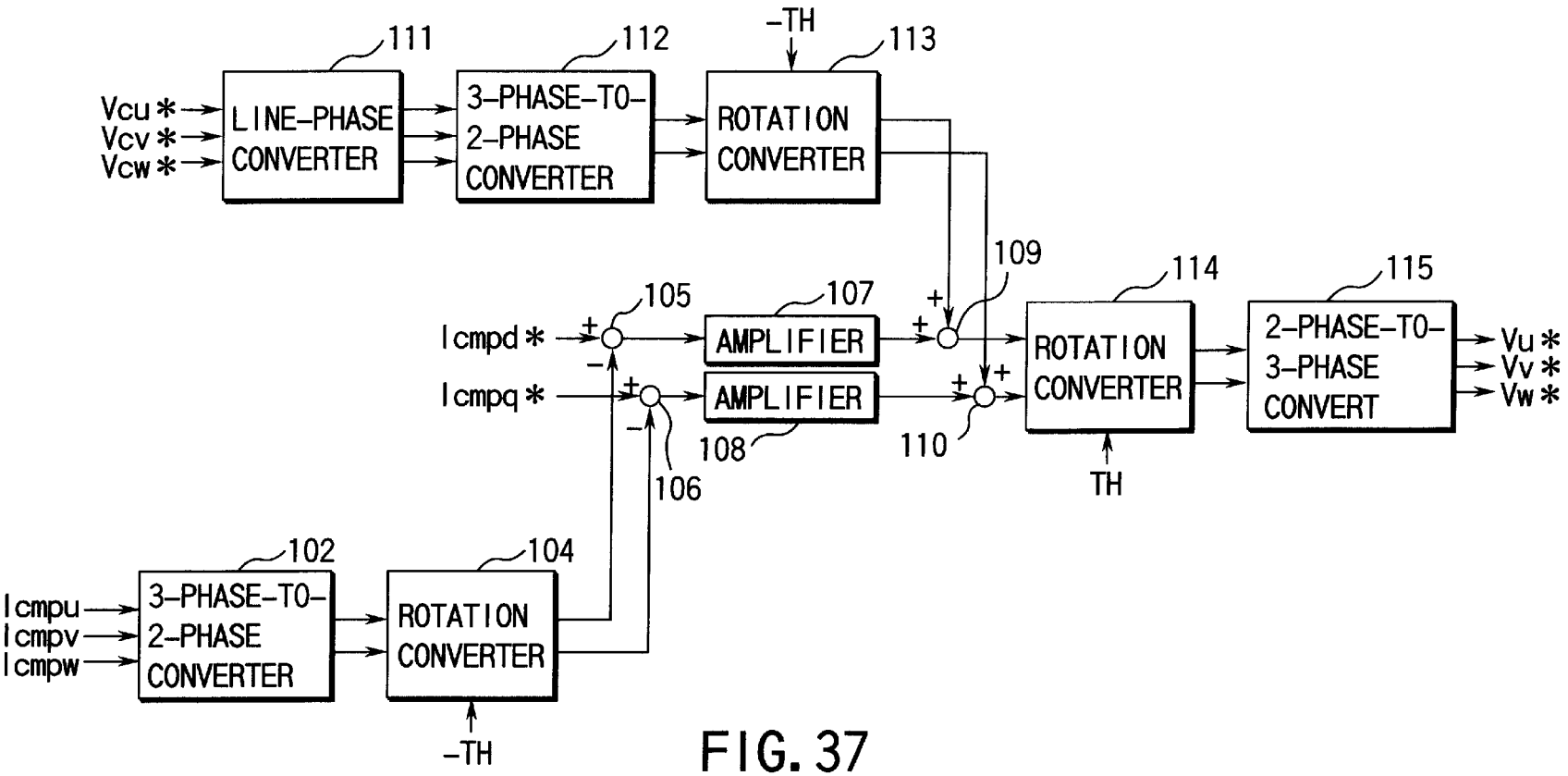
FIG. 37 is a block transmission line diagram showing a further example of the series compensator according to the eighteenth embodiment of this invention.

Referring to FIGS. 36 and 37, series capacitor voltage Edc is detected, and a difference between this voltage and a DC voltage instruction Edc* is computed by a subtracter and is then amplified by an amplifier OP1.

The output of the amplifier OP1 is inverted and given to a current control transmission line ACR3 as a compensation current instruction Icmpq* perpendicular to the transmission line current together with an transmission line current instruction Icmpd* in phase with the transmission line current.

The current control transmission line ACR3 provides the PWM control transmission line PWM2 with voltage instructions Vu*, Vv* and Vw* for causing a voltage source converter VSI3 to output currents equal to the compensation current instructions Icmpd* and Icmpq*.

To output voltages equal to the voltage instructions Vu*, Vv* and Vw*, the PWM control transmission line PWM2 computes switching patterns for the voltage source converter VSI3 through PWM modulation and send them as gate signals to the individual GTOs of the power converter.

As a result, the voltage source converter VSI3 outputs the currents equal to the compensation current instructions Icmpd* and Icmpq*, and supplies the compensation current Icmp to the series capacitor C1 via the series transformer Tr1.

In this case, although the compensation current Icmp contains a slight active current to supplement for the loss, it mostly becomes a reactive current component in phase with the transmission line current, allowing the series compensator to work as a variable reactance.

According to this embodiment, as described above, the current of an AC transmission line is detected, a compensation current instruction having the same phase as or the opposite phase to the phase of the transmission line current is supplied to the compensation current generator CMP1 based on the phase of the transmission line current, and the compensation current generator CMP1 generates a compensation current matched with the compensation current instruction and supplies a current having the same phase as or the opposite phase to the phase of the transmission line current to the series capacitor C1 connected to the compensation current generator CMP1. The compensation voltage that is generated across the series capacitor C1 by the compensation current becomes a component perpendicular to the transmission line current, and the capacitor portion works as an equivalent variable reactance.

This can accomplish various series compensations. In this case, the compensation current generator CMP1 does not basically supply active power to the AC transmission line, so that the DC transmission line of the power converter which constitutes the compensation current generator CMP1 can be realized by a capacitor in a case of a voltage source converter and by an inductance in a case of a current source converter.

Nineteenth Embodiment

Figure 38:
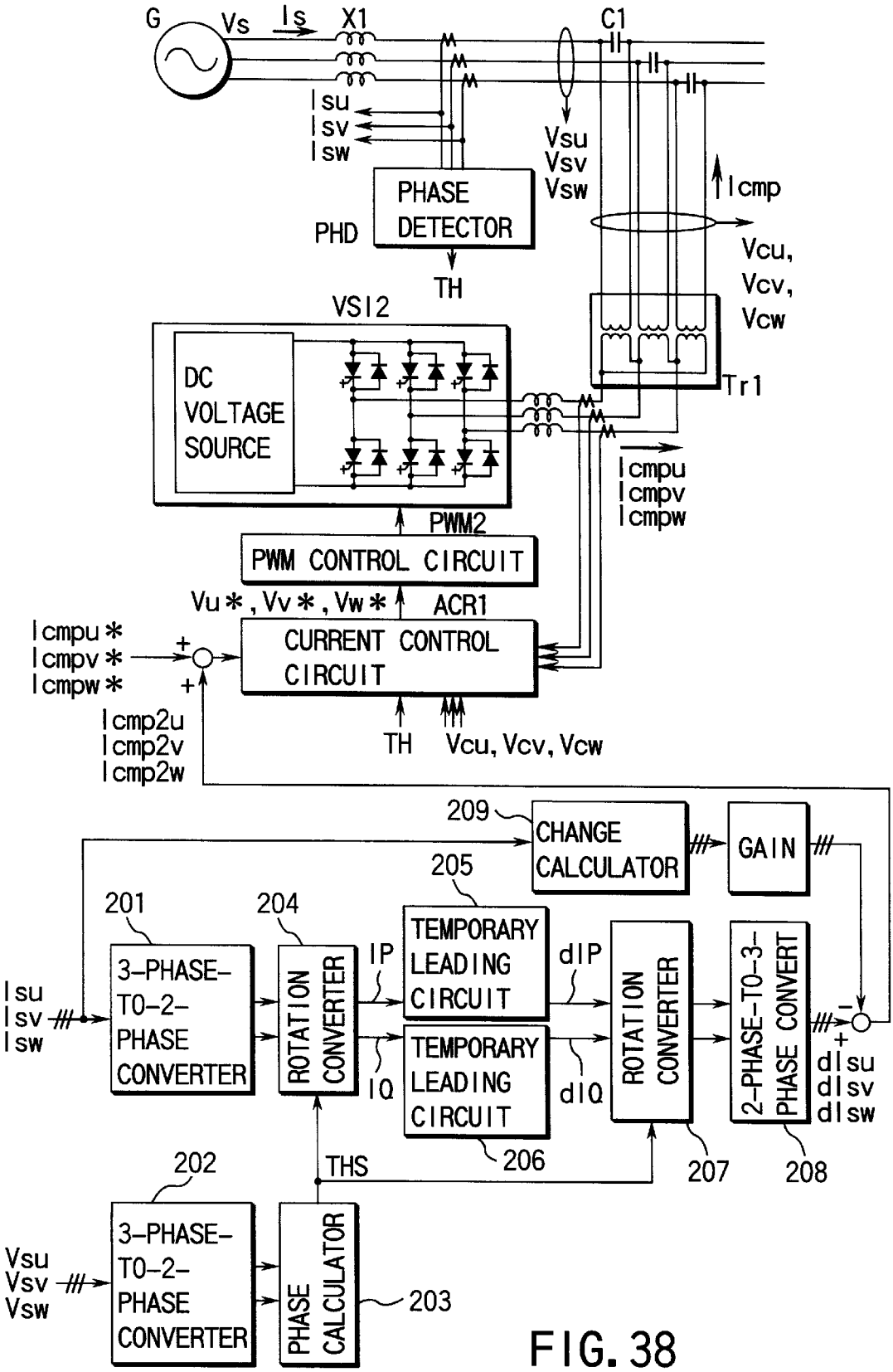
FIG. 38 is a block transmission line diagram illustrating a series compensator according to a nineteenth embodiment of this invention.

FIG. 38 is a block transmission line diagram exemplifying the structure of a series compensator according to this embodiment, and the same reference numerals as used for the components in each of the first to eighteenth embodiments are again used relative to corresponding components of this series compensator.

As shown in FIG. 38, this embodiment is constructed in such a way that a power fluctuation suppressing control device, which comprises a detection transmission line for detecting the transmission line current flowing in an AC transmission line and the transmission line voltage thereof, a calculation transmission line for calculating an active current component and a reactive current component flowing in the AC transmission line and a fluctuation suppressing transmission line for generating such a compensation current instruction as to suppress the fluctuation of the AC transmission line based on the ratio of a change in transmission line current, a variation in active current component and a variation in reactive current component, is provided in each of the first to eighteenth embodiments.

According to the thus constituted series compensator of this embodiment, transmission line currents Isu, Isv and Isw and transmission line voltages Vsu, Vsv and Vsw are detected and are respectively transformed to two-phase amounts Isa and Isb and Vsa and Vsb in 3-phase-to-2-phase converters 201 and 202 using the following equation.

$$Isa=(Isu-Isv/2-Isw/2)$$

$$Isb=\mathrm{sqrt}(3)/2\times(Isv-Isw)$$

$$Vsa=(Vsu-Vsv/2-Vsw/2)$$

$$Vsb=\mathrm{sqrt}(3)/2\times(Vsv-Vsw) \quad (16)$$

The two-phase amounts Vsa and Vsb are input to a phase calculator 203 where the phase THS of each transmission line voltage is computed.

The two-phase amounts Isa and Isb are input to a rotation converter 204 to be converted to a current IP parallel to the transmission line voltage vector and a current IQ whose phase leads by 90 degrees to the transmission line voltage vector by rotation conversion of −THS which is expressed by the following equation.

$$IP=Isa\times\cos(THS)+Isb\times\sin(THS)$$

$$IQ=-Isa\times\sin(THS)+Isb\times\cos(THS) \quad (17)$$

The currents IP and IQ respectively correspond to the active current component and reactive current component of the transmission line current. The currents IP and IQ are input to temporary leading transmission lines 205 and 206 where variations dIP and dIQ of the active current component and reactive current component are computed.

The variations dIP and dIQ of the active current component and reactive current component are input to a rotation converter 207 and a 2-phase-to-3-phase converter 208 to be transformed to three-phase amounts dlsu, dlsv and disw through rotation conversion of +TH and 2-phase-to 3-phase conversion which are expressed by the following equation.

$$dIa=dIP\times\cos(THS)-dIQ\times\sin(THS)$$

$$dIb=dIP\times\sin(THS)+dIQ\times\cos(THS)$$

$$dIsu=\tfrac{2}{3}\times dIa$$

$$dIsv=-\tfrac{1}{3}\times dIa+1/\mathrm{sqrt}(3)\times dIa$$

$$dIsw=-\tfrac{1}{3}\times dIa-1/\mathrm{sqrt}(3)\times dIb \quad (18)$$

The transmission line current detected values Isu, Isv and Isw are also input to a change calculator 209 which calculates the difference between a previous detected value and a current detected value, and each ratio of a change in transmission line current is computed there and is multiplied by a gain. The resultant values are subtracted from disu, disv and disw, yielding three-phase fluctuation suppressing signals Icmp2U, Icmp2v and Icmp2w.

The three-phase fluctuation suppressing signals Icmp2U, Icmp2v and Icmp2w are further added to the compensation current instructions Icmpu*, Icmpv* and Icmpw* that are normally needed.

The compensation currents corresponding to the variations in the active current component and reactive current component are supplied to the series capacitor C1 connected in parallel to the compensation current generator CMP1, which in turn generates voltages which have phase delays of 90 degrees to those of the active current and reactive current that pass the AC transmission line.

As a variation in the voltage applied to the transmission line reactance Xs which has caused a fluctuation in the active current and reactive current has a phase leading by 90 degrees to the phases of the active current and reactive current, the transmission line voltages to be supplied to the series capacitor C1 have a phase to cancel out the voltage that has caused the fluctuation.

As the compensation current proportional to the ratio of a change in transmission line current has a phase leading by 90 degrees to the phase of the current that passes the series capacitor C1, negative feedback of this signal works in a direction to damp the fluctuation in the current flowing across the series capacitor C1.

Figure 39:
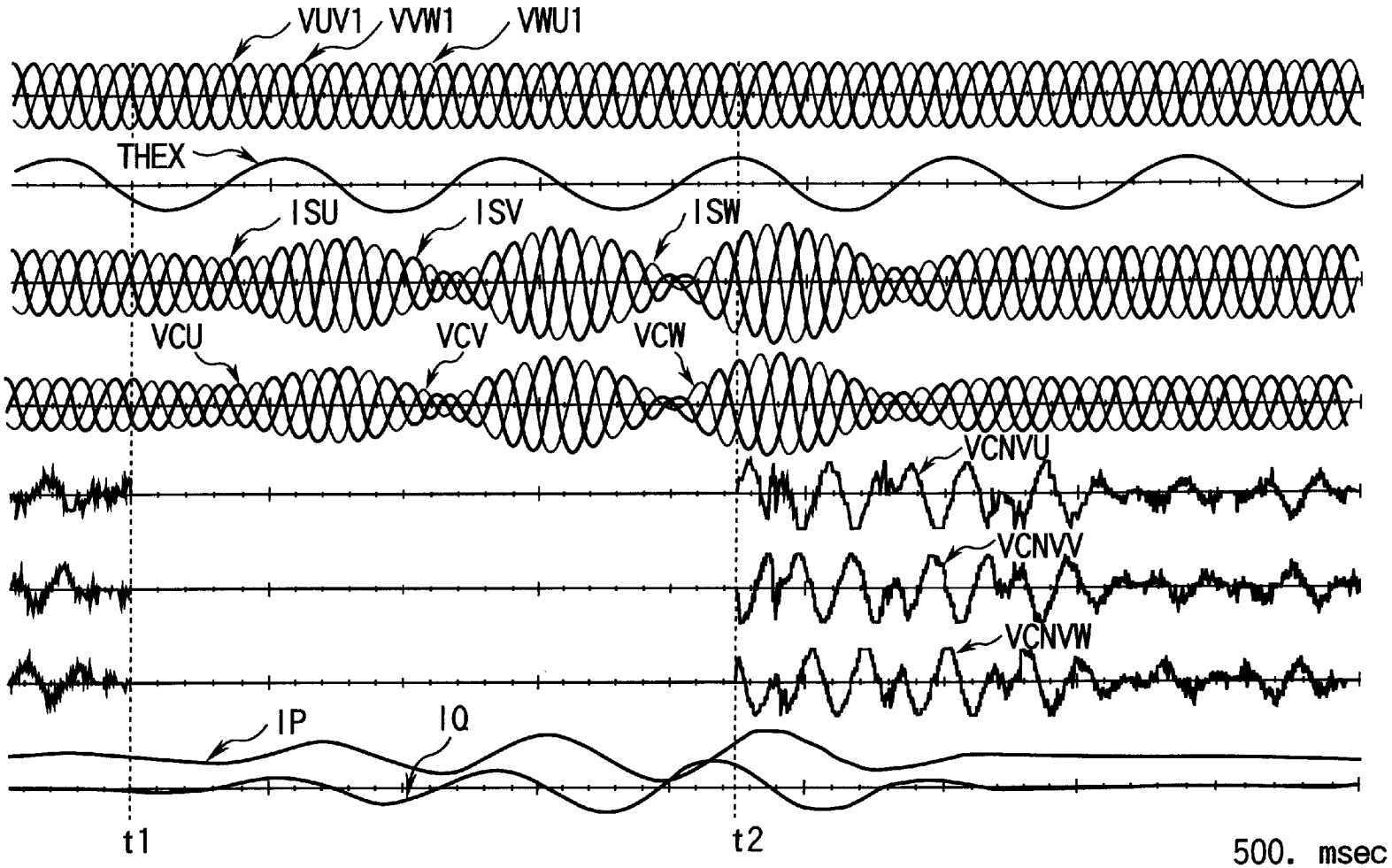
FIG. 39 is a diagram showing one example of the operational waveforms of a power fluctuation suppressing device in the series compensator of the nineteenth embodiment.

FIG. 39 is an operational waveform chart showing one example of the fluctuation suppressing effect of this embodiment.

In FIG. 39, VUV1, VVW1 and VWU1 denote transmission line voltages, THEX shows a variation in the phase of the AC power supply, Isu, Isv and Isw denote transmission line currents, Vcu, Vcv and Vcw denote voltages across the series capacitor C1, Icmpu, Icmpv and Icmpw denote three-phase compensation currents, and IP and IQ denote the active current component and reactive current component that pass the transmission line.

FIG. 39 illustrates a case where when the phase of the AC power supply G oscillates at 12 Hz due to the vibration of the shaft of a power generator or the like, fluctuation suppressing control of this embodiment is deactivated at time t1 and is activated again at time t2.

As shown in FIG. 39, the transmission line current, the capacitor current and the active current and reactive current which pass the transmission line are all acting stably by the fluctuation suppressing control before time ti, but when the fluctuation suppressing signal is disabled at time t1, power fluctuation caused by a variation in the phase signal of the AC power supply G cause resonance with the LC resonance transmission line consisting of the transmission line impedance Xs and the series capacitor C1 and power fluctuation having a frequency of 12 Hz starts becoming larger.

When the fluctuation suppressing control of this embodiment is activated at time t2, power fluctuation is suppressed in about 100 msec and the operation returns to the stable operation.

It is known that in a case of a series capacitor which has a fixed degree of compensation, when the specific frequency of the power generator is superimposed on the LC resonance frequency that is given by the series capacitor C1 and the transmission line reactance, power fluctuation occurs, resulting in such a phenomenon that may damage the shaft of the power generator. FIG. 39 shows that even in such a case, the fluctuation suppressing control of this embodiment can permit a continuous stable operation without causing power fluctuation.

According to this embodiment, as described above, power fluctuation in an AC transmission line can be suppressed by detecting the transmission line current and transmission line voltage, calculating the active current component and reactive current component that pass the AC transmission line, and generating compensation current instructions based on variations in the active current component and reactive current component and the ratio of a change in transmission line current.

That is, the compensation current instructions based on variations in the active current component and reactive current component that pass the AC transmission line are supplied to the series capacitor C1 to become voltages which act in a direction to cancel out voltage variations that have caused the variations in the active current component and reactive current component.

Since the compensation current based on the ratio of a change in transmission line current has an effect of damping the fluctuation in the transmission line current, power fluctuation can be suppressed quickly.

Twentieth Embodiment

Figure 40:
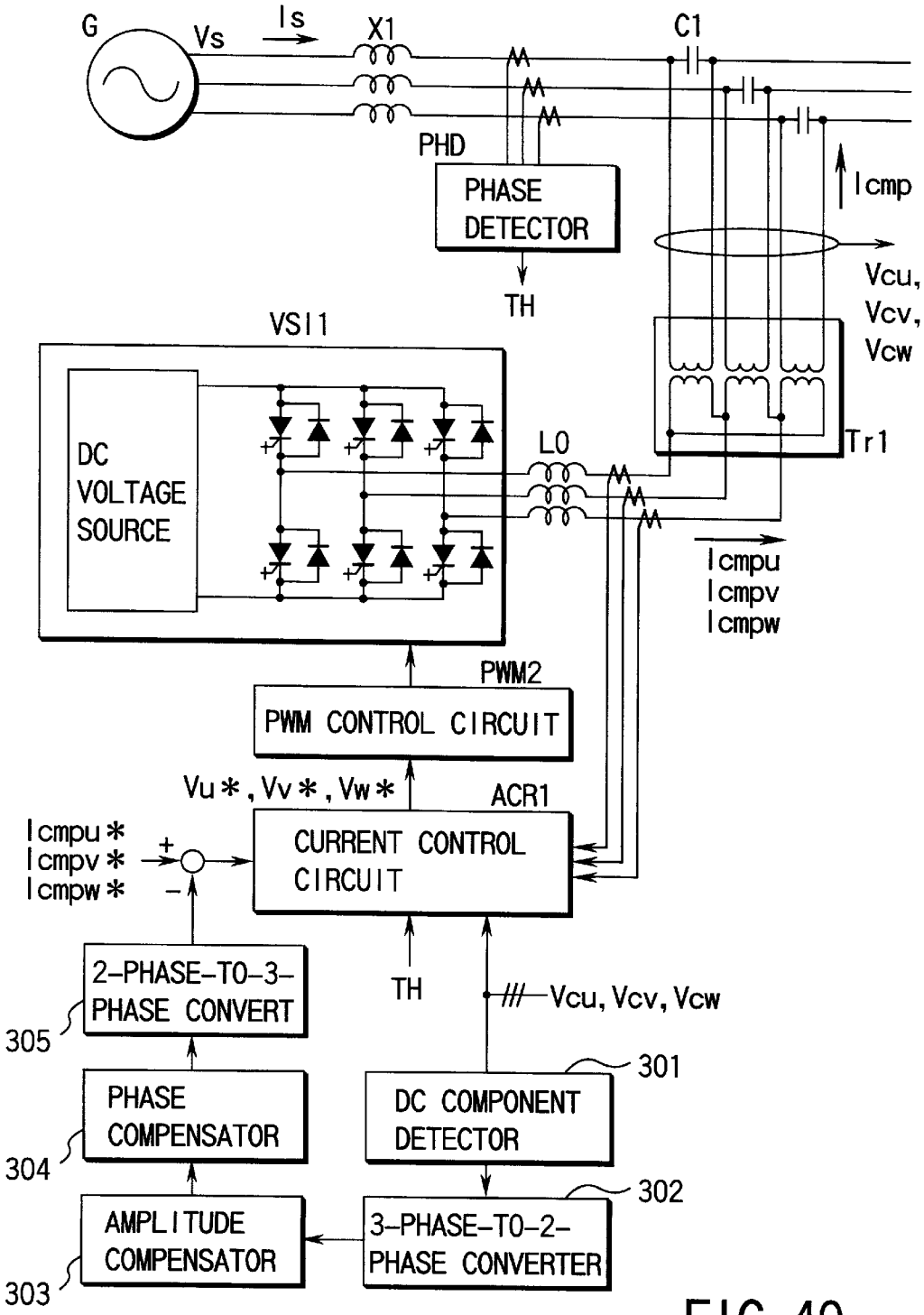
FIG. 40 is a block transmission line diagram illustrating a series compensator according to a twentieth embodiment of this invention.

FIG. 40 is a block transmission line diagram exemplifying the structure of a series compensator according to this embodiment, and same reference numerals as used for the components in each of the first to nineteenth embodiments are given to corresponding components of this series compensator.

As shown in FIG. 40, this embodiment is constructed in such a way that a DC component suppressing control device, which comprises a capacitor voltage detection transmission line for detecting a voltage across the capacitor C1 connected in series to an AC transmission line, a DC component calculation transmission line for calculating a DC voltage component of the series capacitor C1, and a DC component suppressing transmission line for generating a compensation current instruction based on a signal obtained by compensating the amplitude and phase of the output of the DC component calculation transmission line, is provided in each of the first to eighteenth embodiments.

According to the thus constituted series compensator of this embodiment, when a DC component is transiently superimposed on the transmission line current, a DC component appears in the voltage across the series capacitor C1 connected in series to the transmission line, which may cause a DC field deflection in the transformer or the like in the transmission line.

But, the DC component suppressing control device in the series compensator of this embodiment can suppress the DC component that appears in the series capacitor C1.

The series capacitor voltages Vcu, VcV and Vcw are input to a DC component detector 301, and a moving average process is carried out twice in the cycle of the transmission line frequency phase by phase.

This eliminates the transmission line frequency component contained in the voltage across the series capacitor C1 so that the DC component is detected.

The DC component for each phase is input to a 3-phase-to-2-phase converter 302 whose output is multiplied by a gain in an amplitude compensator 303, and the phase of the resultant component is advanced by 90 degrees $+\alpha$ in a phase compensator 304 and is then subjected to 2-phase-to-3-phase conversion in a 2-phase-to-3-phase converter 305. The resultant values for the individual phases are negatively fed back to compensation current instructions Icmpu*, Icmpv* and Icmpw* that are normally needed.

The reason why moving averaging is carried out twice in the DC component detector 301 is that single moving averaging cannot remove a transient change in the amplitude of the capacitor voltage if occurred, so that moving averaging is performed twice to eliminate the fluence of the transient amplitude variation.

The phase is advanced by 90 degrees $+\alpha$ in the phase compensator 304 in consideration of the generation of the compensation voltage originated from the compensation current across the series capacitor C1 at a phase delay of 90 degrees and the presence of a control delay.

When a DC component is produced, the compensation current which is proportional to the DC component and generates such a compensation voltage as to cancel out this DC component is supplied to the series capacitor C1, so that the DC component voltage is canceled out, thus suppressing the DC component.

According to this embodiment, as described above, a DC component of the voltage that is generated across the series capacitor C1 by the disturbance of the transmission line current can be suppressed quickly by causing the compensation current generator CMP1 to generate the compensation current for generating the voltage that cancels out the DC component by detecting the capacitor voltage in the capacitor voltage detection transmission line, computing the DC component of the voltage across the series capacitor C1 in the DC component calculation transmission line and correcting the amplitude and phase of the DC component of the voltage across the series capacitor C1. This makes it possible to avoid the DC field deflection in the transformer or the like.

Twenty-first Embodiment

Figure 41:
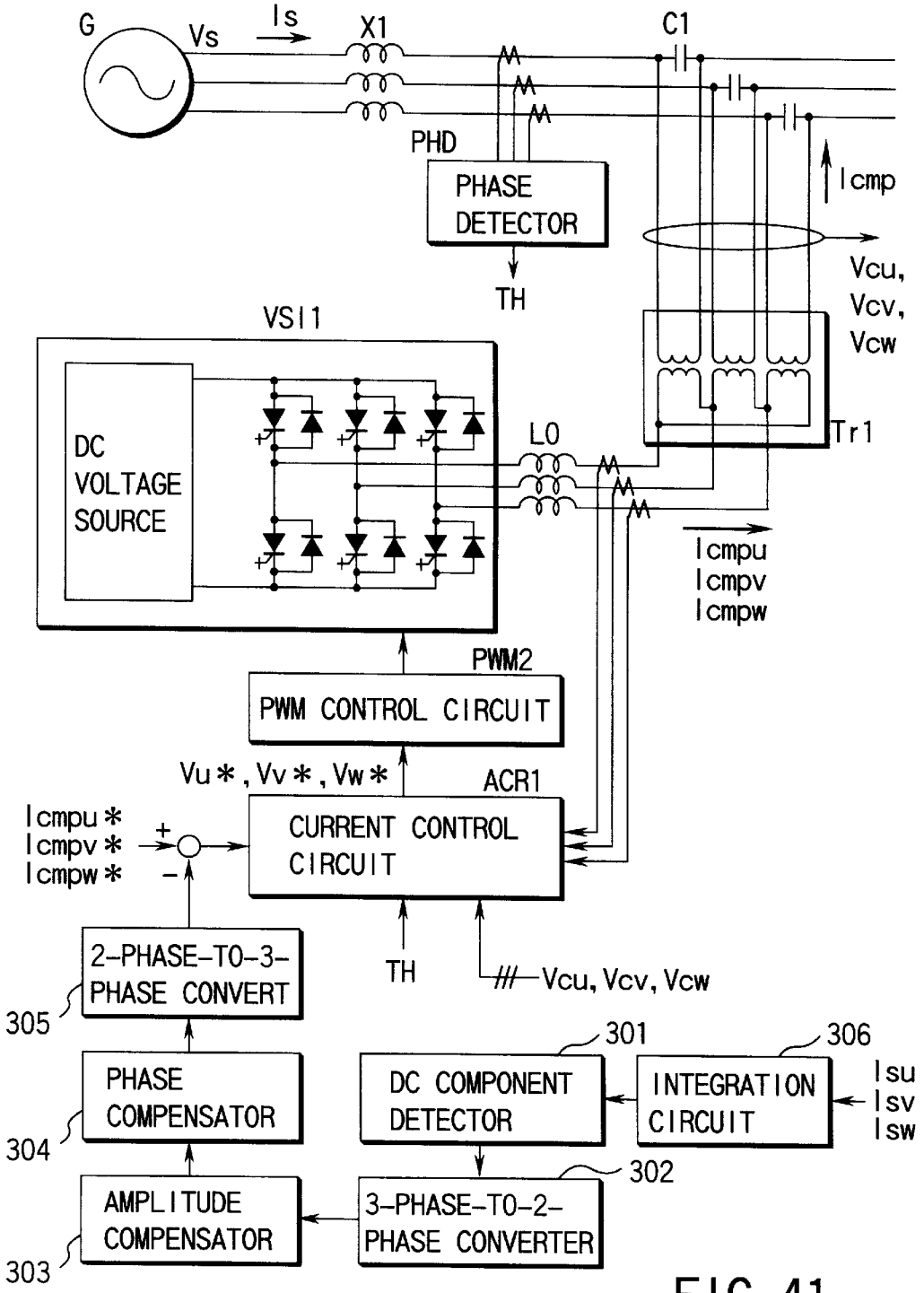
FIG. 41 is a block transmission line diagram illustrating a series compensator according to a twenty-first embodiment of this invention.

FIG. 41 is a block transmission line diagram exemplifying the structure of a series compensator according to this embodiment. The same reference numerals as used for the components in the twentieth embodiment are again used relative to corresponding components of this series compensator, and the following will discuss only the difference.

As shown in FIG. 41, this embodiment is constructed in such a way that the DC component of the series capacitor C1 is detected by using a value obtained by integrating the detected value of the transmission line current flowing in an AC transmission line by means of an integration transmission line 306, instead of directly using the voltage across the series capacitor C1 as done in the twentieth embodiment.

According to the thus constituted series compensator of this embodiment, because the basic factor of producing a DC component voltage in the voltage across the series capacitor C1 is the superimposition of the DC component in the transmission line, integrating the transmission line current can allow the DC component to be detected even by using an amount equivalent to the voltage across the series capacitor C1 and a transient DC component originated from the compensation current is not contained in the DC component detection signal. It is therefore possible to implement more stable DC component suppressing control.

According to this invention, as apparent from the above, the DC component produced in the series capacitor C1 by the transmission line current is calculated by integrating the transmission line current instead of detecting the DC component based on the voltage across the series capacitor C1, and the compensation current is generated from the compensation current generator CMP1 based on the computed DC component. This can ensure fast suppression of the DC component produced in the series capacitor C1 and make it possible to avoid the DC field deflection in the transformer or the like.

In this case, because the transient DC component caused by the compensation current is not involved in the calculation of the DC component, this embodiment can accomplish more stable DC component suppressing control than the twentieth embodiment.

Twenty-second Embodiment

Figure 42:
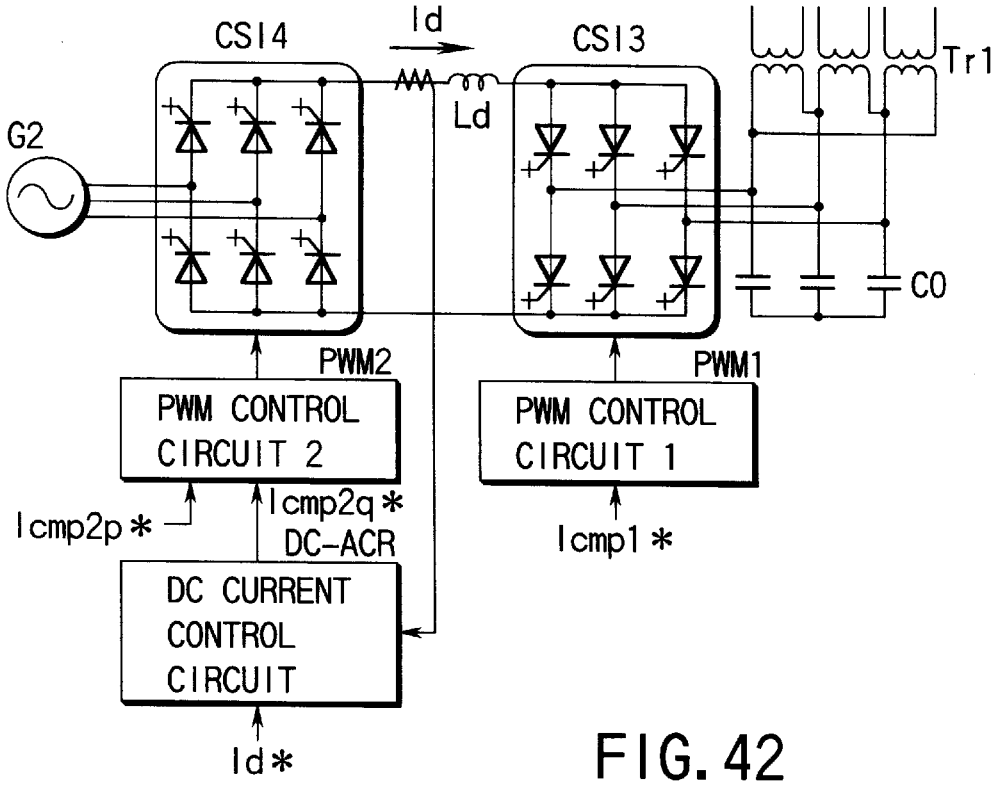
FIG. 42 is a block transmission line diagram illustrating a series compensator according to a twenty-second embodiment of this invention.

FIG. 42 is a block transmission line diagram exemplifying the structure of a series compensator according to this embodiment, and the same reference numerals as used for the components of each of the first to eleventh embodiments are again used relative to corresponding components of this series compensator.

According to this embodiment, as shown in FIG. 42, the compensation current generator CMP1 comprises a series transformer Tr1, a first current source converter CSI3, which has reverse blocking GTOs as switching elements connected in three-phase rectifier connection, a second current source converter CSI4, which is connected in parallel to an AC power supply G2 and has reverse blocking GTOs as switching elements connected in three-phase rectifier connection, a DC reactor Ld for connecting the DC portion of the first current source converter CSI3 and the DC portion of the second current source converter CSI4, and a DC current control transmission line DC-ACR which controls the current across the DC reactor Ld.

Provided between the current source converter CSI3 and the series transformer Tr1 is a harmonic filter C0 for eliminating a harmonic component produced by the current source converter CSI3.

Figure 43:
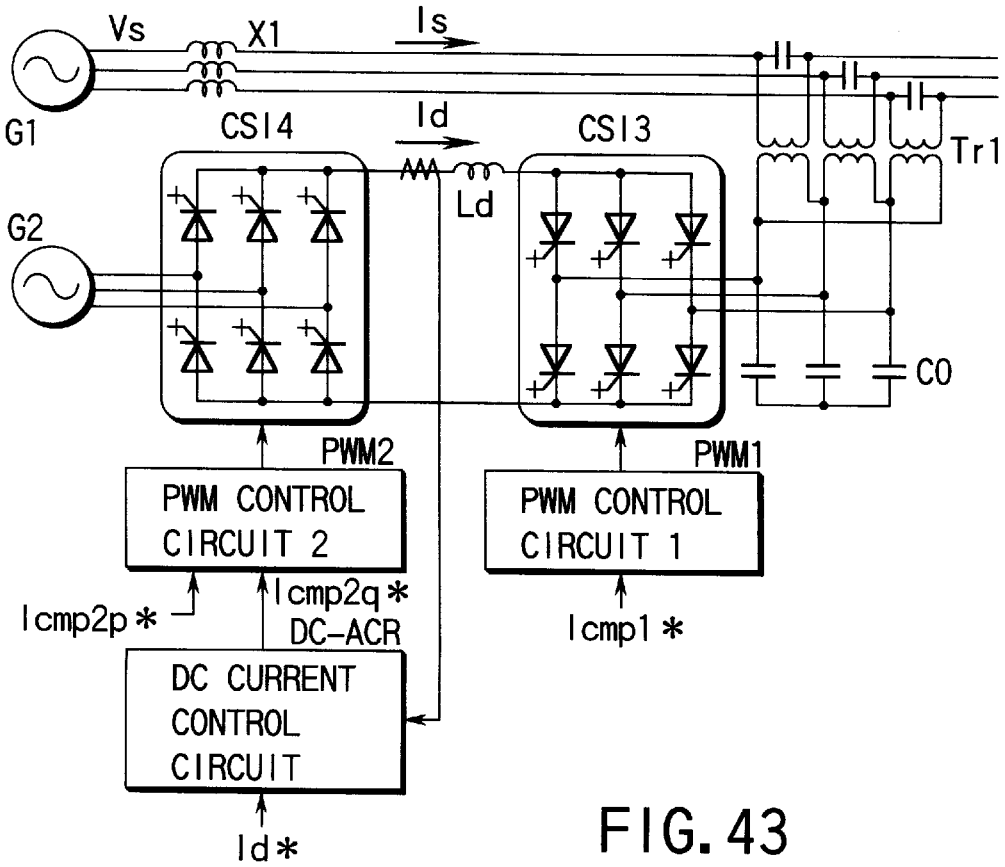
FIG. 43 is a block transmission line diagram showing a structural example in a case where a compensation current generator constituting the series compensator of the twenty-second embodiment is adapted to the first embodiment.

FIG. 43 is a block transmission line diagram showing a structural example in a case where the compensation current generator CMP1 constituting the series compensator of this embodiment is adapted to the first embodiment, and same reference numerals as used for the components in FIG. 3 are given to corresponding components of this series compensator.

According to the thus constituted series compensator of this embodiment, a compensation current instruction Icmp1* is input to a PWM control transmission line PWM1 which performs PWM modulation and generates such a switching pattern as to generate a current which becomes equal to the current instruction Icmp1*.

The current that is output from the first current source converter CSI3 has a PWM-modulated square waveform has its harmonic component eliminated by the harmonic filter C0, so that the current having a sine waveform is supplied to the secondary winding of the series transformer Tr1.

The compensation current is converted by the series transformer Tr1 in accordance with the number of turns, and the resultant current is supplied to the series capacitor C1, thereby generating a compensation current having a sine wave.

A DC link current Id from the DC portion is input to the DC current control transmission line DC-ACR which outputs a current instruction Icmp2q* for producing a DV voltage equal to a DC current instruction Id*.

The compensation current instruction Icmp2q* is input to the PWM control transmission line PWM2 to perform such control as to make the DC current of the second current source converter CSI4 become a target current amount.

At the same time, the output current Icmp2 of the second current source converter CSI4 is detected, the PWM control transmission line PWM2 outputs a current which becomes equal to a reactive power instruction Icmp2d*, and the second current source converter CSI4 controls the reactive power to be output to the AC power supply.

Although the foregoing description of this embodiment has been given with reference to the structure wherein a single current source converter connected in three-phase bridge rectifier connection is used as each of the first current source converter CSI3 and the second current source converter CSI4 for the sake of simpler description, a plurality of current source converters may be connected in a multiplexing form to achieve a large capacity.

Twenty-third Embodiment

Figure 44:
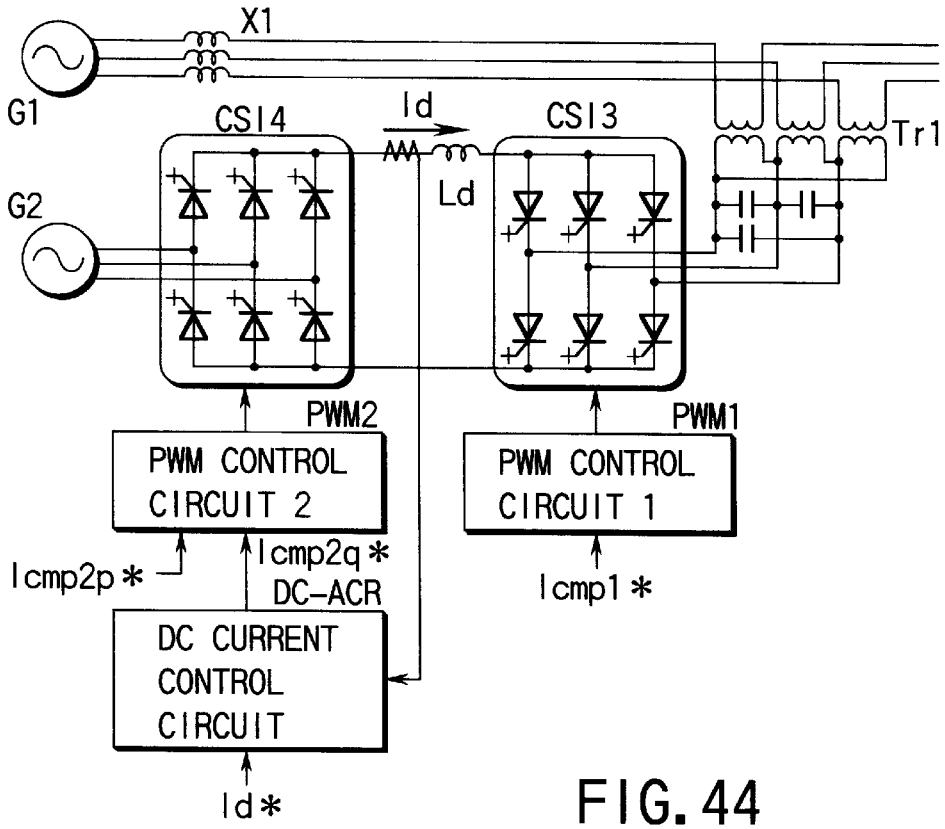
FIG. 44 is a block transmission line diagram showing one example of a series compensator according to a twenty-third embodiment of this invention.

FIG. 44 is a block transmission line diagram exemplifying the structure of a series compensator according to this embodiment, and the same reference numerals as used for the components in the fifth embodiment are again used relative to corresponding components of this series compensator.

According to this embodiment, as shown in FIG. 44, as a capacitor is provided on the low-voltage side of the series transformer Tr1, the compensation current generator CMP1 comprises a first current source converter CSI3, which has reverse blocking GTOs as switching elements connected in three-phase rectifier connection, a second current source converter CSI4, which is connected in parallel to an AC power supply G2 and has reverse blocking GTOs as switching elements connected in three-phase rectifier connection, a DC reactor Ld for connecting the DC portion of the first current source converter CSI3 and the DC portion of the second current source converter CSI4, and a DC current control transmission line DC-ACR which controls the current across the DC reactor Ld.

According to the thus constituted series compensator of this embodiment, the second current source converter CSI4 can control the reactive power of the AC transmission line to which the second current source converter CSI4 is connected.

The first current source converter CSI3 generates a current equal to the compensation instruction under PWM control and serves as a current source to supply the compensation current to the capacitor C21, so that various compensation voltages can be generated on the primary winding of the series transformer Tr1.

It is possible to omit a transformer in the compensation current generator CMP1 and also a harmonic filter because the capacitor C21, which is connected to the secondary winding of the series transformer Tr1 and generates the compensation voltage normally needed, serves as a filter.

Figure 45:
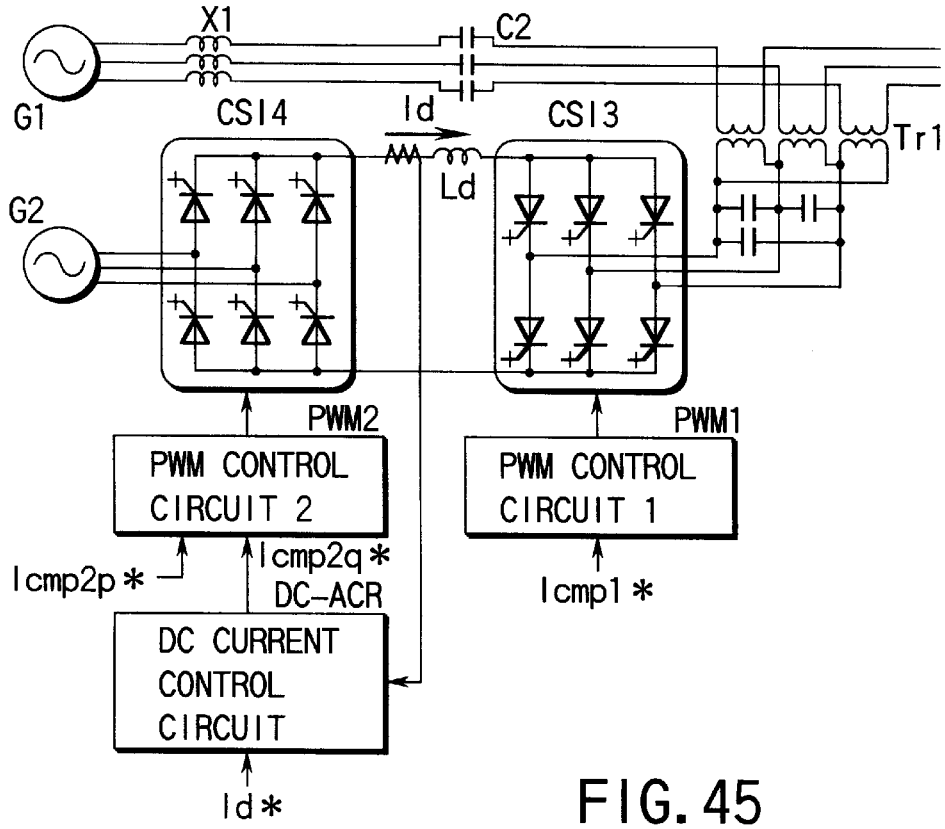
FIG. 45 is a block transmission line diagram showing another example of the series compensator according to the twenty-third embodiment of this invention.
Figure 46:
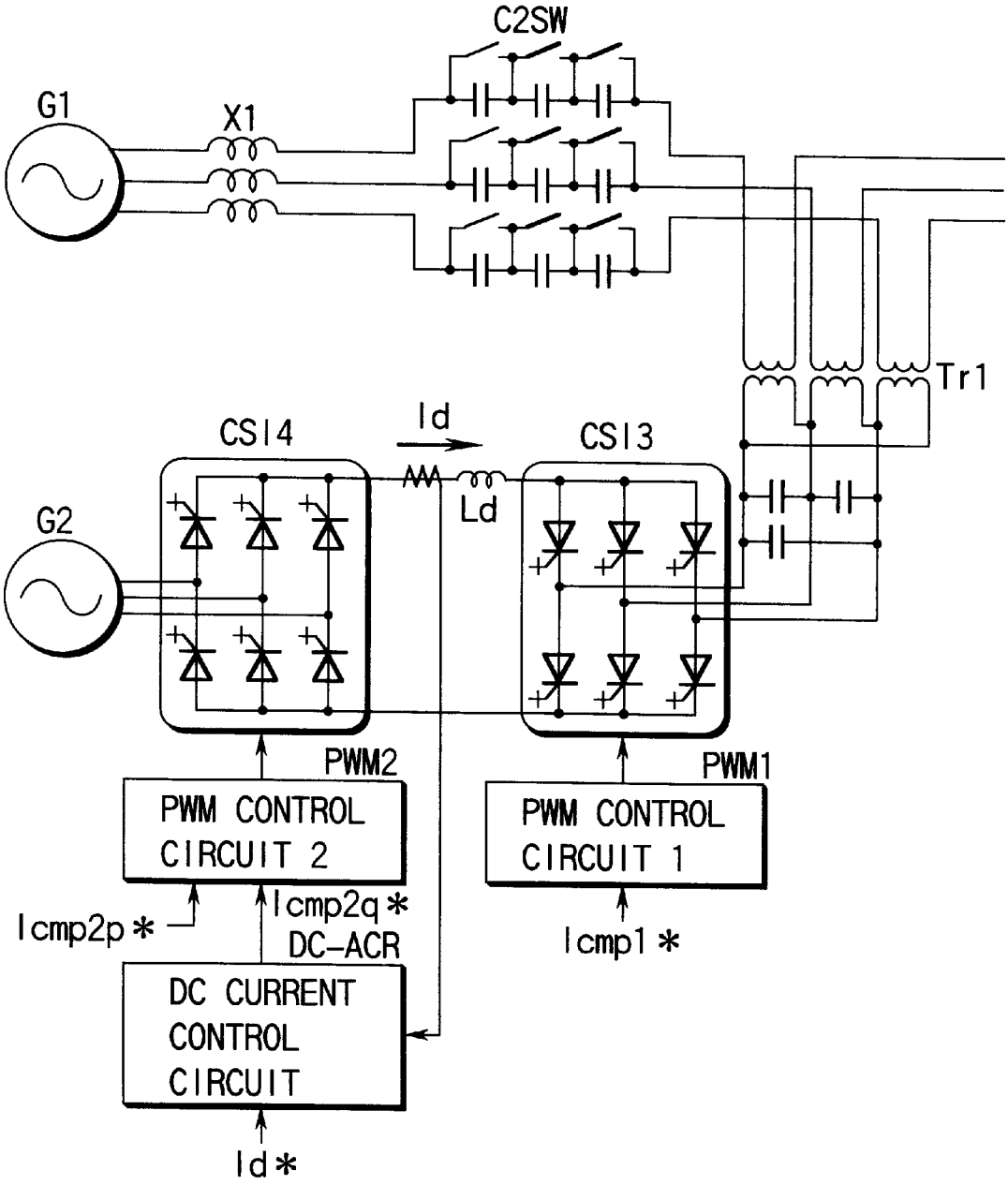
FIG. 46 is a block transmission line diagram showing a further example of the series compensator according to the twenty-third embodiment of this invention.
Figure 47:
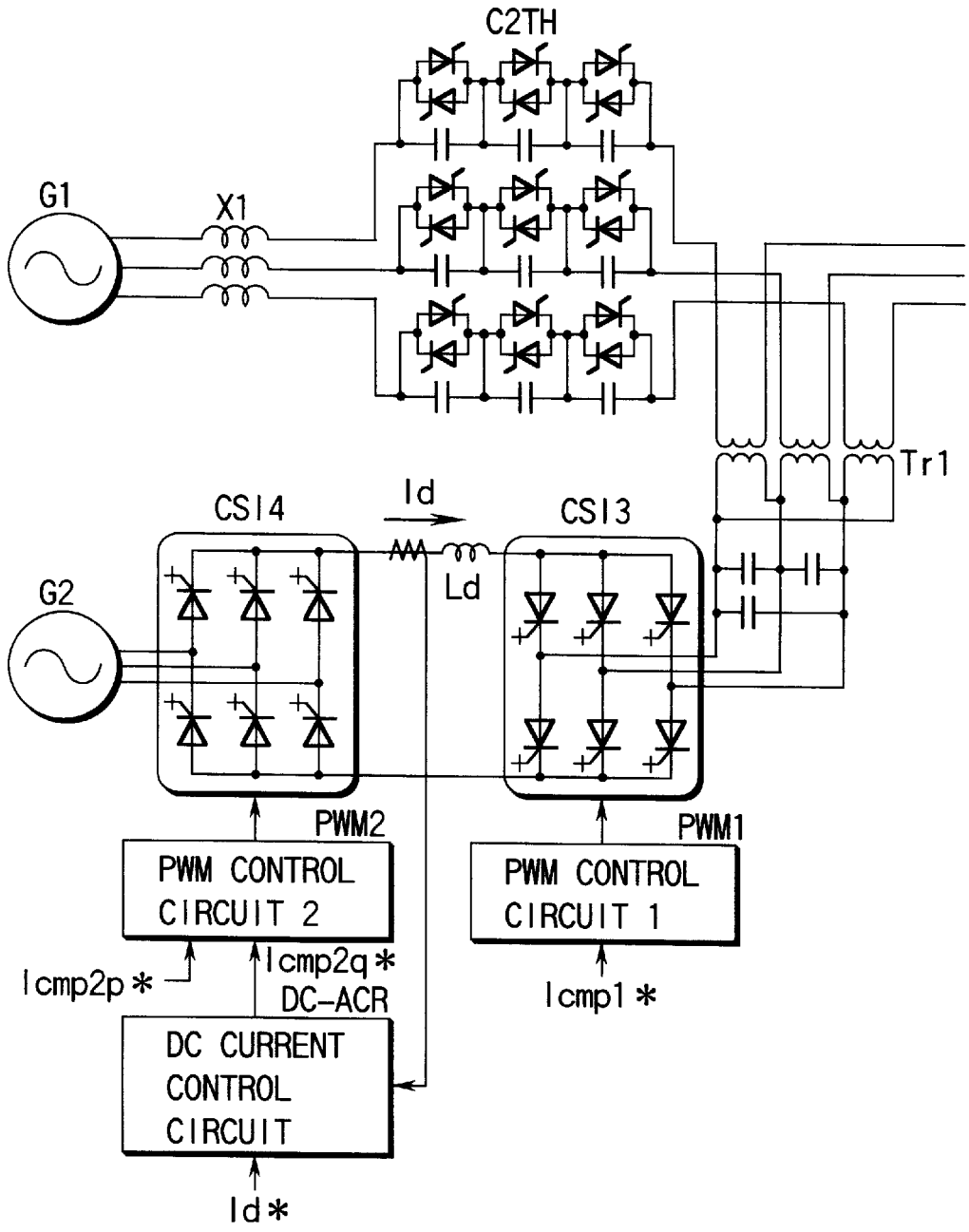
FIG. 47 is a block transmission line diagram showing a still further example of the series compensator according to the twenty-third embodiment of this invention.

FIGS. 45 to 47 are block transmission line diagrams exemplifying the structure of the series compensator according to this embodiment, and the same reference numerals as used for the components in the ninth to eleventh embodiments are again used relative to corresponding components of this series compensator.

According to this embodiment, as shown in FIGS. 45 to 47, as in the case of FIG. 44, a transformer and a harmonic filter are omitted from the compensation current generator CMP1 and the second current source converter CSI4 can control the reactive power of the AC transmission line to which the second current source converter CSI4 is connected.

The series compensator of this embodiment with the above-described structure basically can supply various compensation voltages to the transmission line through quite the same operation as has been discussed in the sections of the ninth to eleventh embodiments.

Twenty-fourth Embodiment

Figure 48:
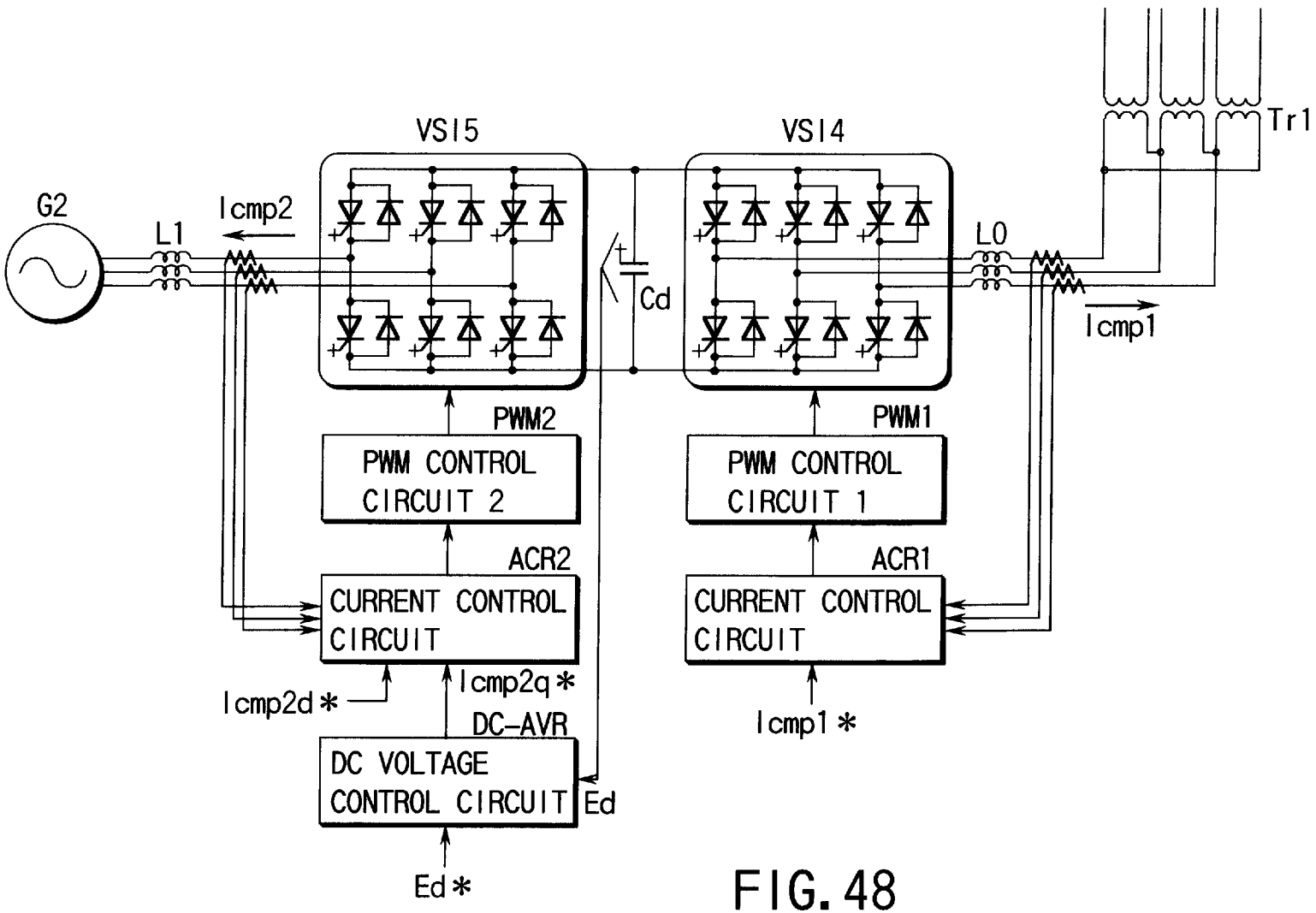
FIG. 48 is a block transmission line diagram illustrating a series compensator according to a twenty-fourth embodiment of this invention.

FIG. 48 is a block transmission line diagram exemplifying the structure of a series compensator according to this embodiment, and the same reference numerals as used for the components of each of the first to eleventh embodiments are again used relative to corresponding components of this series compensator.

According to this embodiment, as shown in FIG. 48, the compensation current generator CMP1 comprises a series transformer Tr1, a first voltage source converter VSI4, which has GTOs as switching elements connected in three-phase rectifier connection, a PWM control transmission line PWM1 for generating a switching pattern for each GTO of the first voltage source converter VSI4, a current control transmission line ACR1 for controlling the output current of the first voltage source converter VSI4, a link reactor L0, a second voltage source converter VSI5, which is connected in parallel to an AC power supply G2 and has GTOs as switching elements connected in three-phase rectifier connection, a PWM control transmission line PWM2 for generating a switching pattern for each GTO of the second voltage source converter VSI5, a current control transmission line ACR2 for controlling the output current of the second voltage source converter VSI5, a link reactor L1, a DC capacitor Cd for connecting the DC portion of the first voltage source converter VSI4 and the DC portion of the second voltage source converter VSI5, and a DC voltage control transmission line DC-AVR which controls the voltage across the DC capacitor Cd.

The link reactors L0 and L1 may be provided as independent reactors as in this embodiment, or may be achieved by designing the leak reactance of the transformer larger.

Figure 49:
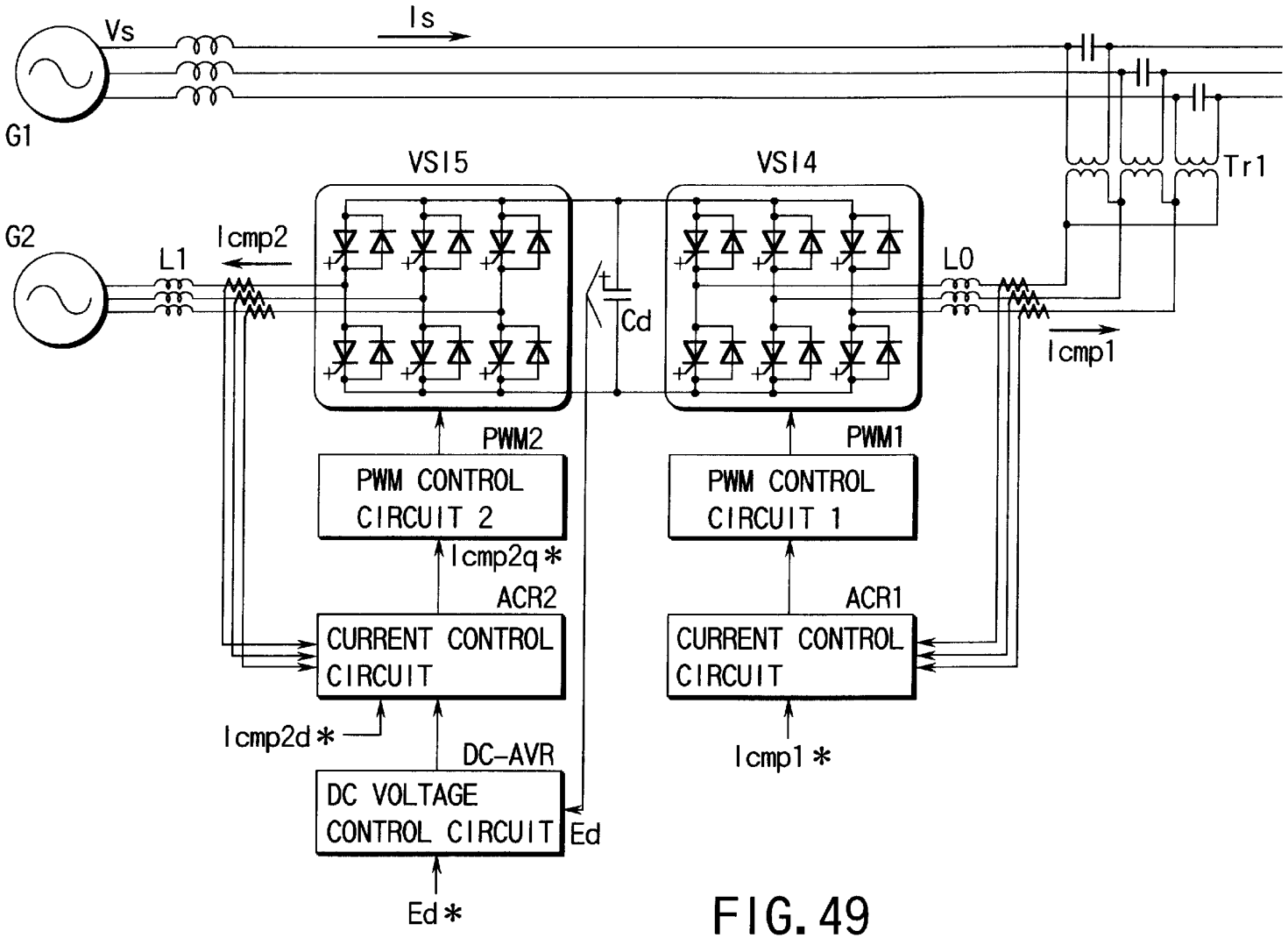
FIG. 49 is a block transmission line diagram showing a structural example in a case where a compensation current generator constituting the series compensator of the twenty-fourth embodiment is adapted to the first embodiment.

FIG. 49 is a block transmission line diagram showing a structural example in a case where the compensation current generator CMP1 constituting the series compensator of this embodiment is adapted to the first embodiment, and the same reference numerals as used for the components in FIG. 3 are again used relative to corresponding components of this series compensator.

Since the detailed structure of the current control transmission line ACR1 has been discussed in the foregoing description of the thirteenth embodiment, its description will not be repeated here.

According to the thus constituted series compensator of this embodiment, a DC capacitor voltage Ed from the DC portion is input to the DC voltage control transmission line DC-AVR which outputs a current instruction Icmp2q* for producing a DV voltage equal to a DC voltage instruction Ed*.

The compensation current instruction Icmp2q* is input to the PWM control transmission line PWM2 to perform such control as to make the DC voltage of the second voltage source converter VSI5 become a target voltage amount.

At the same time, the output current Icmp2 of the second voltage source converter VSI5 is detected, the PWM control transmission line PWM2 outputs a current which becomes equal to a reactive power instruction Icmp2d*, and the second voltage source converter VSI5 controls the reactive power to be output to the AC transmission line.

Although the foregoing description of this embodiment has been given with reference to the structure wherein a single voltage source converter connected in three-phase bridge rectifier connection is used as each of the first voltage source converter VSI4 and the second voltage source converter VSI5 for the sake of simpler description, a plurality of voltage source converters may be connected in a multiplexing form to achieve a large capacity.

Twenty-fifth Embodiment

Figure 50:
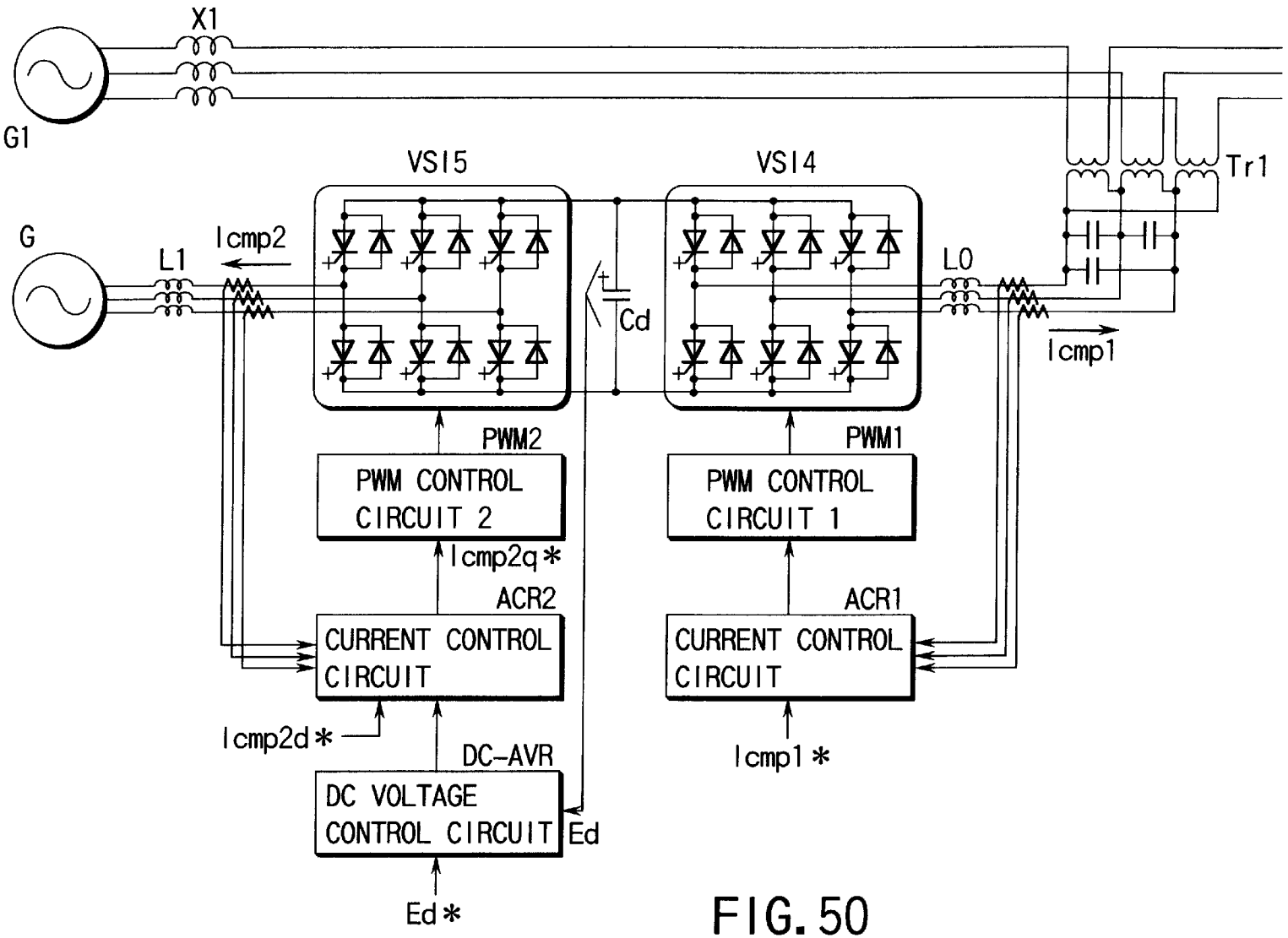
FIG. 50 is a block transmission line diagram showing one example of a series compensator according to a twenty-fifth embodiment of this invention.

FIG. 50 is a block transmission line diagram exemplifying the structure of a series compensator according to this embodiment, and the same reference numerals as used for the components in the fifth embodiment are again used relative to corresponding components of this series compensator.

According to this embodiment, as shown in FIG. 50, because a capacitor is provided on the low-voltage side of the series transformer Tr1, the compensation current generator CMP1 comprises a first voltage source converter VSI4 equipped with a first output current control capability, a second voltage source converter VSI5 equipped with a second output current control capability, and a DC capacitor Cd for connecting the DC portion of the first voltage source converter VSI4 and the DC portion of the voltage current source converter VSI5.

According to the thus constituted series compensator of this embodiment, as the first voltage source converter VSI4 generates a current equal to the compensation current instruction through current control and serves as a current source to supply the compensation current to the capacitor C21, various compensation voltages can be generated on the primary winding of the series transformer Tr1.

The second voltage source converter VSI5 controls the voltage across the DC capacitor Cd to adjust the active power which is input to and output from the first voltage source converter VSI4.

At the same time, the second voltage source converter VSI5 can control the reactive power of the AC power supply G to which the second voltage source converter VSI5 is connected.

It is possible to omit a transformer in the compensation current generator CMP1.

Figure 51:
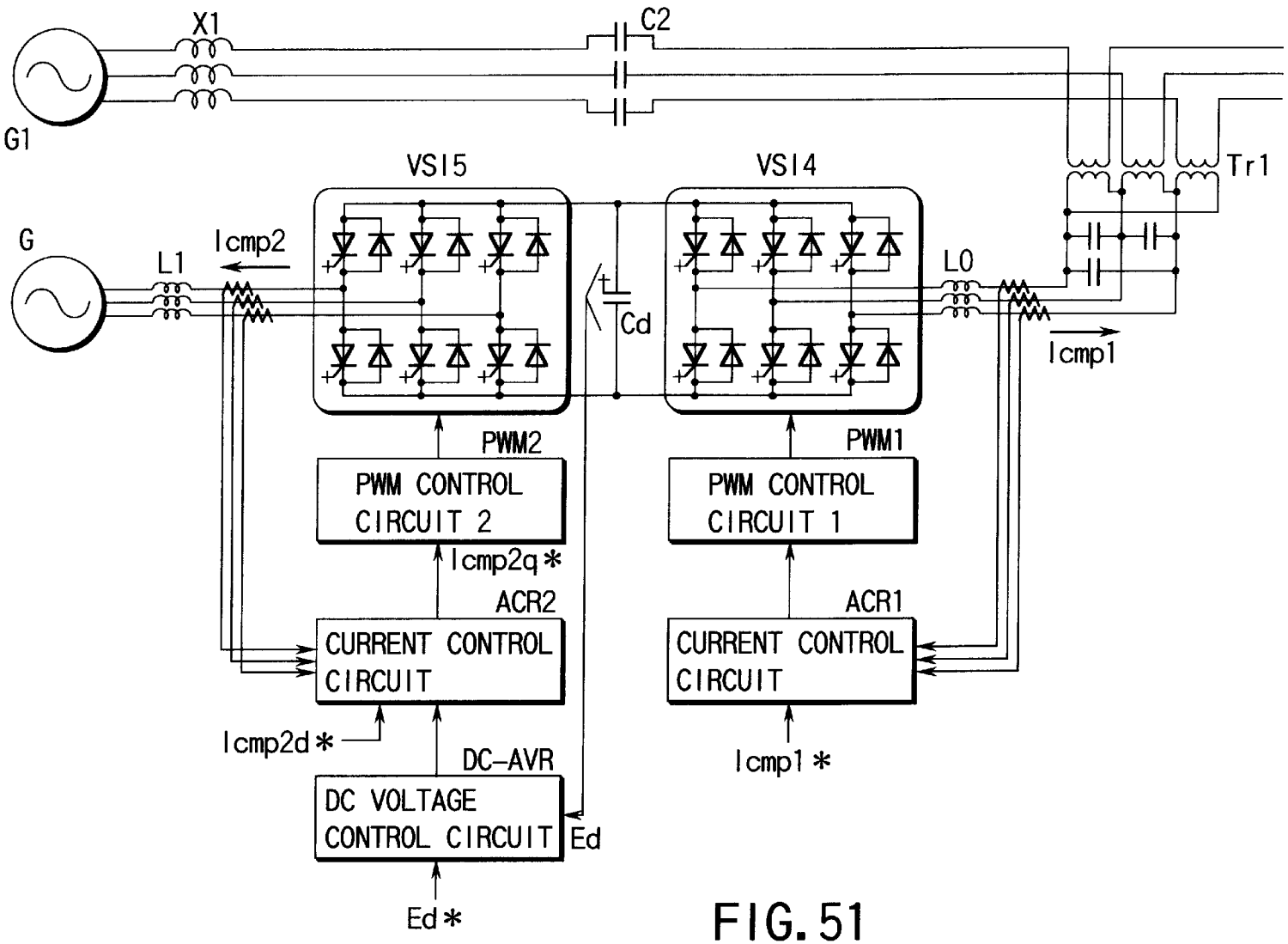
FIG. 51 is a block transmission line diagram showing another example of the series compensator according to the twenty-fifth embodiment of this invention.
Figure 52:
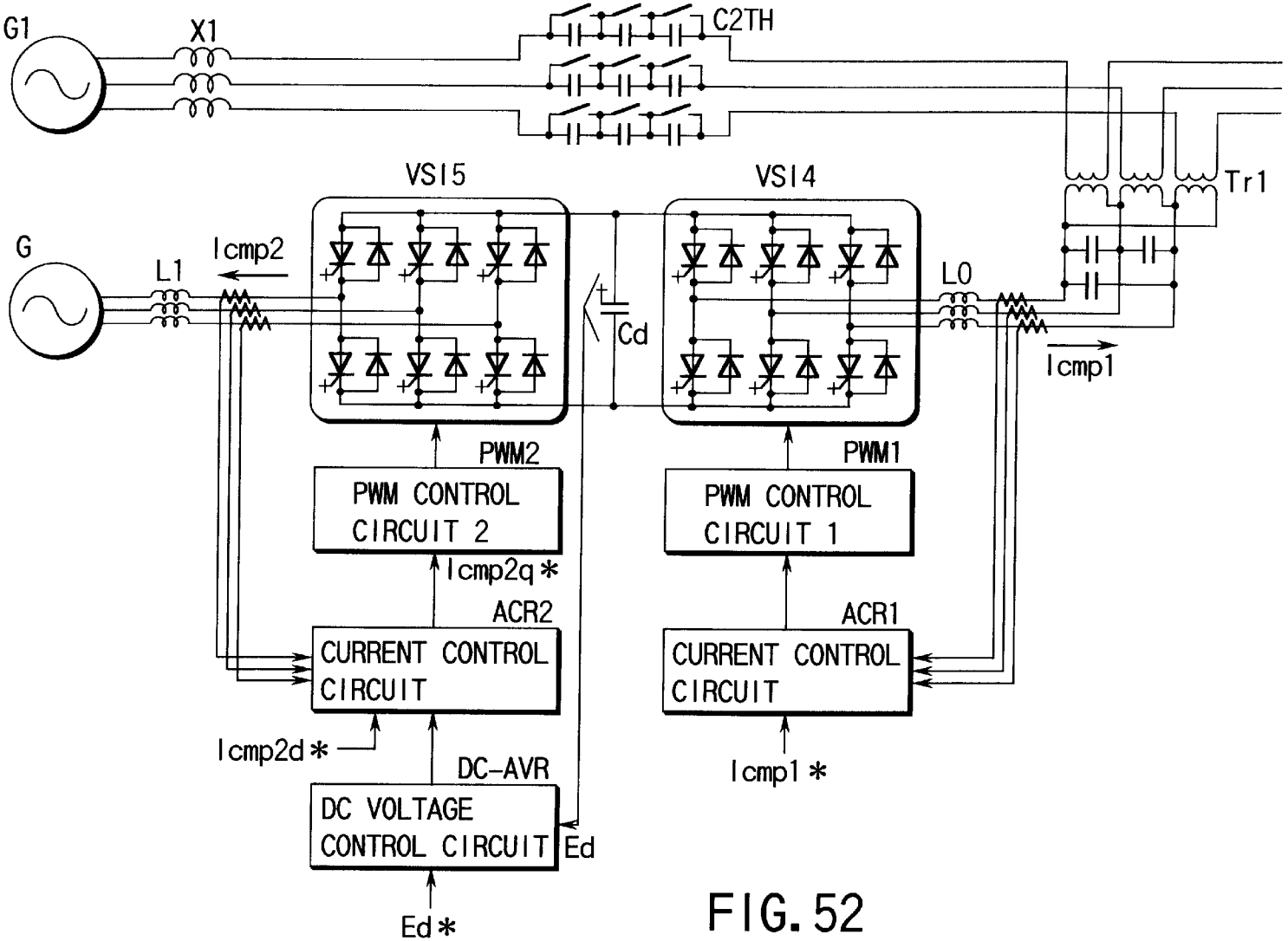
FIG. 52 is a block transmission line diagram showing a further example of the series compensator according to the twenty-fifth embodiment of this invention.
Figure 53:
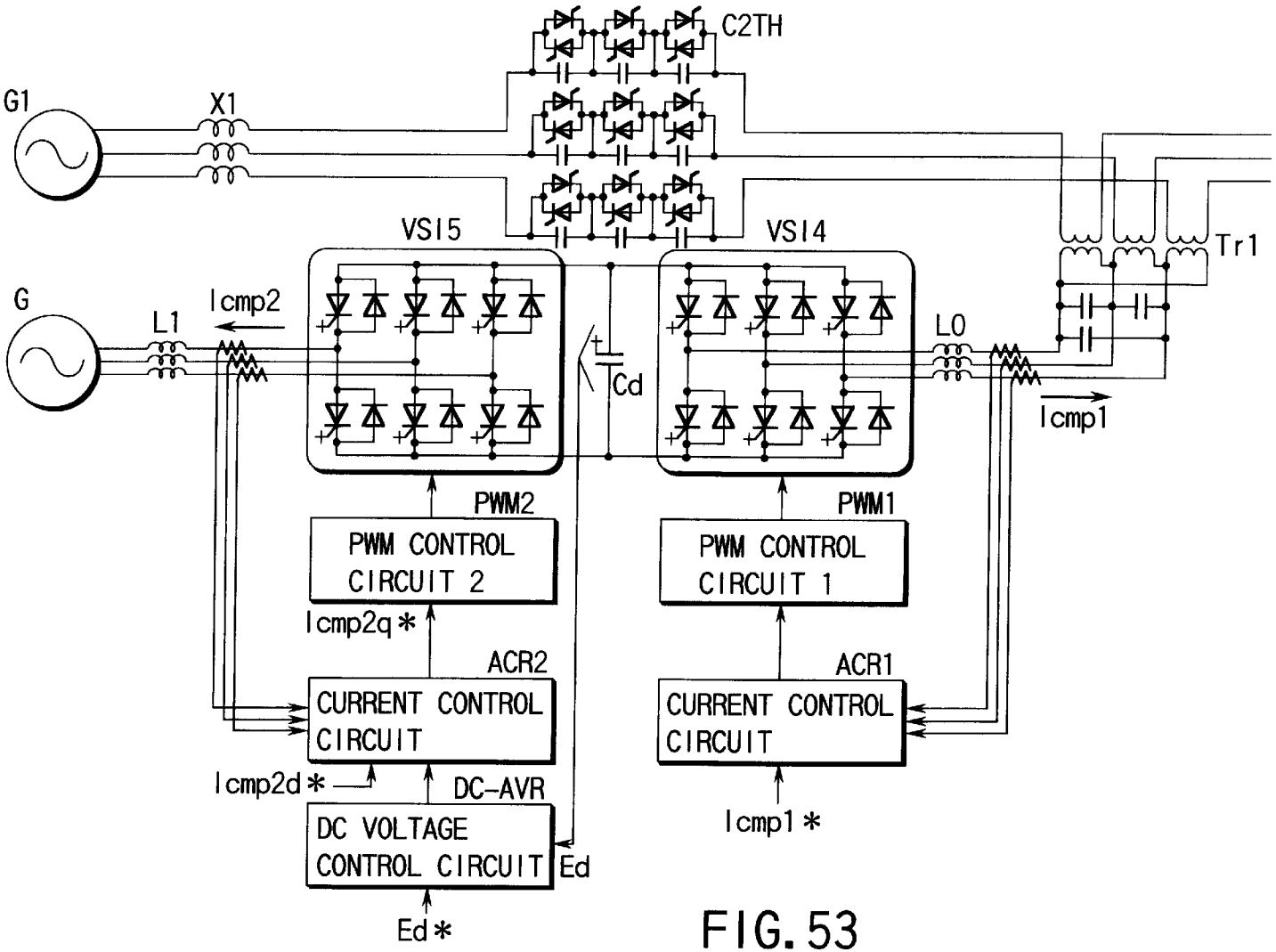
FIG. 53 is a block transmission line diagram showing a still further example of the series compensator according to the twenty-fifth embodiment of this invention.

FIGS. 51 to 53 are block transmission line diagrams exemplifying the structure of the series compensator according to this embodiment, and the same reference numerals as used for the components in the ninth to eleventh embodiments are again used relative to corresponding components of this series compensator.

According to this embodiment, as shown in FIGS. 51 to 53, as in the case of FIG. 50, a transformer is omitted from the compensation current generator CMP1.

The series compensator of this embodiment with the above-described structure basically can supply various compensation voltages to the transmission line through quite the same operation as has been discussed in the sections of the ninth to eleventh embodiments.

Twenty-sixth Embodiment

Figure 54:
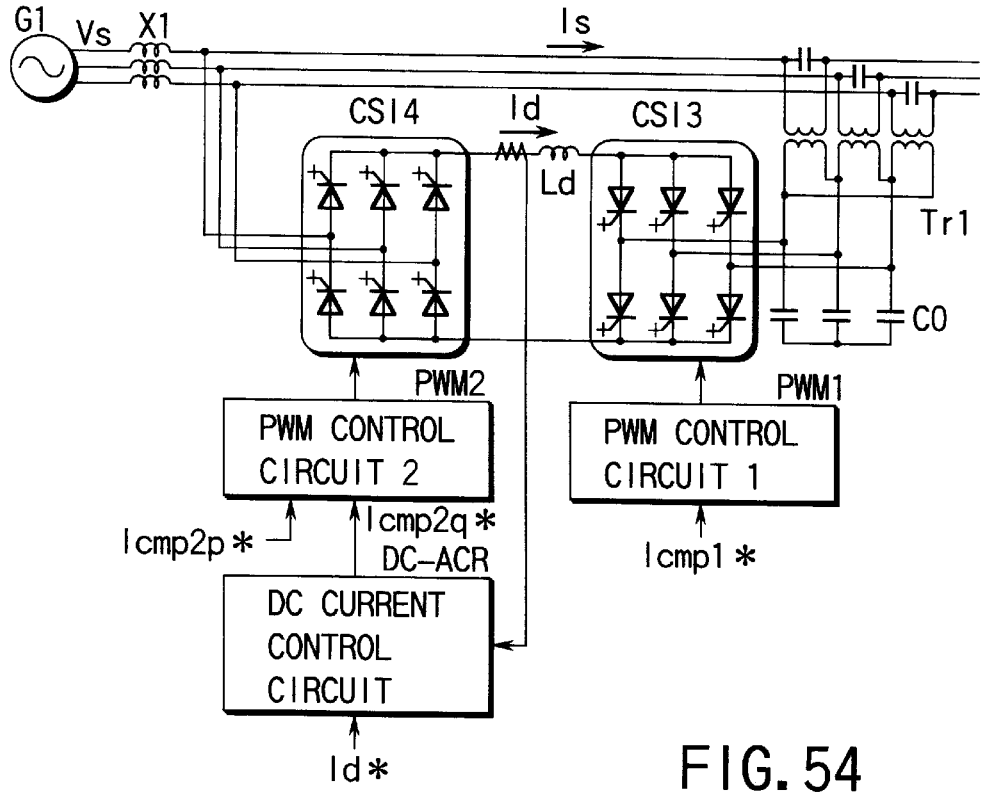
FIG. 54 is a block transmission line diagram illustrating a series compensator according to a twenty-sixth embodiment of this invention.

FIG. 54 is a block transmission line diagram exemplifying the structure of a series compensator according to this embodiment, and the same reference numerals as used for the components in the twenty-second or twenty-third embodiment are again used relative to corresponding components of this series compensator.

According to this embodiment, as shown in FIG. 54, an AC power supply to which the second current source converter CSI4 is connected in parallel is connected to an AC power supply to which the first current source converter CSI3 is connected in series or to the same AC power supply to which the first current source converter CSI3 output a current.

The series compensator of this embodiment with the above-described structure basically can supply various compensation voltages to the transmission line and at the same time can control the reactive power by carrying out quite the same operation as has been discussed in the section of the twenty-second or twenty-third embodiment.

Twenty-seventh Embodiment

Figure 55:
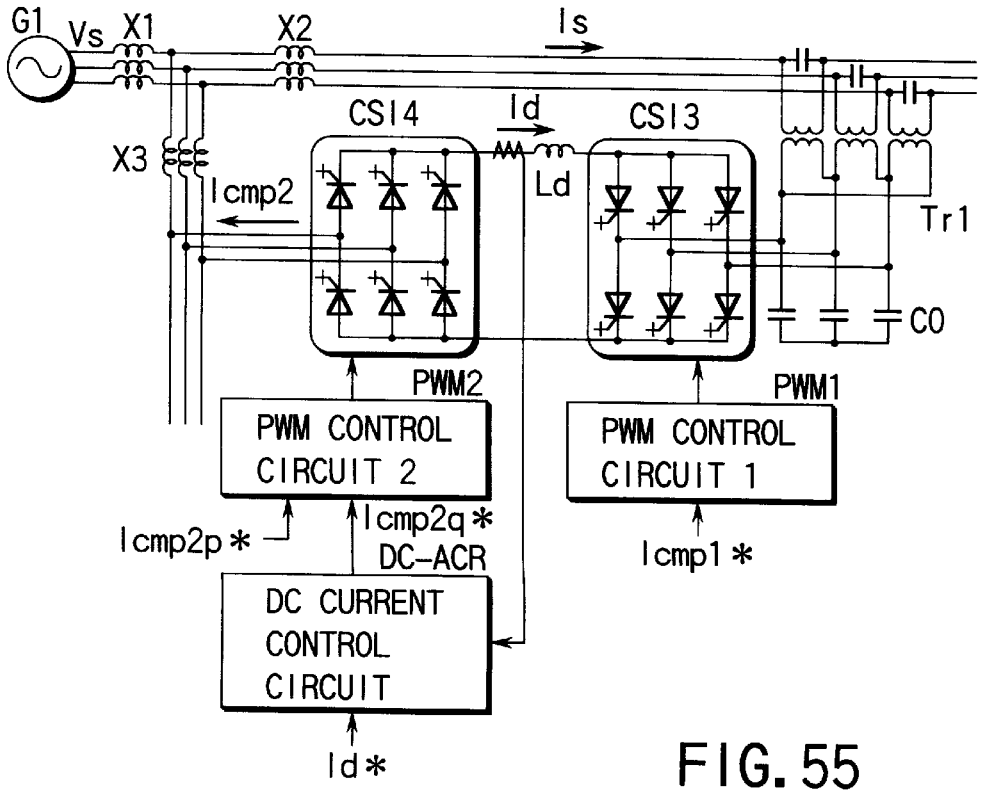
FIG. 55 is a block transmission line diagram illustrating a series compensator according to a twenty-seventh embodiment of this invention.

FIG. 55 is a block transmission line diagram exemplifying the structure of a series compensator according to this embodiment, and the same reference numerals as used for the components in the twenty-second or twenty-third embodiment are again used relative to corresponding components of this series compensator.

According to this embodiment, as shown in FIG. 55, an AC power supply to which the second current source converter CSI4 is connected in parallel is connected to an AC power supply to which the first current source converter CSI3 is connected in series or which is parallel to an AC power supply to which the first current source converter CSI3 output a current.

The series compensator of this embodiment with the above-described structure can perform the same operation as has been discussed above relative to the twenty-second or twenty-third embodiment, so that the first current source converter CSI3 supplies various compensation voltages to the AC power supply to which the first current source converter CSI3 is connected while the second current source converter CSI4 adjusts the DC current and controls the reactive power of the AC power supply to which the second current source converter CSI4 is connected.

According to this embodiment, as apparent from the above, the first current source converter CSI3 and the second current source converter CSI4 are provided in different power transmission lines, so that even if large power fluctuation occurs in the AC power supply to which the first current source converter CSI3 is connected, the second current source converter CSI4 is normal and can provide a reliable DC current. Accordingly, the first current source converter CSI3 can supply various compensation voltages to the transmission line and can enhance the transmission line fluctuation suppressing effect as compared with the case where the first and second current source converters are connected to the same power supply current.

Twenty-eighth Embodiment

Figure 56:
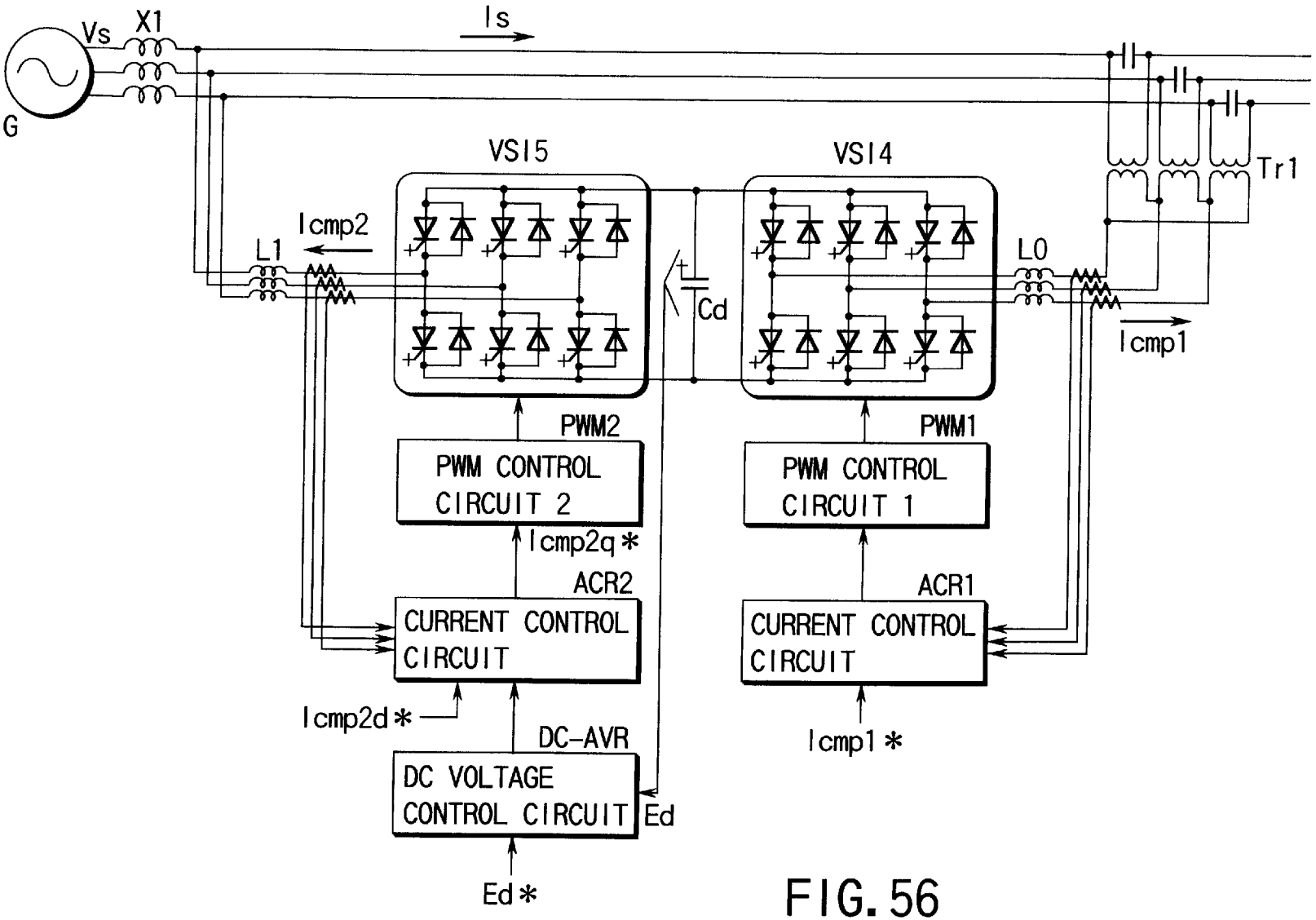
FIG. 56 is a block transmission line diagram illustrating a series compensator according to a twenty-eighth embodiment of this invention.

FIG. 56 is a block transmission line diagram exemplifying the structure of a series compensator according to this embodiment, and the same reference numerals as used for the components in the twenty-fourth or twenty-fifth embodiment are again used relative to corresponding components of this series compensator.

According to this embodiment, as shown in FIG. 56, an AC power supply to which the second voltage source converter VSI5 is connected in parallel is connected to an AC power supply to which the first voltage source converter VSI4 is connected in series or to the same AC power supply to which the first voltage source converter VSI4 output a current.

The series compensator of this embodiment with the above-described structure can supply various compensation voltages to the transmission line through the same operation as has been discussed above relative to the twenty-fourth or twenty-fifth embodiment, and at the same time can control the reactive power.

Twenty-ninth Embodiment

Figure 57:
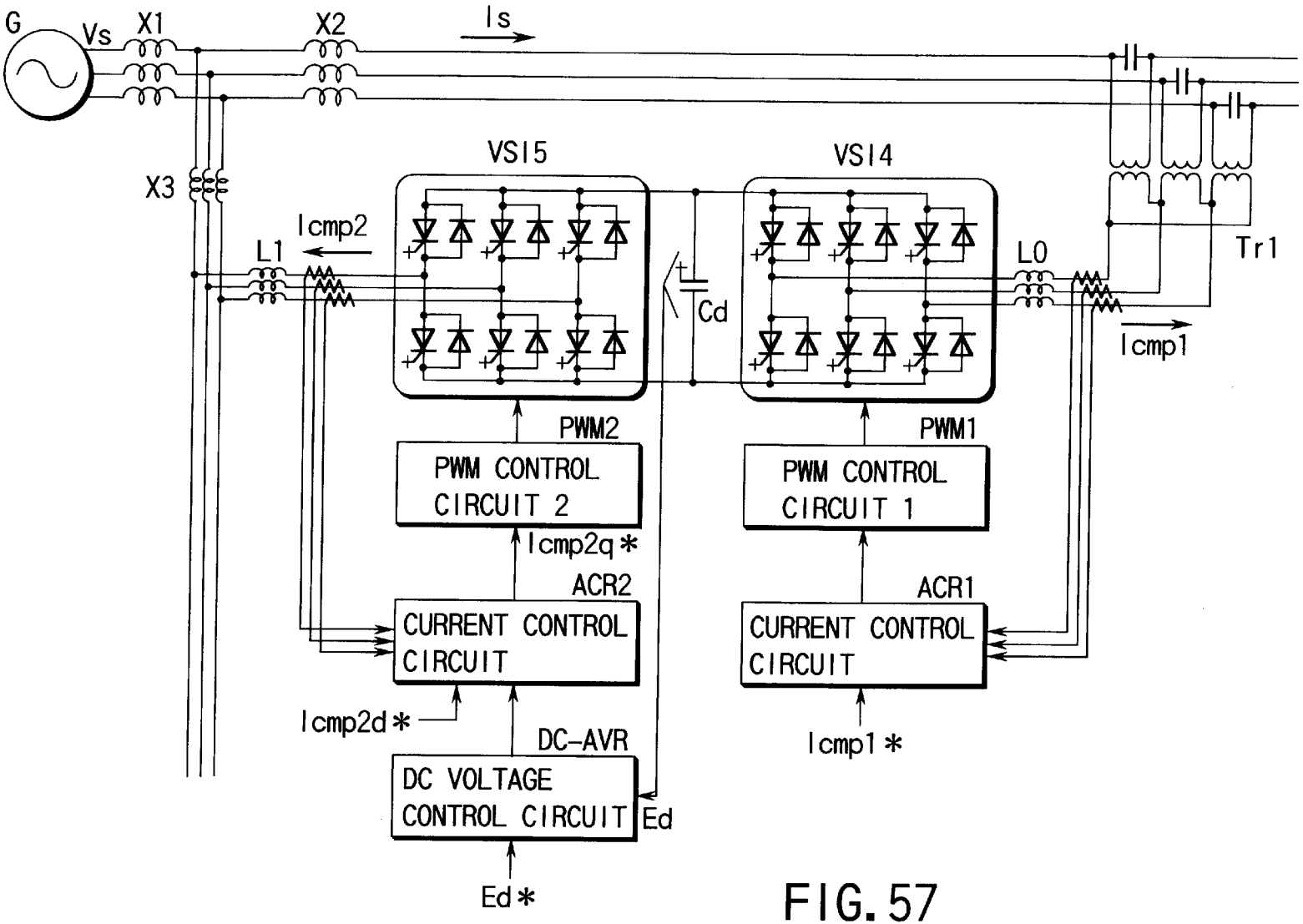
FIG. 57 is a block transmission line diagram illustrating a series compensator according to a twenty-ninth embodiment of this invention.

FIG. 57 is a block transmission line diagram exemplifying the structure of a series compensator according to this embodiment, and the same reference numerals as used for the components in the twenty-fourth or twenty-fifth embodiment are again used relative to corresponding components of this series compensator.

According to this embodiment, as shown in FIG. 57, an AC power supply to which the second voltage source converter VSI5 is connected in parallel is connected to an AC power supply to which the first voltage source converter VSI4 is connected in series or which is parallel to an AC power supply to which the first voltage source converter VSI4 output a current.

The series compensator of this embodiment with the above-described structure can perform the same operation as has been discussed in the section of the twenty-fourth or twenty-fifth embodiment, so that the first voltage source converter VSI4 supplies various compensation voltages to the AC power supply to which the first voltage source converter VSI4 is connected while the second voltage source converter VSI5 adjusts the DC voltage and controls the reactive power of the AC power supply to which the second voltage source converter VSI5 is connected.

According to this embodiment, as apparent from the above, the first voltage source converter VSI4 and the second voltage source converter VSI5 are provided in different power transmission lines, so that even if large power fluctuation occurs in the AC power supply to which the first voltage source converter VSI4 is connected, the second voltage source converter VSI5 is normal and can provide a reliable DC voltage.

Accordingly, the first voltage source converter VSI4 can supply various compensation voltages to the transmission line and can enhance the transmission line fluctuation suppressing effect as compared with the case where the first and second voltage source converters are connected to the same power supply current.

Thirtieth Embodiment

Figure 58:
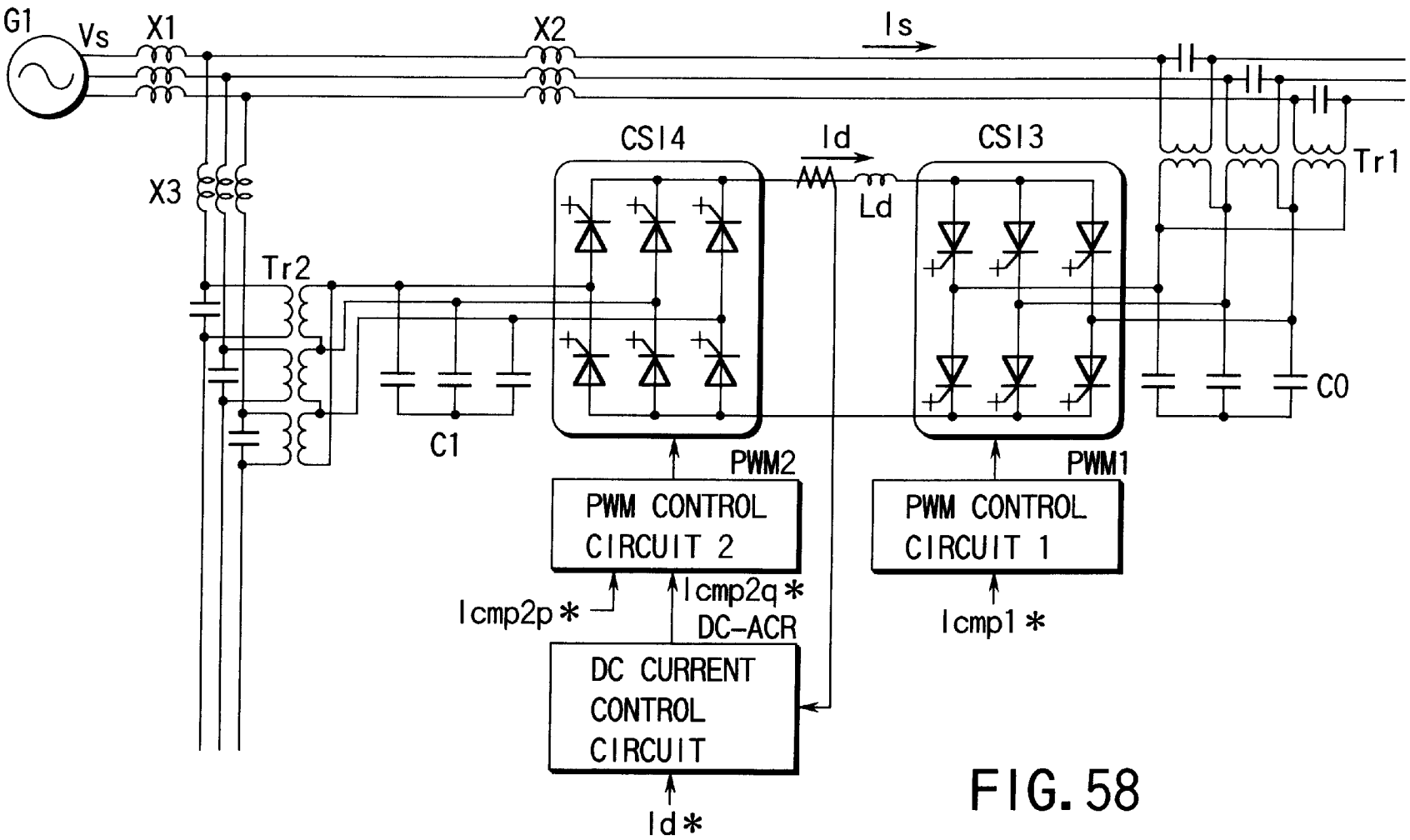
FIG. 58 is a block transmission line diagram illustrating a series compensator according to a thirtieth embodiment of this invention.

FIG. 58 is a block transmission line diagram exemplifying the structure of a series compensator according to this embodiment, and the same reference numerals as used for the components of each of the first to eleventh embodiments are again used relative to corresponding components of this series compensator.

According to this embodiment, as shown in FIG. 58, the compensation current generator CMP1 comprises a series transformer Tr1, a first current source converter CSI3, which has reverse blocking GTOs as switching elements connected in three-phase rectifier connection, a series capacitor C1 connected in series to an AC power supply different from the one to which the first current source converter CSI3 is connected, a series transformer Tr2 connected in parallel to the series capacitor C1, a second current source converter CSI4, which has reverse blocking GTOs as switching elements connected in three-phase rectifier connection, a DC reactor Ld for connecting the DC portion of the first current source converter CSI3 and the DC portion of the second current source converter CSI4, and a DC current control transmission line DC-ACR which controls the current across the DC reactor Ld.

Provided between the first current source converter CSI3 and the series transformer Tr1 is a harmonic filter C0 for eliminating a harmonic component produced by the first current source converter CSI3. Likewise provided between the second current source converter CSI4 and the series transformer Tr2 is a harmonic filter C2 for eliminating a harmonic component produced by the second current source converter CSI4.

According to the thus constituted series compensator of this embodiment, a compensation current instruction Icmp1* is input to a PWM control transmission line PWM1 which performs PWM modulation and generates such a switching pattern as to generate a current which becomes equal to the current instruction Icmp1*.

The current that is output from the first current source converter CSI3 has a PWM-modulated square waveform has its harmonic component eliminated by the harmonic filter C0, so that the current having a sine waveform is supplied to the secondary winding of the series transformer Tr1.

The compensation current is converted by the series transformer Tr1 in accordance with the number of turns, and the resultant current is supplied to the series capacitor C1, thereby generating a compensation current having a sine wave.

A DC link current Id from the DC portion is input to the DC current control transmission line DC-ACR which outputs a current instruction Icmp2q* for producing a DV voltage equal to a DC current instruction Id*.

The compensation current instruction Icmp2q* is input to the PWM control transmission line PWM2 to control the DC current of the second current source converter CSI4 to a target current amount.

At the same time, the output current Icmp2 of the second current source converter CSI4 is detected, the PWM control transmission line PWM2 outputs a current which becomes equal to a current instruction Icmp2d* having the same phase as or the opposite phase to the phase of the transmission line current, and the second current source converter CSI4 controls the current to be output to the AC power supply.

Accordingly, series compensation can be performed simultaneously with the AC power supply to which the first current source converter CSI3 is connected and the AC power supply to which the second current source converter CSI4 is connected.

Even if large power fluctuation occurs in the AC power supply to which the first current source converter CSI3 is connected, the second current source converter CSI4 is normal and can provide a reliable DC current.

Accordingly, the first current source converter CSI3 can supply various compensation voltages to the transmission line and can suppress the transmission line fluctuation.

Although the foregoing description of this embodiment has been given with reference to the structure wherein a single current source converter connected in three-phase bridge rectifier connection is used as each of the first current source converter CSI3 and the second current source converter CSI4 for the sake of simpler description, a plurality of current source converters may be connected in a multiplexing form to achieve a large capacity.

Thirty-first Embodiment

Figure 59:
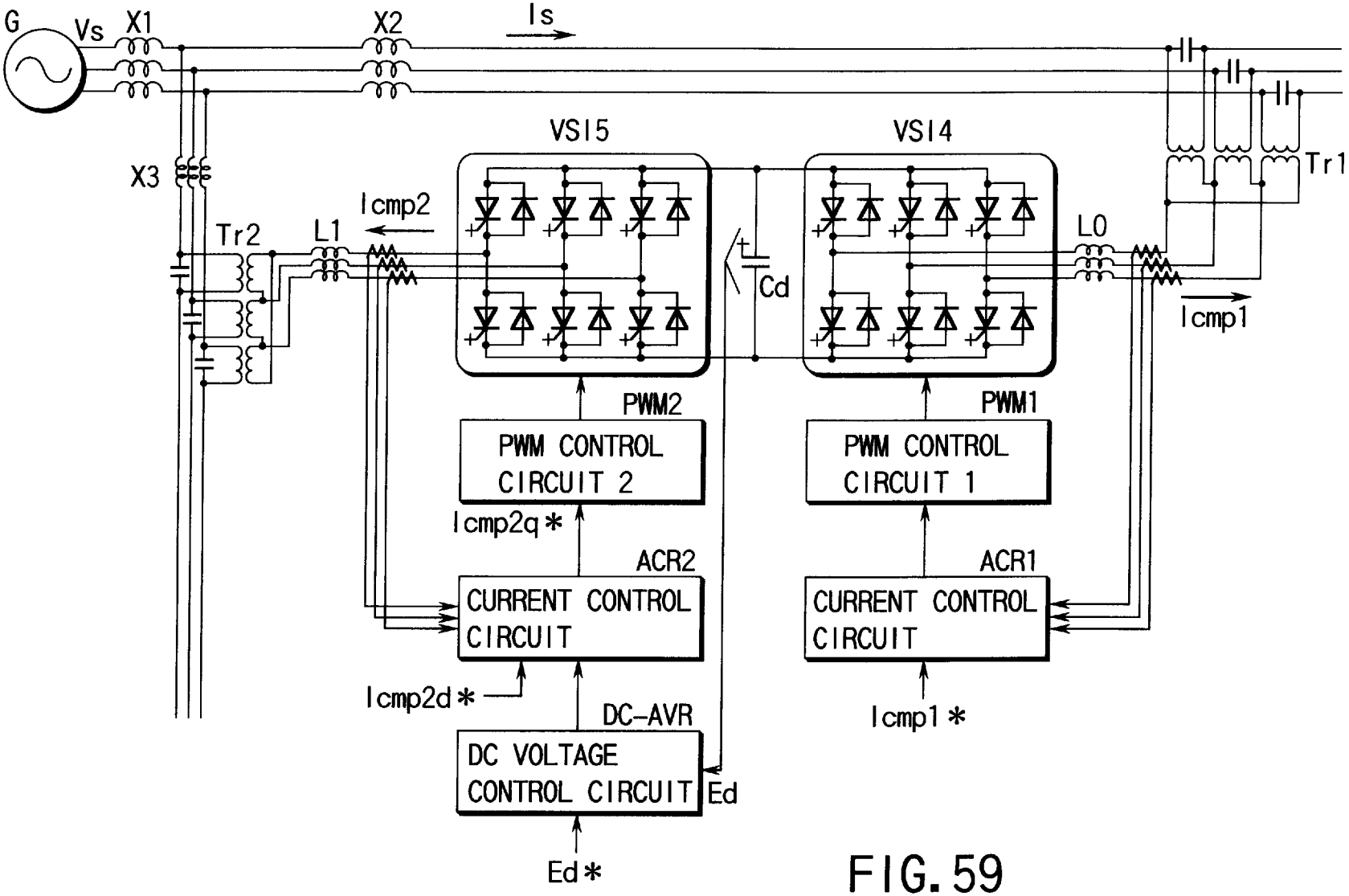
FIG. 59 is a block transmission line diagram illustrating a series compensator according to a thirty-first embodiment of this invention.
Figure 60:
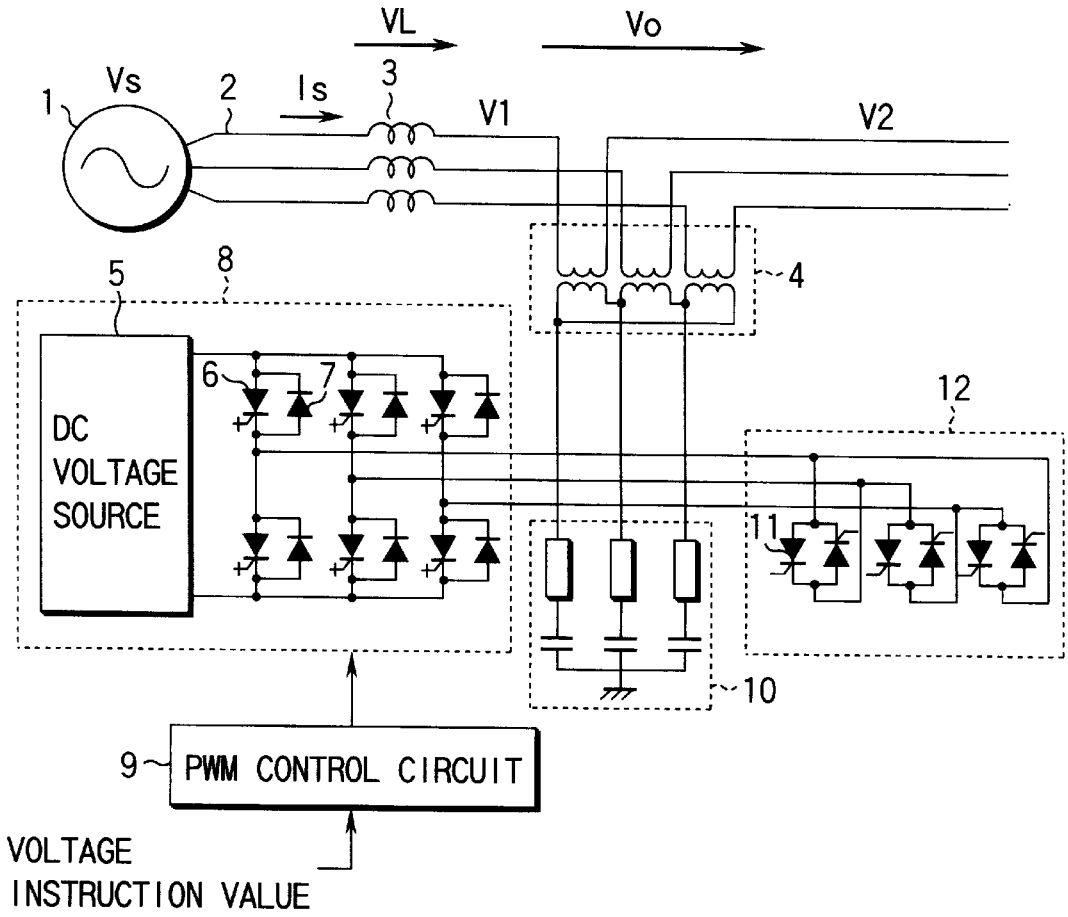
FIG. 60 PRIOR ART
FIG. 60 is a block diagram showing the transmission line structure of another conventional series compensator.
Figure 61:
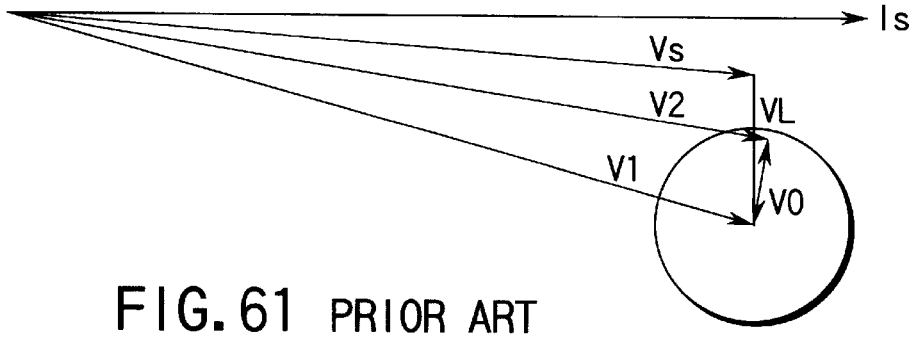
FIG. 61 PRIOR ART
FIG. 61 is a voltage/current vector diagram for the conventional series compensator.

FIG. 59 is a block transmission line diagram exemplifying the structure of a series compensator according to this embodiment, and the same reference numerals as used for the components of each of the first to eleventh embodiments are again used relative to corresponding components of this series compensator.

According to this embodiment, as shown in FIG. 59, the compensation current generator CMP1 comprises a series transformer Tr1, a first voltage source converter VSI4, which has GTOs as switching elements connected in three-phase rectifier connection, a PWM control transmission line PWM1 for generating a switching pattern for each GTO of the first voltage source converter VSI4, a current control transmission line ACR1 for controlling the output current of the first voltage source converter VSI4, a link reactor L0, a series capacitor C1 connected in series to an AC power supply different to the one to which the first voltage source converter VSI4 is connected, a series transformer Tr2 connected in parallel to the series capacitor C1, a second voltage source converter VSI5, which has GTOs as switching elements connected in three-phase rectifier connection, a PWM control transmission line PWM2 for generating a switching pattern for each GTO of the second voltage source converter VSI5, a current control transmission line ACR2 for controlling the output current of the second voltage source converter VSI5, a link reactor L1, a DC capacitor Cd for connecting the DC portion of the first voltage source converter VSI4 and the DC portion of the voltage current source converter VSI5, and a DC voltage control transmission line DC-AVR which controls the voltage across the DC capacitor Cd.

The link reactors L0 and L1 may be provided as independent reactors as in this embodiment, or may be achieved by designing the leak reactance of the transformer to be larger.

Since the detailed structure of the current control transmission line ACR1 has been discussed in the foregoing description of the thirteenth embodiment, its description will not be repeated here.

According to the thus constituted series compensator of this embodiment, a DC capacitor voltage Ed from the DC portion is input to the DC voltage control transmission line DC-AVR which outputs a current instruction Icmp2q* for producing a DV voltage equal to a DC voltage instruction Ed*.

The compensation current instruction Icmp2q* is input to the PWM control transmission line PWM2 to perform such control as to make the DC voltage of the second voltage source converter VSI5 become a target voltage amount.

At the same time, the output current Icmp2 of the second voltage source converter VSI5 is detected, the PWM control transmission line PWM2 outputs a current which becomes equal to a current instruction Icmp2d* having the same phase as or the opposite phase to that of the transmission line current, and the second voltage source converter VSI5 controls the current to be output to the AC power supply.

Accordingly, series compensation can be performed simultaneously with the AC power supply to which the first voltage source converter VSI4 is connected and the AC power supply to which the second voltage source converter VSI5 is connected.

Even if large power fluctuation occurs in the AC power supply to which the first voltage source converter VSI4 is connected, the second voltage source converter VSI5 is normal and can provide a reliable DC voltage.

Accordingly, the first voltage source converter VSI4 can supply various compensation voltages to the transmission line and can suppress the transmission line fluctuation.

Although the foregoing description of this embodiment has been given with reference to the structure wherein a single voltage source converter connected in three-phase bridge rectifier connection is used as each of the first voltage source converter VSI4 and the second voltage source converter VSI5 for the sake of simpler description, a plurality of voltage source converters may be connected in a multiplexing form to achieve a large capacity.

In the following description of individual embodiments, protection systems for the series compensators will be explained.

Thirty-second Embodiment

Figure 62:
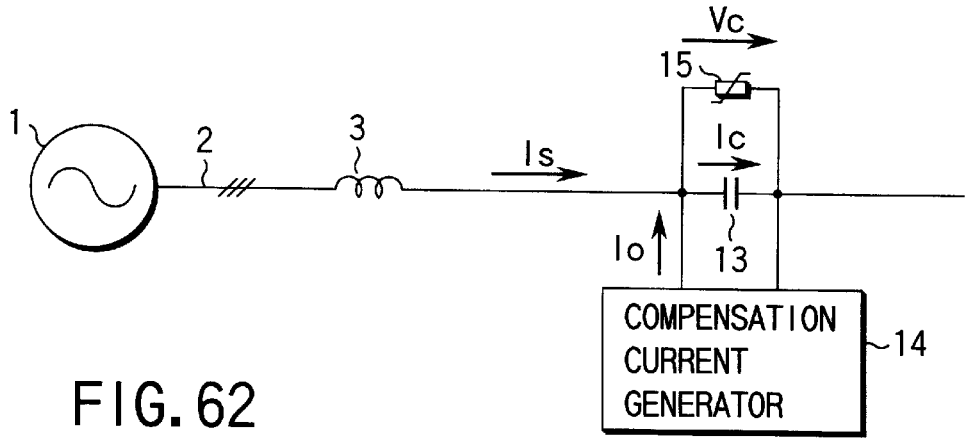
FIG. 62 is a structural diagram showing a series compensator according to a thirty-second embodiment of this invention.

FIG. 62 is a block transmission line diagram exemplifying the structure of a series compensator according to this embodiment.

In FIG. 62, reference numerals "11", "2" and "3" respectively denote an AC transmission line voltage source, AC transmission lines and the line reactance of the AC transmission lines which have already been discussed in the section of the prior art.

Referring to this figure, "13" is a series capacitor, "14" is a compensation current generator and "15" is a non-linear resistor element. The series capacitor 13 is connected in parallel to the compensation current generator 14, so that the voltage produced in the series capacitor 13 can be adjusted by controlling the output current of the compensation current generator 14.

Figure 63:
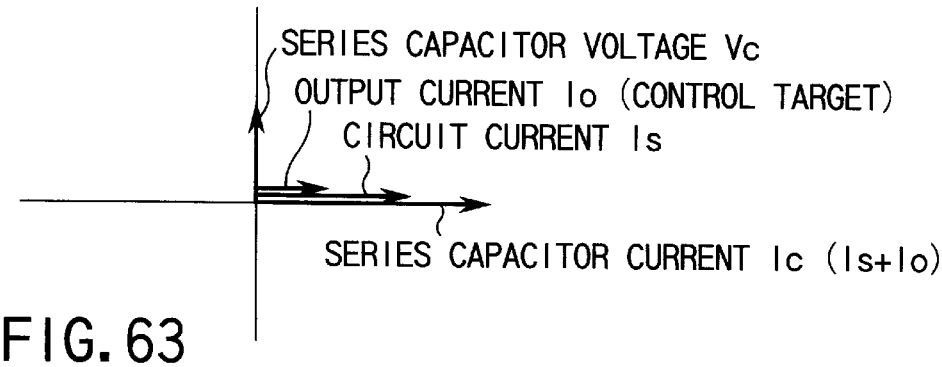
FIG. 63 is a voltage/current vector diagram for explaining the operation of the series compensator in FIG. 62.

The relationship between the current and voltage will be specifically discussed with reference to the vector diagram of FIG. 63. It is assumed that the transmission line current Is is constant. As the compensation current generator 14 can output an arbitrary output current Io and a series capacitor current Ic which flows through the series capacitor 13 is Is+Io, the series capacitor current can be varied by controlling Io. Given that a series capacitor voltage vc is positive in the arrow-head direction, the series capacitor voltage Vc is generated in such a direction that its phase is ahead of the phase of the series capacitor current Ic by 90 degrees. Given that the output current Io of the compensation current generator 14 is in phase with the transmission line current Is as shown in FIG. 63, it is possible to alter only the level of the series capacitor current Ic while keeping it in phase with the transmission line current Is. Accordingly, the series capacitor voltage Vc changes with a phase difference of 90 degrees to the transmission line current Is, thereby allowing the series capacitor 13 to adjust the impedance that is produced in series to the AC transmission lines.

Figure 64:
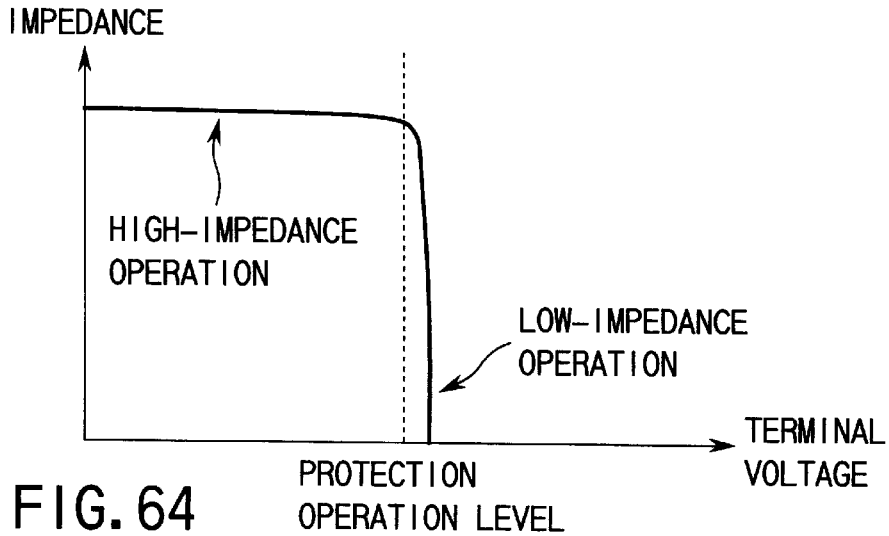
FIG. 64 shows the impedance characteristic of a nonlinear resistor element.

The non-linear resistor element 15 is connected in parallel to the series capacitor 13 and the compensation current generator 14. FIG. 64 shows the impedance characteristic of this non-linear resistor element 15. The protection operation level of the non-linear resistor element is such a specific voltage at which the impedance characteristic changes when a potential difference is produced between the terminals of the non-linear resistor element. When the voltage between the terminals of the non-linear resistor element is smaller than the protection operation level, the high-impedance operation takes place so that the current hardly flows across the non-linear resistor element. When the voltage between the terminals of the non-linear resistor element is higher than the protection operation level, on the other hand, the low-impedance operation takes place, causing the current to flow across the non-linear resistor element.

The protection operation level of the non-linear resistor element is set higher than the peak value of the normal operation voltage of the series capacitor 13. If the instantaneous value of the series capacitor voltage Vc lies in a voltage range lower than the protection operation level, therefore, the non-linear resistor element 15 performs the high-impedance operation so that the current hardly flows across the non-linear resistor element 15. This makes it possible to regard the non-linear resistor element as not being used.

Suppose a transmission line fault, such as a ground fault, occurs in the transmission lines, increasing the transmission line current. As the output current Io of the compensation current generator 14 is controlled, the transmission line current Is flows in the series capacitor 13, raising the series capacitor voltage Vc. When the rising series capacitor voltage Vc reaches the protection operation level of the non-linear resistor element 15, the non-linear resistor element 15 goes to the low-impedance mode, causing the transmission line current Is to flow across the non-linear resistor element 15. The use of the non-linear resistor element 15 can thus suppress a voltage rise and an excess current with respect to the series capacitor 3 and, at the same time, can protect the compensation current generator 14 against an excess voltage.

This structure can protect the series capacitor and the compensation current generator without requiring the thyristor bypass transmission line that is used in the conventional series compensator, and is thus advantageous in cost and siting space. While the thyristor bypass transmission line requires a special control transmission line to enable the thyristors, the non-linear resistor element does not require such a control transmission line and can ensure a faster protection operation, improving the reliability of the protecting apparatus.

Thirty-third Embodiment

Figure 65:
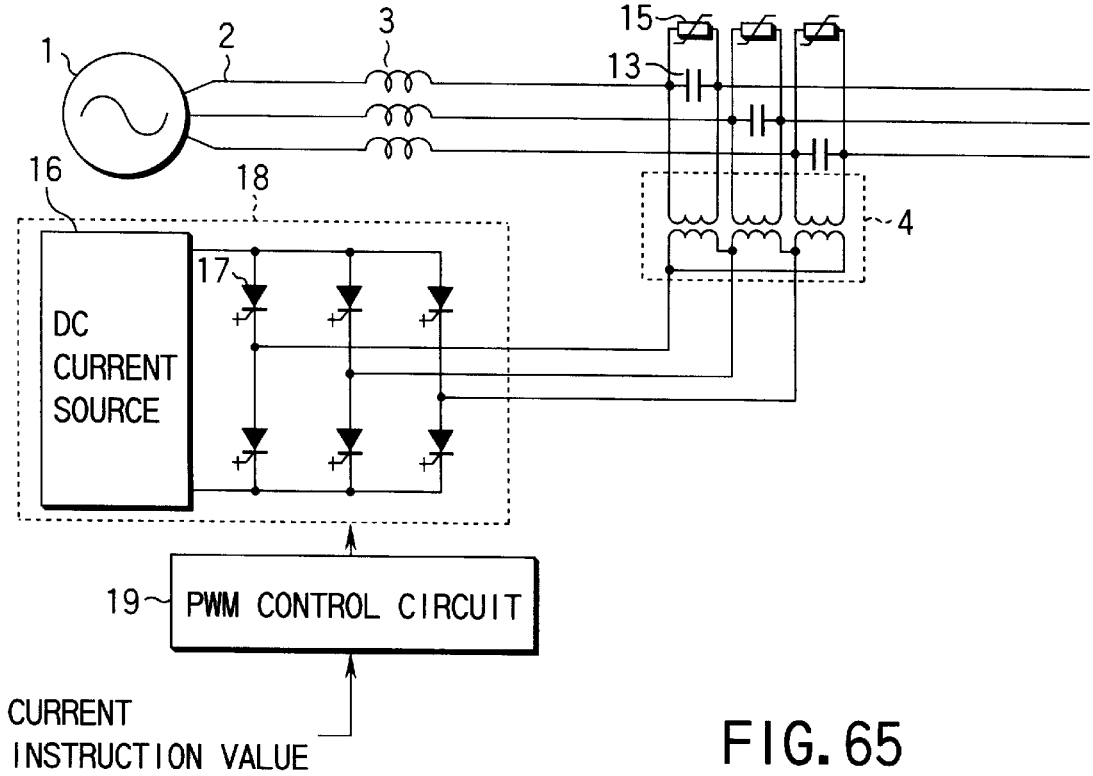
FIG. 65 is a structural diagram showing a series compensator according to a thirty-third embodiment of this invention.

FIG. 65 is a block transmission line diagram exemplifying the structure of a series compensator according to this embodiment.

In FIG. 65, "16" is a DC current source and "17" denotes a switching device with intrinsic turn-off capabilities. A current source converter 18 is constituted by the DC current source 16 and the switching elements 17. A PWM control transmission line 19 determines the switching pattern of the switching elements 17 based on a current instruction value. Upon reception of the current instruction value, the PWM control transmission line 19 outputs a switching signal for the switching elements 17 of the current source converter 18. In accordance with the switching signal from the PWM control transmission line 19, the switching elements 17 perform the ON/OFF action to transform the output current of the DC current source 16 into an AC sequence of pulses, thereby converting the output current of the current source converter 18 to an AC current. As this output current flows through the series transformer 4 into the series capacitor 13, the terminal voltage of the series capacitor 13 can be variable by which the line impedance 3 of the AC transmission lines can be controlled.

When a transmission line fault such as a ground fault occurs in the transmission line in FIG. 65, the transmission line current increases, raising the terminal voltage of the series capacitor 13. When this terminal voltage of the series capacitor 13 exceeds the protection operation level of the non-linear resistor element 15, the increased transmission line current flows across the non-linear resistor element 15, thereby protecting the series capacitor 13 against the excess voltage. The suppression of the rise in the series capacitor voltage can protect the current source converter 8 against the excess voltage as well as protect the series capacitor 13.

This embodiment can therefore protect the entire series compensator against the excess current with the non-linear resistor element having a simple structure, without requiring the thyristor bypass transmission line that is needed in the conventional series compensator, when a transmission line fault occurs. This embodiment is therefore advantageous in cost and siting area. While the thyristor bypass transmission line requires a special control transmission line to enable the thyristors, the non-linear resistor element does not require such a control transmission line and can ensure a faster protection operation, improving the reliability of the protecting apparatus.

Thirty-fourth Embodiment

Figure 66:
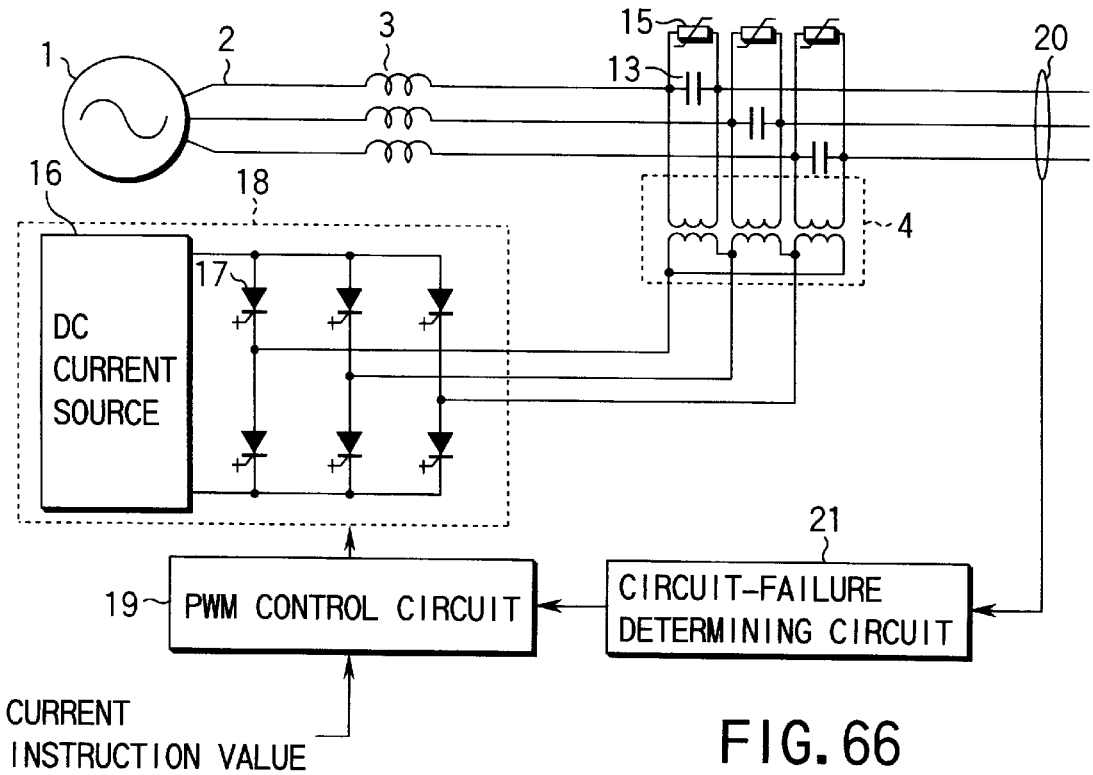
FIG. 66 is a structural diagram showing a series compensator according to a thirty-fourth embodiment of this invention.

FIG. 66 is a block transmission line diagram exemplifying the structure of a series compensator according to this embodiment.

In FIG. 66, "20" denotes a transmission line voltage/current detector and "21" denotes a line-failure determining transmission line.

The voltage/current signal that has been detected by the transmission line voltage/current detector 20 is input to the line-failure determining transmission line 21 which determines if a transmission line fault has occurred. If the line-failure determining transmission line 21 determines that a transmission line fault has occurred, the PWM control transmission line 19 short-circuits at least one arm of the switching elements 17 in the current source converter 18, thereby stopping the output current of the current source converter 18. This disconnects the converter from the AC transmission lines. If the line-failure determining transmission line 21 determines that the transmission line fault has been eliminated, the series compensator can resume the transmission line impedance compensating operation.

As the current source converter 18 is stopped during a transmission line fault, the current source converter can be protected by a simple transmission line structure and a simple control transmission line. It is also possible to permit the series compensator to promptly resume the transmission line impedance compensating operation after elimination of a transmission line fault.

Thirty-fifth Embodiment

Figure 67:
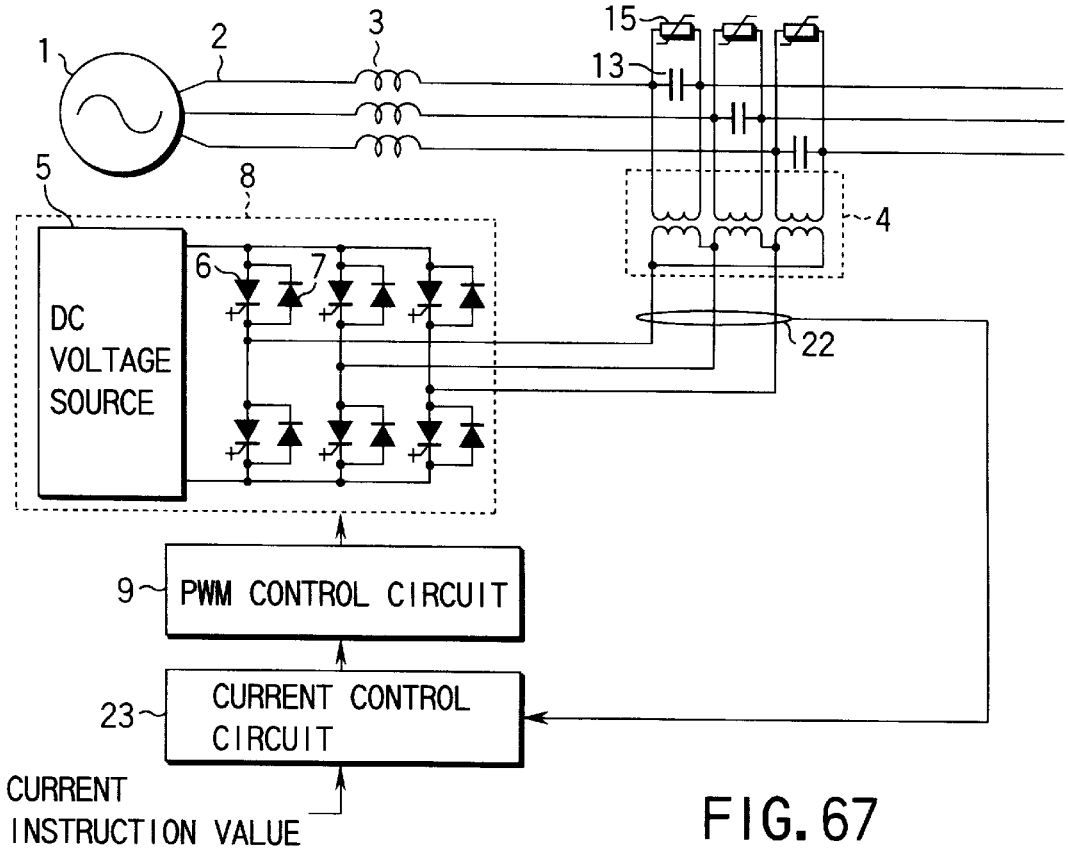
FIG. 67 is a structural diagram showing a series compensator according to a thirty-fifth embodiment of this invention.

FIG. 67 is a block transmission line diagram exemplifying the structure of a series compensator according to this embodiment.

In FIG. 67, "22" is an output current detector and "23" is a current control transmission line.

The output current detector 22 detects the current that is output from the voltage source converter 8 and sends its output signal to the current control transmission line 23. The current control transmission line 23 acquires the difference between the detected current signal and a current instruction value, and sends such a control signal to the PWM control transmission line 9 as to make the difference smaller. The voltage source converter 8 carries out the ON/OFF operation of its switching elements 6 in accordance with the output signal of the PWM control transmission line 9. The output current of the converter is determined by the difference between the output voltage of the converter and the terminal voltage of the series capacitor 13 and the leak inductance of the series transformer 4. Suppressing the output voltage of the voltage source converter 8 can control the output current of the converter. This can make the series capacitor voltage variable, thereby allowing the line impedance 3 of the AC transmission lines to be controlled.

When a transmission line fault such as a ground fault occurs in the transmission line in FIG. 67, the transmission line current increases, raising the terminal voltage of the series capacitor 13. When this terminal voltage of the series capacitor 13 exceeds the protection operation level of the non-linear resistor element 15, the increased transmission line current flows across the non-linear resistor element 15, thereby protecting the series capacitor 13 against the excess voltage. The suppression of the rise in the series capacitor voltage can protect the current source converter 8 against the excess voltage as well as protect the series capacitor 13.

This embodiment can therefore protect the entire series compensator against the excess current with the non-linear resistor element having a simple structure, without requiring the thyristor bypass transmission line that is needed in the conventional series compensator, when a transmission line fault occurs. This embodiment is therefore advantageous in cost and siting area. While the thyristor bypass transmission line requires a special control transmission line to enable the thyristors, the non-linear resistor element does not require such a control transmission line and can ensure a faster protection operation, improving the reliability of the protecting apparatus.

Thirty-sixth Embodiment

Figure 68:
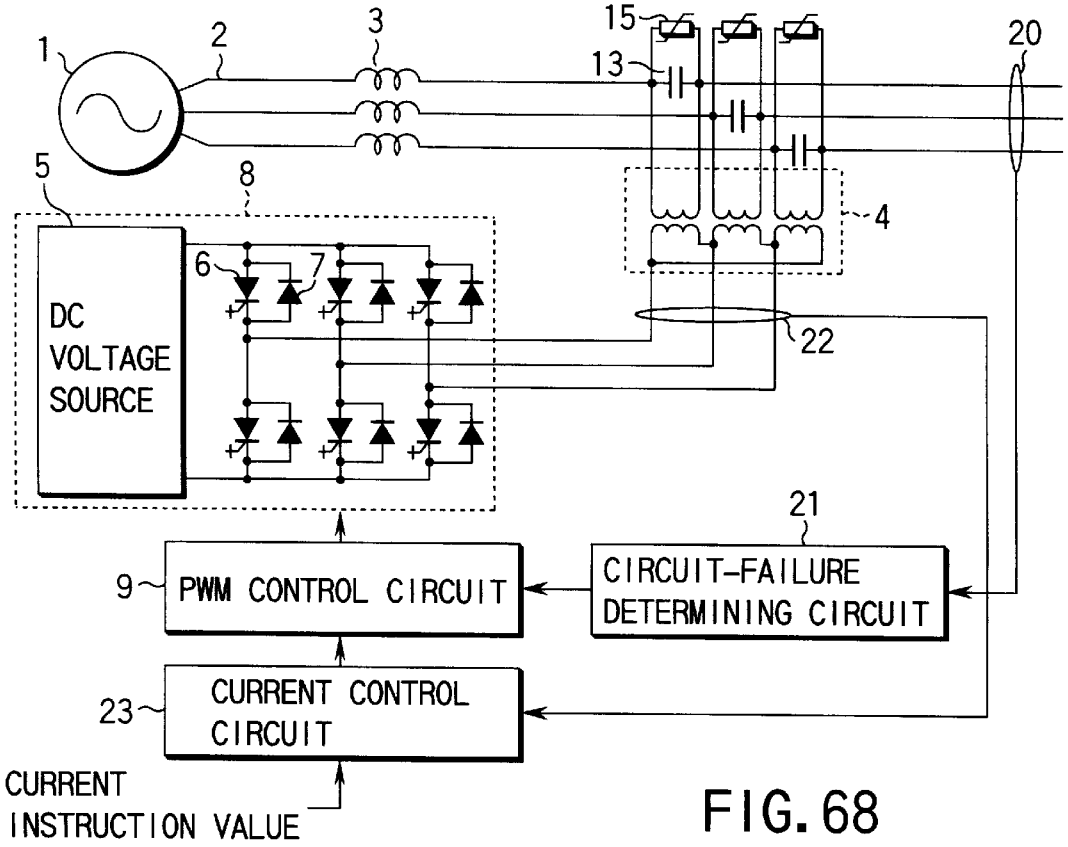
FIG. 68 is a structural diagram showing a series compensator according to a thirty-sixth embodiment of this invention.

FIG. 68 is a block transmission line diagram exemplifying the structure of a series compensator according to this embodiment.

The voltage/current signal that has been detected by the transmission line voltage/current detector 20 is input to the line-failure determining transmission line 21 which in turn determines if a transmission line fault has occurred. If the line-failure determining transmission line 21 determines that a transmission line fault has occurred, the PWM control transmission line 9 disables all the switching elements in the voltage source converter 8, thereby disconnecting the voltage source converter 8 from the AC transmission lines. If the line-failure determining transmission line 21 determines thereafter that the transmission line fault has been eliminated, the series compensator can promptly resume the transmission line impedance compensating operation. As the voltage source converter is stopped during a transmission line fault, the current source converter can be protected by a simple transmission line structure and a simple control transmission line. It is also possible to permit the series compensator to promptly resume the transmission line impedance compensating operation after elimination of a transmission line fault.

Thirty-seventh Embodiment

Figure 69:
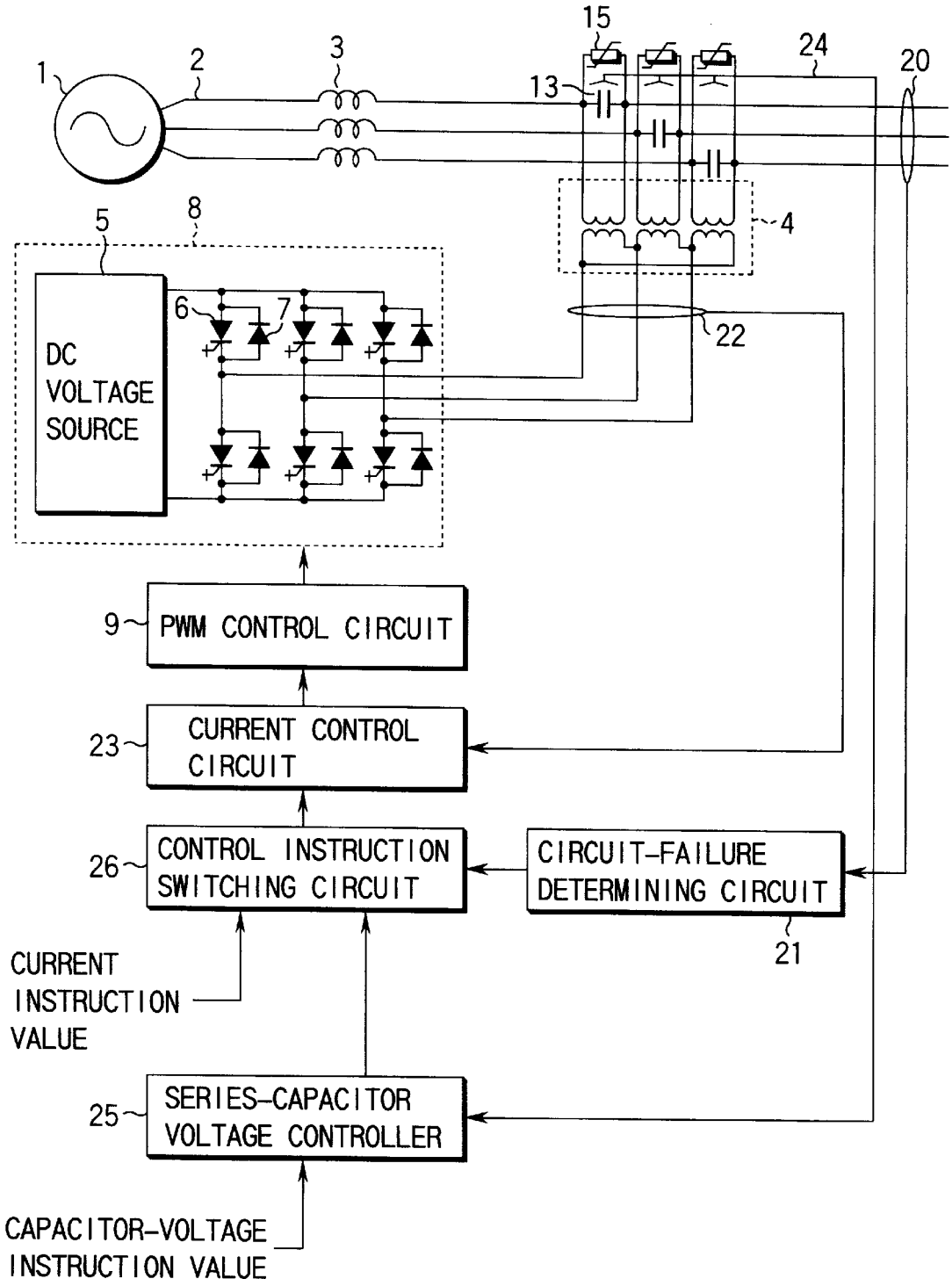
FIG. 69 is a structural diagram showing a series compensator according to a thirty-seventh embodiment of this invention.

FIG. 69 is a block transmission line diagram exemplifying the structure of a series compensator according to this embodiment.

In FIG. 69, "24" is a series-capacitor voltage detector which detects the terminal voltage of the series capacitor, and "25" is a series-capacitor voltage controller which controls the voltage of the series capacitor. A control instruction switching transmission line 26 switches control instruction values from one to another based on the output of the circuit-failure determining transmission line 21. The voltage signal that has been detected by the series-capacitor voltage detector 24 is input to the series-capacitor voltage controller 25. The series-capacitor voltage controller 25 acquires the difference between the voltage control signal and a series-capacitor-voltage instruction value and sends such a control signal as to make the difference smaller to the current control transmission line 23 through the control instruction switching transmission line 26. The current control transmission line 23 acquires the difference between the control signal from the series-capacitor voltage controller 25 and the current detection signal from the current detector 20 and sends such a control signal to the PWM control transmission line 9 as to reduce the difference. Upon reception of the output of the current control transmission line 23, the PWM control transmission line 9 outputs the switching signal for the switching elements in the voltage source converter 8. As a result, the switching elements in the voltage source converter 8 perform the ON/OFF action to control the output current. This achieves the adjustment of the series capacitor voltage which is the upper-rank control. The voltage/current signal detected by the transmission line voltage/ detector 20 for the AC transmission lines is input to the line-failure determining transmission line 21 which in turn determines if a transmission line fault has occurred.

Here, the protection operation level of the non-linear resistor elements is set low with respect to the maximum value of the output voltage of the voltage source converter in such a fashion that the voltage source converter can output the voltage waveform that is produced in the series capacitor during a transmission line fault.

If the circuit-failure determining transmission line 21 determines that a transmission line fault has occurred, the control instruction switching transmission line 26 switches the control input to the current control transmission line 23 from the output signal of the series-capacitor voltage controller 25 to the current instruction value. If the current instruction value is zero, the voltage source converter can output a voltage equivalent to the series capacitor voltage at the time of occurrence of the transmission line fault. This can allow the voltage source converter to continue its operation even during the transmission line fault while controlling the output current down to zero. Depending on the protection operation level set, the current that has been output from the converter before the occurrence of a transmission line fault can also be output during the transmission line fault, thereby ensuring a continuous operation.

Accordingly, the operation can continue even during a transmission line fault without disabling the converter and the AC transmission lines can be restored to the normal state with the converter kept operating when the transmission line fault is removed. This can ensure very fast restoring to the series compensating operation.

Thirty-eighth Embodiment

Figure 70:
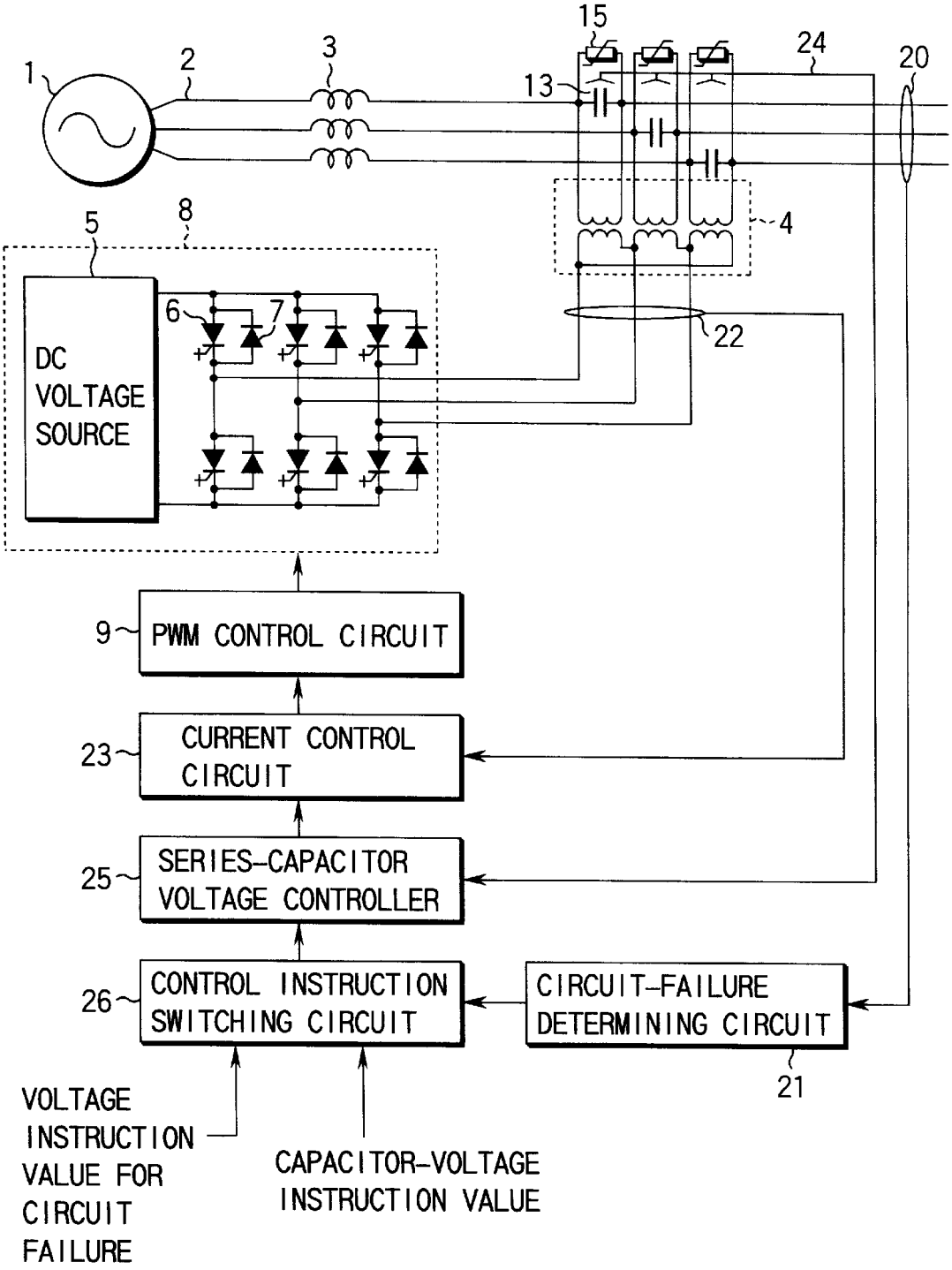
FIG. 70 is a structural diagram showing a series compensator according to a thirty-eighth embodiment of this invention.

FIG. 70 is a block transmission line diagram exemplifying the structure of a series compensator according to this embodiment.

The voltage/current signal that has been detected by the transmission line voltage/current detector 20 is input to the line-failure determining transmission line 21 which determines if a transmission line fault has occurred. If the line-failure determining transmission line 21 determines that a transmission line fault has occurred, this transmission line sends a signal to the control instruction switching transmission line 26 to switch the instruction value of the series-capacitor voltage controller 25 to a voltage instruction value for a transmission line fault from the capacitor-voltage instruction value.

Here, the protection operation level of the non-linear resistor elements is set low with respect to the maximum value of the output voltage of the voltage source converter in such a fashion that the voltage source converter can output the voltage waveform that is produced in the series capacitor during a transmission line fault.

Assume that the series capacitor voltage during a transmission line fault is used directly as the line-failure-time voltage instruction value. Because the voltage source converter can output the series capacitor voltage even during the fault by properly setting the protection operation level of the non-linear resistor elements, the converter output voltage is equal to the series capacitor voltage. The voltage source converter can therefore maintain the operation with the output current made to nearly zero.

Accordingly, the operation can continue even during the fault without disabling the converter and the AC transmission lines can be restored to the normal state with the converter kept operating when the fault is removed. This can ensure very fast restoring to the series compensating operation.

As described above, the series compensator embodying this invention can eliminate the need for a bypass transmission line to thereby simplify the main transmission line and has an enhanced compensation current controllability to reduce harmonics to be generated.

Further, the use of a series capacitor can economically achieve a large amount of compensation current while suppressing the capacity of the power converter portion.

It is also possible to control power fluctuation in the transmission line and control suppression of a DC component in a series capacitor.

Moreover, according to the present invention, the compensation current generator connected in parallel to the series capacitor has non-linear resistor elements connected in parallel to the series capacitor to thereby suppress the series capacitor voltage that is produced by an excess current at the time a transmission line fault occurs. This simple protection device can protect the series capacitor and the compensation current generator against the excess current and excess voltage that are originated from a transmission line fault. It is also possible to keep the converter unstopped and operating even during a transmission line fault and permit the series compensator to promptly resume the series compensating operation after the fault is eliminated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A series compensator, for compensating for an electric amount of an AC transmission line, comprising:

a first capacitor and a second capacitor connected in series to each other and connected to said AC transmission line; and a compensation circuit generator connected in parallel to said first capacitor, said compensation current generator being configured to generate a compensation current applied to said parallel connected first capacitor.

2. The series compensator according to claim 1, wherein said second capacitor has a plurality of capacitors connected in series to one another and a plurality of switches respectively connected in parallel to said plurality of capacitors.

3. A series compensator, for compensating for an electric amount of an AC transmission line, comprising:

a transformer connected in series to said AC transmission line;

a first capacitor connected via said transformer to said AC transmission line; and a compensation current generator connected in parallel to said first capacitor, said compensation current generator being configured to generate a compensation current applied to said parallel connected first capacitor.

4. A series compensator for compensating for an electric amount of an AC transmission line, comprising:

a transformer connected in series to said AC transmission line;

a first capacitor and a second capacitor connected in series to each other and connected via said transformer to said AC transmission line; and a compensation current generator connected in parallel to said first capacitor, said compensation current generator being configured to generate a compensation current to be applied to said parallel connected first capacitor.

5. The series compensator according to claim 4, wherein said second capacitor has a plurality of capacitors connected in series to one another and a plurality of switches respectively connected in parallel to said plurality of capacitors.

6. The series compensator according to claim 1, wherein said compensation current generator has a transformer and a current source converter using switching elements connected to said transformer.

7. The series compensator according to claim 1, wherein said compensation current generator has a transformer, a voltage source converter using switching elements connected to said transformer and a current control transmission line for controlling an output current of said voltage source converter.

8. The series compensator according to claim 3, wherein said compensation current generator has a voltage source converter using switching elements and a current control transmission line for controlling an output current of said voltage source converter.

9. The series compensator according to claim 1, wherein said compensation current generator generates a current having a phase same as or opposite to that of a current of said AC transmission line based on said current of said AC transmission line.

10. The series compensator according to claim 1, further comprising:

a detection transmission line for detecting a current flowing in said AC transmission line and a voltage thereof;

a calculation transmission line for calculating an active current component and reactive current component flowing in said AC transmission line; and a fluctuation control transmission line for generating a compensation current instruction to suppress fluctuation in said AC transmission line based on a ratio of a change in said current, a variation in said active current component and a variation in said reactive current component.

11. The series compensator according to claim 1, further comprising:

a capacitor voltage detection transmission line for detecting a voltage across said first capacitor connected in series to said AC transmission line;

a DC component calculation transmission line for calculating a DC voltage component of said first capacitor from an output of said capacitor voltage detection transmission line; and a DC component suppressing transmission line for generating a compensation current instruction based on a signal obtained by compensating an amplitude and phase of an output of said DC component calculation transmission line.

12. The series compensator according to claim 11, wherein said capacitor voltage detection transmission line has a detection transmission line for detecting a transmission line current flowing in said AC transmission line and an integration transmission line for calculating a voltage across said first capacitor connected in series to said AC transmission line.

13. The series compensator according to claim 1, wherein said compensation current generator has a transformer, a first current source converter using switching elements connected to said transformer, a second current source converter connected in parallel to said AC transmission line using switching elements, a reactor for connecting a DC portion of said first current source converter and a DC portion of said second current source converter and a DC current control transmission line for controlling a current across said reactor.

14. The series compensator according to claim 3, wherein said compensation current generator has a first current source converter using switching elements, a second current source converter connected in parallel to said AC transmission line using switching elements, a reactor for connecting a DC portion of said first current source converter and a DC portion of said second current source converter and a DC current control transmission line for controlling a current across said reactor.

15. The series compensator according to claim 1, wherein said compensation current generator has a transformer, a first voltage source converter using switching elements connected to said transformer, a second voltage source converter connected in parallel to said AC transmission line using switching elements, a third capacitor for connecting a DC portion of said first voltage source converter, a first current control transmission line for controlling an output current of said first voltage source converter, a second current control transmission line for controlling an output current of said second voltage source converter, and a DC portion of said second voltage source converter and a DC voltage control transmission line for controlling a voltage across said third capacitor.

16. The series compensator according to claim 3, wherein said compensation current generator has a first voltage source converter using switching elements, a second voltage source converter connected in parallel to said AC transmission line using switching elements, a second capacitor for connecting a DC portion of said first voltage source converter, a first current control transmission line for controlling an output current of said first voltage source converter, a second current control transmission line for controlling an output current of said second voltage source converter, and a DC portion of said second voltage source converter and a DC voltage control transmission line for controlling a voltage across said second capacitor.

17. The series compensator according to claim 1, wherein said compensation current generator has a transformer, a first current source converter using switching elements connected to said transformer, a second current source converter using a series transformer connected in series to another AC transmission line and switching elements, a reactor for connecting a DC portion of said first current source converter and a DC portion of said second current source converter and a DC current control transmission line for controlling a current across said reactor.

18. The series compensator according to claim 1, wherein said compensation current generator has a transformer, a first voltage source converter using switching elements connected to said transformer, a second voltage source converter using a series transformer connected in series to another AC transmission line and switching elements, a third capacitor for connecting a DC portion of said first voltage source converter, a first current control transmission line for controlling an output current of said first voltage source converter, a second current control transmission line for controlling an output current of said second voltage source converter, and a DC portion of said second voltage source converter and a DC voltage control transmission line for controlling a voltage across said third capacitor.

19. A series compensator comprising:

a series capacitor connected in series to an AC transmission line;

a compensation current generator connected in parallel to said series capacitor, said compensation current generator being configured to generate a compensation current to be applied to said parallel connected series capacitor; and a non-linear resistor element connected in parallel to said series capacitor.

20. The series compensator according to claim 19, wherein said compensation current generator has a current source converter using a series transformer and switching elements.

21. The series compensator according to claim 20, further comprising:

a detection transmission line for detecting a voltage or a current of said AC transmission line connected to said series compensator; and a transmission line for enabling a same arm of switching elements in said current source converter, thereby short-circuiting upper and lower ends of said arm, when a fault is detected by said detection transmission line.

22. The series compensator according to claim 20, wherein said compensation current generator has a voltage source converter using a series transformer and switching elements; and said series compensator further includes a current control transmission line for controlling an output current of said voltage source converter.

23. The series compensator according to claim 22, further comprising:

a detection transmission line for detecting a voltage or a current of said AC transmission line connected to said series compensator; and a transmission line for blocking a gate of said voltage source converter and disabling all of said switching elements when a fault is detected by said detection transmission line.

24. The series compensator according to claim 22, further comprising:

a detection transmission line for detecting a voltage or a current of said AC transmission line connected to said series compensator; and a transmission line for controlling an output current when a fault is detected by said detection transmission line, thereby permitting said voltage source converter to keep operating even during said fault.

25. The series compensator according to claim 22, further comprising:

a voltage control transmission line for controlling an output voltage of said series compensator;

a detection transmission line for detecting a voltage or a current of said AC transmission line connected to said series compensator; and a transmission line for controlling said output voltage when a fault is detected by said detection transmission line, thereby permitting said voltage source converter to keep operating even during said fault.

* * * * *